US010625885B2

(12) United States Patent
Koike et al.

(10) Patent No.: US 10,625,885 B2
(45) Date of Patent: Apr. 21, 2020

(54) MEDICINE DISPENSING APPARATUS

(71) Applicant: YUYAMA MFG. CO., LTD., Toyonaka-shi, Osaka (JP)

(72) Inventors: Naoki Koike, Toyonaka (JP); Ryosuke Fukamori, Toyonaka (JP); Hikaru Katayama, Toyonaka (JP); Takuma Hiraoka, Toyonaka (JP)

(73) Assignee: YUYAMA MFG. CO., LTD., Toyonaka-Shi, Osaka (JP)

( * ) Notice: Subject to any disclaimer, the term of this patent is extended or adjusted under 35 U.S.C. 154(b) by 270 days.

(21) Appl. No.: 15/735,520

(22) PCT Filed: Jun. 24, 2016

(86) PCT No.: PCT/JP2016/068763
§ 371 (c)(1),
(2) Date: Dec. 11, 2017

(87) PCT Pub. No.: WO2017/002713
PCT Pub. Date: Jan. 5, 2017

(65) Prior Publication Data

US 2018/0170591 A1 Jun. 21, 2018

(30) Foreign Application Priority Data

Jun. 29, 2015 (JP) ..... 2015-130269
Nov. 30, 2015 (JP) ..... 2015-234279

(51) Int. Cl.
*B65B 5/10* (2006.01)
*B65B 9/067* (2012.01)
(Continued)

(52) U.S. Cl.
CPC ..... *B65B 5/103* (2013.01); *A61J 3/00* (2013.01); *B65B 1/10* (2013.01); *B65B 1/30* (2013.01);
(Continued)

(58) Field of Classification Search
CPC .. B65B 5/103; B65B 1/10; B65B 1/30; B65B 57/14; B65B 41/12; B65B 5/022; A61J 3/00
See application file for complete search history.

(56) References Cited

U.S. PATENT DOCUMENTS

2006/0201109 A1* 9/2006 Van Eenoo ..... B65B 5/103 53/250
2010/0077708 A1* 4/2010 Kobayashi ..... B65B 5/103 53/501
(Continued)

FOREIGN PATENT DOCUMENTS

CN 102802588 A 11/2012
CN 204223278 U 3/2015
(Continued)

OTHER PUBLICATIONS

ISA/JPO, International Search Report issued in PCT/JP2016/068763, dated Aug. 30, 2016, total 4 pages with English translation.
(Continued)

*Primary Examiner* — David F Dunphy
(74) *Attorney, Agent, or Firm* — Masuvalley & Partners

(57) ABSTRACT

A medicine packaging apparatus 10 has a medicine preparing and dispensing portion 20, a packaging portion 150, a pre-packaging photographing portion 100 for reading identification information attached to a medicine in a phase before the medicines are packaged by the packaging portion 150, an individually supplying portion 60 which can individually supply the plurality of medicines received from the side of the medicine preparing and dispensing portion 20 to the side of the pre-packaging photographing portion 100 and a control part 200. The individually supplying portion 60 includes a receiving portion 72 for receiving the medicines from the side of the medicine preparing and dispensing portion 20 and a delivering device 64 which can perform a
(Continued)

delivery action for delivering the medicines by individually holding the medicines in the receiving portion 72 and releasing the medicines toward the side of the pre-packaging photographing portion 100. The control part 200 perform an inspection process based on the identification information read by the pre-packaging photographing portion 100.

17 Claims, 34 Drawing Sheets

(51) Int. Cl.

| | |
|---|---|
| ***B65B 35/42*** | (2006.01) |
| ***B65B 41/12*** | (2006.01) |
| ***B65B 57/14*** | (2006.01) |
| ***B65B 5/02*** | (2006.01) |
| ***B65B 1/30*** | (2006.01) |
| ***A61J 3/00*** | (2006.01) |
| ***B65B 1/10*** | (2006.01) |

(52) U.S. Cl.
CPC ..... *B65B 5/022* (2013.01); *B65B 9/067* (2013.01); *B65B 35/42* (2013.01); *B65B 41/12* (2013.01); *B65B 57/14* (2013.01)

(56) References Cited

U.S. PATENT DOCUMENTS

| | | | | |
|---|---|---|---|---|
| 2018/0016044 | A1* | 1/2018 | Kim | B65B 37/04 |
| 2018/0065765 | A1* | 3/2018 | Koike | A61J 3/00 |

FOREIGN PATENT DOCUMENTS

| | | | | | |
|---|---|---|---|---|---|
| JP | 05066203 | A | * | 3/1993 | G01N 21/9508 |
| JP | H05-66203 | A | | 3/1993 | |
| JP | 11206855 | A | * | 8/1999 | |
| JP | H11-206855 | A | | 8/1999 | |
| JP | 2000-175990 | A | | 6/2000 | |
| JP | 4034404 | B2 | | 1/2008 | |
| JP | 4439433 | B2 | | 3/2010 | |
| JP | 2011-104077 | A | | 6/2011 | |
| JP | 2013-158461 | A | | 8/2013 | |
| JP | 2013158461 | A | * | 8/2013 | |
| JP | 2013230875 | A | * | 11/2013 | B65B 9/08 |
| JP | 2014-223290 | A | | 12/2014 | |
| JP | 2014223290 | A | * | 12/2014 | |
| JP | 2015-000194 | A | | 1/2015 | |
| JP | 2015-002985 | A | | 1/2015 | |
| JP | 2015000194 | A | * | 1/2015 | |
| JP | 2015-054115 | A | | 3/2015 | |
| JP | 6196722 | B1 | * | 9/2017 | |
| WO | WO-2008120657 | A1 | * | 10/2008 | B65B 5/103 |
| WO | WO-2010038377 | A1 | * | 4/2010 | B65B 1/30 |
| WO | 2010106944 | A1 | | 9/2010 | |
| WO | 2011/108448 | A1 | | 9/2011 | |
| WO | WO-2011108448 | A1 | * | 9/2011 | B08B 7/02 |
| WO | 2012070643 | A1 | | 5/2012 | |
| WO | WO-2013002399 | A1 | * | 1/2013 | B65B 41/16 |
| WO | WO-2013002400 | A1 | * | 1/2013 | G07F 11/44 |
| WO | 2014/054447 | A1 | | 4/2014 | |

OTHER PUBLICATIONS

EPO, The Extended European Search Report dated Feb. 14, 2019 in EP Patent Application No. 16817821.8 11 pages.

* cited by examiner (a)

Fig. 22

(a)

| Package 3 for 7 days | Morning | Noon | Night |
|---|---|---|---|
| Medicine A (○) | 1 | 2 | 1 |
| Medicine B (△) | 1 | 1 | 1 |
| Medicine C (□) | 2 | 1 | 1 |
| Total | 4 | 4 | 3 |

(b)

| | 1st day | 2nd day | 3rd day | 4th day | 5th day | 6th day | 7th day |
|---|---|---|---|---|---|---|---|
| Morning (4 medicines) | ○ | ○ | ○ | ○ | ○ | ○ | ○ |
| | △ | △ | △ | △ | △ | △ | △ |
| | □ | □ | □ | □ | □ | □ | □ |
| | □ | □ | □ | □ | □ | □ | □ |
| Noon (4 medicines) | ○ | ○ | ○ | ○ | ○ | ○ | ○ |
| | ○ | ○ | ○ | ○ | ○ | – | ○ |
| | △ | △ | △ | △ | △ | △ | △ |
| | □ | □ | □ | □ | □ | □ | □ |
| | | | | | | | ○ |
| Night (3 medicines) | ○ | – | ○ | ○ | ○ | ○ | ○ |
| | △ | △ | △ | △ | △ | △ | △ |
| | □ | □ | □ | □ | □ | □ | □ |
| | | | ○ | | | | |

(a)

(b)

(a)

(b)

MEDICINE DISPENSING APPARATUS

TECHNICAL FIELD

The present invention relates to a medicine dispensing apparatus for inspecting a medicine such as a tablet, a capsule and a suppository before the medicine is packaged.

BACKGROUND ART

Heretofore, as an apparatus which can perform inspection related to medicine dispensing, there are provided an apparatus which photographs a medicine before the medicine is packaged to perform the inspection and an apparatus which photographs the medicine after the medicine has been packaged to perform the inspection.

For example, as the former apparatus, there is provided an apparatus which supplies only tablets required to be inspected on a turn table to photograph the tablets with a camera and then carries the tablets from a discharging hopper through a carrying conveyer to package the tablets for every one package with a packaging device as disclosed in patent document 1. Further, for example, as the latter apparatus, there is provided an apparatus which photographs tablets which have been packaged with a photographing device with illuminating the tablets with an illumination device to count the number of the tablets from an image of shadows of the tablets as disclosed in patent document 2.

PRIOR ART DOCUMENTS

Patent Documents

Patent document 1: JP 4034404B
Patent document 2: JP 4439433B

SUMMARY OF THE INVENTION

Problem to be Solved by the Invention

In the tablet packaging apparatus of the patent document 1, although the tablets required to be inspected can be photographed with the camera, a photographed surface of each tablet is limited to a surface (front surface) directed toward the side of the camera and it is impossible to photograph a rear surface of each tablet. Namely, the tablet packaging apparatus of the patent document 1 is configured to recognize an external view of a medicine based on an image photographed with the camera to identify medicine information. Thus, in the tablet packaging device of the patent document 1, any surface constituting the medicine may be photographed by the camera as long as it is possible to obtain an image from which an external shape of the tablet can be recognized. On the other hand, since the identification for the medicine is performed based on the external shape of the medicine, it requires a complex process such as image processing and further there is a concern that a sufficient inspection accuracy cannot be obtained in a case where other medicines having a similar external view is mistakenly handled or the like.

Further, in the case where the inspection is performed after the medicine has been packaged in packaging paper as disclosed in the patent document 2, the tablet is photographed in a state that the packaging paper intervenes. Thus, in the case of taking the configuration as disclosed in the patent document 2, there is a problem that it is difficult to read an engraved mark engraved on the surface of the medicine or the like and it is impossible to perform other inspection than the counting of the number of the medicines. Specifically, there is a problem that marks for a patient name, a medicine name or the like attached to the packaging paper are overlapped with the medicine and thus it is difficult to read information such as the engraved mark attached to the medicine.

Thus, the present invention is intended to provide a medicine packaging apparatus whose reading accuracy for identification information such as an engraved mark attached to a medicine is high and which can provide superior inspection performance.

Means for Solving the Problems

A medicine packaging apparatus of the present invention provided for solving the above-described problem is characterized by comprising a medicine preparing and dispensing portion for preparing medicines so that the medicines can be dispensed, a packaging portion for packaging the medicines dispensed from the medicine preparing and dispensing portion, a pre-packaging photographing portion including a medicine photographing device for photographing the medicines dispensed from the medicine preparing and dispensing portion in a phase before the medicines are packaged by the packaging portion, an individually supplying portion which can individually supply the plurality of medicines received from the side of the medicine preparing and dispensing portion to the side of the pre-packaging photographing portion, and a control part, wherein the control part includes a reading control part for reading identification information attached to the medicine based on an image photographed by the pre-packaging photographing portion and an inspection processing part for performing an inspection process based on the identification information read by the reading control part and prescription information.

In the medicine packaging apparatus of the present invention, it is possible to individually supply the plurality of medicines dispensed from the medicine preparing and dispensing portion to the side of the pre-packaging photographing portion according to the prescription information and photograph the medicines with the medicine photographing device in the phase before the medicines are packaged by the packaging portion. This makes it possible to obtain images by individually photographing the plurality of medicines dispensed from the medicine preparing and dispensing portion. Further, it is possible to read the identification information attached to the medicines with the reading control part based on the images obtained by photographing every medicine with the medicine photographing apparatus and perform the inspection process with the inspection processing part based on the read identification information and the prescription information. By taking such a configuration, it is possible to accurately inspect the medicines one by one.

The above-described medicine photographing device can be configured to photograph the medicines dispensed from the medicine preparing and dispensing portion in the phase before the medicines are packaged by the packaging portion and in a timing before the medicines drop into an inside of the packaging paper.

In the above-described medicine packaging apparatus of the present invention, it is preferable that the individually supplying portion includes a receiving portion for receiving the medicines from the side of the medicine preparing and dispensing portion and a delivering portion which can perform a delivery action for delivering the medicines by individually holding the medicines in the receiving portion and releasing the medicines toward the side of the pre-packaging photographing portion.

In the medicine packaging apparatus of the present invention, the medicines received from the side of the medicine preparing and dispensing portion into the receiving portion with the individually supplying portion can be individually held and supplied to the side of the pre-packaging photographing portion by the delivering portion. This makes it possible to allow the pre-packaging photographing portion to accurately read the identification information related to the medicines supplied through the individually supplying portion and it is possible to contribute to improvement of the inspection performance.

In the above-described medicine packaging apparatus of the present invention, it is preferable that the medicine preparing and dispensing portion includes a manually distributing portion into which the medicines can be distributed and from which the medicines can be dispensed and the medicines supplied into the manually distributing portion are supplied to the pre-packaging photographing portion through the individually supplying portion.

According to such a configuration, even if the plurality of medicines are dispensed from the manually distributing portion at one time, it is possible to individually and one by one supply the medicines to the pre-packaging photographing portion. This makes it possible to contribute improvement of a photographing accuracy for the medicines in the pre-packaging photographing portion and an inspection process accuracy in the inspection processing part.

In the above-described medicine packaging apparatus of the present invention, it is preferable that the medicine preparing and dispensing portion has a manually distributing portion into which the medicines can be distributed and from which the medicines can be dispensed and a cassette dispensing portion including a plurality of medicine cassettes which can store the medicines and individually dispense the stored medicines, wherein the medicines dispensed from the manually distributing portion reach the pre-packaging photographing portion in a path passing through the individually supplying portion and the medicines dispensed from the cassette dispensing portion reach the pre-packaging photographing portion in a path bypassing the individually supplying portion.

In the medicine dispensing apparatus of the present invention, the medicine preparing and dispensing portion includes the manually distributing portion and the cassette dispensing portion. The medicines prepared in the manually distributing portion are dispensed toward the pre-packaging photographing portion in the path passing through the individually supplying portion. Thus, even if the plurality of medicines are dispensed from the manually distributing portion at one time, it is possible to individually and one by one supply the medicines to the pre-packaging photographing portion. The medicines prepared in the cassette dispensing portion are dispensed toward the pre-packaging photographing portion with bypassing the individually supplying portion. The cassette dispensing portion is configured to individually dispense the medicines stored in the medicine cassette. Thus, even if the medicines dispensed from the cassette dispensing portion are supplied to the pre-packaging photographing portion without passing through the individually supplying portion, it is possible to individually and one by one supply the medicines to the pre-packaging photographing portion. As described above, in the medicine packaging apparatus of the present invention, it is also possible to one by one supply the medicines prepared in either the manually distributing portion or the cassette dispensing portion toward the pre-packaging photographing portion. This makes it possible to contribute improvement of a reading accuracy for the identification information of the medicine in the pre-packaging photographing portion and improvement of an inspection process accuracy in the inspection processing part.

In the above-described medicine packaging apparatus of the present invention, it is preferable that the delivering portion includes a suctioning device which can suction the medicines and the medicine packaging apparatus individually holds the medicines by allowing the suctioning device to apply suctioning force to the medicines and releases the medicines by allowing the suctioning device to release the suctioning force.

According to such a configuration, it is possible to reliably hold the medicines supplied to the individually supplying portion and individually and one by one supply the medicines to the side of the pre-packaging photographing portion.

Here, in the above-described medicine packaging apparatus, it is preferable that the suctioning device has a contacting portion which contacts with the medicine which is a holding target, wherein the contacting portion is formed from a material which can elastically deform and the contacting portion has an inlet port for sucking air and to be connected to the suctioning device, a bowl-shaped pad portion formed so that its cross-sectional shape is formed in a tapered shape around the inlet port and a protruding portion protruding toward an inside of the pad portion along an outer edge of the inlet port.

In the suctioning device used in the present invention, the contacting portion has the bowl-shaped pad portion and is configured to elastically deform. Thus, for a medicine having a size equal to or larger than an outer diameter of the pad portion, the pad portion is elastically deformed when the contacting portion is contacted against the medicine and thus the medicine can be reliably suctioned. Further, in addition to the bowl-shaped pad portion, the protruding portion protruding toward the inside of the pad portion along the outer edge of the inlet port is provided at the contacting portion. Thus, for a medicine having a size smaller than the outer diameter of the pad portion and which is difficult to be suctioned by the pad portion, it is possible to reliably suction the medicine with the protruding portion. Thus, according to the present invention, it is possible to reliably suction the medicine with the suctioning device regardless of the size of the medicine or the like.

In the above-described medicine packaging apparatus of the present invention, it is preferable that the delivering portion includes a discharging device for discharging air onto the medicine which has been suctioned by the suctioning device in a direction opposite to a working direction of the suctioning force and the medicine dispensing apparatus allows the discharging device to discharge the air when the medicine is released toward the side of the pre-packaging photographing portion.

According to such a configuration, it is possible to reliably release the medicine which has been held by the delivering portion from the delivering portion toward the side of the pre-packaging photographing portion by discharging the air with the discharging device. This makes it possible to even more improve a reliability of an action (delivery action) for delivering the medicines supplied from the side of the medicine preparing and dispensing portion toward the side of the pre-packaging photographing portion.

In the above-described medicine packaging apparatus of the present invention, it may be possible to take a configuration in which the delivering portion has a contacting portion which contacts with the medicine at the time of the delivery action and the medicine packaging apparatus can perform a pre-suctioning action for applying the suctioning force in a state that the contacting portion is contacted with a predetermined pre-suctioning position deviated from a location where the medicine is arranged before the delivery action is performed.

According to such a configuration, it is possible to confirm whether or not the delivering portion is ready for providing sufficient suctioning force or the like by performing the pre-suctioning action.

In the above-described medicine packaging apparatus of the present invention, a detachable member which is detachable and should be attached at the time of the delivery action is provided at the individually supplying portion and a position expected to contact with the detachable member is set as the pre-suctioning position.

According to such a configuration, it is possible to utilize the pre-suctioning action for confirming whether or not the detachable member is attached prior to the delivery action.

In the above-described medicine packaging apparatus of the present invention, it is preferable that the individually supplying portion has a discharging portion for discharging the medicines released by the delivering portion to the side of the pre-packaging photographing portion and a frame body for surrounding the receiving portion and the discharging portion and the delivering portion moves the medicines from the side of the receiving portion to the side of the discharging in an area lower than an upper end of the frame body.

According to such a configuration, it is possible to move the medicine moved by the action of the delivering portion at a position lower than the frame body. This makes it possible to keep the medicine inside the frame body even if the medicine drops from the delivering portion during the delivery action.

In the above-described medicine packaging apparatus of the present invention, it may be possible to take a configuration in which the individually supplying portion has a discharging portion for discharging the medicine released by the delivering portion to the side of the pre-packaging photographing portion and a frame body for surrounding the receiving portion and the discharging portion and the frame body is the detachable member.

According to such a configuration, it is possible to confirm whether or not the frame body is attached by performing the pre-suctioning action prior to the delivery action. This makes it possible to perform the delivery action in a state that the frame body is reliably attached.

The above-described medicine packaging apparatus of the present invention can be configured so that a bottom portion of the receiving portion is formed from a translucent material having translucency, the individually supplying portion includes a receiving photographing portion which is arranged on the upper side of the receiving portion and can photograph the bottom portion and an illuminating portion which can illuminate the bottom portion from the lower side and the control part includes an arrangement deriving part for deriving an arrangement of the medicines in the receiving portion based on an image photographed by the receiving photographing portion in a state that the bottom portion is illuminated by the illuminating portion and a delivery action control part for driving the delivering portion based on the arrangement of the medicines derived by the arrangement deriving portion.

According to such a configuration, it is possible to precisely identify the arrangement of the medicines supplied into the receiving portion and accurately perform the delivery action by the delivering portion.

The above-described medicine packaging apparatus of the present invention may be configured to further comprise a collectively discharging mechanism for collectively discharging the medicines in the receiving portion.

According to such a configuration, it is possible to rapidly discharge the medicines in the receiving portion in a case where it is necessary to recovery the medicines introduced into the receiving portion or the like.

In the above-described medicine packaging apparatus of the present invention, it is preferable that the plurality of receiving portions are arranged on a rotating body in a circumferential direction of the rotating body which can be rotated around a predetermined axial center position and the delivering portion can perform the delivery action for the medicines in the receiving portion arranged in a predetermined working area.

According to such a configuration, it is possible to prepare the medicines supplied from the side of the medicine preparing and dispensing portion into the plurality of provided receiving portions in sequence and move the rotating body into the working area of each of the receiving portions to perform the delivery action, thereby supplying the medicines to the side of the pre-packaging photographing portion one after another. This makes it possible to efficiently perform the action for individually and one by one supplying the medicines to the side of the pre-packaging photographing portion in the individually supplying portion.

Here, in order to precisely perform an operation for individually and one by one holding the plurality of medicines prepared in the receiving portion by the delivering portion, it is preferable that the medicines are dispersed in the receiving portion.

The medicine packaging apparatus of the present invention provided based on such knowledge is configured so that the medicines supplied from the side of the medicine preparing and dispensing portion are supplied to a position which is in the receiving portion and on the side of the axial center position of the rotating body.

According to such a configuration, the medicines supplied to positions eccentrically located at positions on the side of the axial center position of the rotating body in the receiving portion are individually dispersed in the receiving portion along with rotation of the rotating body and thus the medicines become in a separated state. Thus, at the time when the receiving portion reaches the working area of the delivering portion due to the rotation of the rotating body, the medicines become in a sufficiently separated state in the receiving portion and thus it becomes easier to one by one hold the medicines with the delivering portion.

Here, it is easier to hold a medicine existing at a position away from a wall surface constituting the receiving portion compared with a medicine existing in the vicinity of the wall surface constituting the receiving portion at the time of performing the action for holding the medicine with the delivering portion.

The medicine packaging apparatus of the present invention provided based on such knowledge is characterized that the control part has a rotating body control part for controlling the rotation of the rotating body and when the rotating body control part rotates the rotating body to move the receiving portion to a predetermined position in the working area, the rotating body control part rotates the rotating body so that the receiving portion rotates to a position over the predetermined position and then rotates the rotating body so that the receiving portion returns to the predetermined position.

According to such a configuration, the medicines are likely to be in a state that the medicines are separated from the wall surface constituting the receiving portion at the time when the receiving portion reaches the working area of the delivering portion along with the rotation of the rotating body. This makes it much easier to perform the action for one by one holding the medicines with the delivering portion.

Here, when the rotating body is rotated so that the receiving portion reaches the working area of the delivering portion, the medicines roll in the receiving portion. Thus, in order to allow the delivering portion to precisely hold the medicines in the receiving portion reaching the working area, it is preferable to take a configuration in which the rolling of the medicines stops and the medicines become in a stable state as soon as possible.

The medicine packaging apparatus of the present invention provided based on such knowledge is configured so that the receiving portion has a receiving portion side wall provided to stand, a receiving area for receiving the medicines is provided inside the receiving portion side wall and a shape of the receiving area is non-circular.

According to such a configuration, it is possible to suppress time until the medicines are stable in the receiving portion after the rotating body is rotated to a minimum.

In the above-described medicine packaging apparatus of the present invention, it is preferable that the pre-packaging photographing portion has a medicine rolling and moving device for rolling and moving the medicines.

In the present invention, it is possible to read the identification information for identifying the medicines from the image photographed by the medicine photographing device in the phase before the medicines are packaged. Namely, in the present invention, it is possible to read the identification information based on the image photographed without intervening the packaging paper or the like. Further, in the present invention, it is possible to roll and move the medicines in the medicine rolling and moving device and use the image photographed by the medicine photographing device to read the identification information. Thus, it is possible to read the identification information without being affected by postures of the medicines supplied to the pre-packaging photographing portion. Therefore, according to the present invention, it is possible to improve the inspection process accuracy for the medicines in the medicine packaging apparatus.

In the above-described medicine packaging apparatus of the present invention, it is preferable that the medicine rolling and moving device includes a first rotating roller and a second rotating roller arranged side by side and the medicine rolling and moving device rotates the first rotating roller and the second rotating roller in the same direction at the time of reading the identification information.

According to such a configuration, it is possible to roll and move the medicine regardless of the size, the shape or the like of the medicine to photograph the image in a state that the identification information can be recognized with the medicine photographing device. Thus, according to the medicine packaging apparatus of the present invention, it is possible to perform inspection based on the identification information without depending on the size, the shape or the like of the medicine.

Here, in order to smoothly start the operation such as the reading process for the identification information or the like which is subsequently performed in a case of supplying the medicines into the above-described medicine rolling and moving device, it is preferable to stop the rolling of the medicines supplied into the medicine rolling and moving device and make the medicines in the stable state as soon as possible.

In the medicine packaging apparatus of the present invention provided based on such knowledge, it is preferable that an introducing portion internally having an introduced area for introducing the medicines is provided at the medicine rolling and moving device and a cross-sectional shape of the introduced area is non-circular.

According to such a configuration, it is possible to suppress time until the medicines supplied into the introduced area of the medicine rolling and moving device are stable to a minimum. This makes it possible to smoothly start the operation such as the reading process for the identification information or the like.

In the above-described medicine packaging apparatus of the present invention, it is preferable that an introducing portion internally having an introduced area for introducing the medicines is provided at the medicine rolling and moving device, the introducing portion is constituted of a plurality of constitution bodies, the constitution bodies are connected to each other in the vertical direction so that end surfaces of the constitution bodies are contacted with each other and the end surface of each constitution body has dark color.

In a case of constituting the introducing portion by connecting the plurality of constitution bodies in the vertical direction as described above, there is a concern that if light is reflected by the end surfaces of the constitution bodies, the photographing for the medicines in the medicine photographing device is adversely affected. Specifically, due to the effect of the reflected light generated on the end surfaces of the constitution bodies, there is a concern that the constitution bodies appear in the image photographed by the medicine photographing device as white artifacts and thus it becomes difficult to distinguish the medicines from the constitution bodies. In order to solve such a concern, in the present invention, the end surfaces of the constitution bodies have the dark color. This makes it possible to prevent the constitution bodies from appearing in the image obtained by photographing with the medicine photographing device as the white artifacts and thus it becomes possible to precisely distinguish the medicines from the constitution bodies. As a result, it is possible to further improve the inspection accuracy in the medicine packaging apparatus.

In the above-described medicine packaging apparatus of the present invention, it is preferable that the medicine rolling and moving device includes a first rotating roller and a second rotating roller arranged side by side, the medicine rolling and moving device is configured to rotate the medicines arranged on the first rotating roller and the second rotating roller and each of the first rotating roller and the second rotating roller has dark color.

By taking such a configuration, it is possible to clearly distinguish the medicines from the first rotating roller and the second rotating roller in the image obtained by photographing with the medicine photographing device. Thus, according to the present invention, it is possible to even more improve the inspection accuracy by the medicine packaging apparatus.

Here, in the medicine packaging apparatus of the present invention, if the identification information on the plurality of medicines can be obtained at one time, it is possible to make the operation required for the inspection even more efficient. In a case of providing the medicine rolling and moving device as described above, it is expected that the identification information on the plurality of medicines can be obtained from the image obtained by the medicine photographing device if under a condition that the plurality of medicines can be rotated without overlapping each other.

The medicine packaging apparatus of the present invention provided based on such knowledge is configured so that the medicine rolling and moving device includes a first rotating roller and a second rotating roller arranged side by side, the medicine rolling and moving device is configured to rotate the medicines arranged on the first rotating roller and the second rotating roller, the medicine packaging apparatus can perform an integrated process for photographing the plurality of medicines by using the pre-packaging photographing portion with rotating the plurality of medicines by using the medicine rolling and moving device, and when a length of a portion which is the longest in the medicine is defined as a medicine length x and a length of a border line between the first rotating roller and the second rotating roller is defined as a border length X, a condition that a sum of the medicine lengths x of the plurality of medicines which are targets of the integrated process is equal to or less than the border length X is set as an execution condition for the integrated process.

According to such a configuration, the plurality of medicines can rotate in the medicine rolling and moving device without overlapping with each other. Thus, according to the present invention, it becomes possible to obtain the identification information on the plurality of medicines from the image obtained by the medicine photographing device and thus it is possible to make the operation required for the inspection even more efficient.

Here, in a case of taking the configuration for rolling and moving the medicines in order to obtain the identification information as described above, there is a possibility that each portion is charged with static electricity due to an influence of friction caused by the rotation. If each portion of the pre-packaging photographing portion is in a charged state, there is also possibility that the medicines adhere to each portion and thus an influence that the medicines cannot smoothly supplied to a subsequent process or the like may occur.

The medicine packaging apparatus of the present invention provided based on such knowledge is configured so that some or all of members constituting the medicine rolling and moving device have a charging suppressing effect.

According to such a configuration, it is possible to reduce the possibility that the pre-packaging photographing portion is charged with the static electricity and suppress the adverse effect such as adherence of the medicines to the pre-packaging photographing portion.

In the above-described medicine packaging apparatus of the present invention, it is preferable that the medicine rolling and moving device includes a first rotating roller and a second rotating roller arranged side by side, the medicine rolling and moving device is configured to rotate the medicines arranged on the first rotating roller and the second rotating roller, the medicine rolling and moving device is configured to dispense the medicines by expanding a clearance between the first rotating roller and the second rotating roller, the medicine rolling and moving device has a movable portion for movably supporting a support axis of one of the first rotating roller and the second rotating roller, and the medicine rolling and moving device is configured to move the support axis in a direction for expanding the clearance between the first rotating roller and the second rotating roller by applying external force in a direction for lifting the movable portion and return to a state that the medicines can be arranged on the first rotating roller and the second rotating roller by releasing the external force to allow the movable portion to be lowered due to its own weight.

In the medicine packaging apparatus of the present invention, the movable portion is lowered due to its own weight and returns to the state that the medicines can be arranged by releasing the external force after the external force is applied in the direction for lifting the movable portion to dispense the medicines from the medicine rolling and moving device. Thus, in the medicine packaging apparatus of the present invention, a mechanism for returning the movable portion back to an original posture after the medicines have been dispensed is not needed and thus it is possible to simplify an apparatus configuration correspondingly.

It is preferable that the medicine packaging apparatus of the present invention is configured to fix the movable portion with fixing force due to magnetic force in a state that the movable portion is lowered.

According to such a configuration, it is possible to provide the medicine packaging apparatus which can keep the medicines so as to prevent the medicines from leaking when only external force weaker than the fixing force caused by the magnetic force is applied to the movable portion.

Here, in a case where the medicine packaging apparatus of the present invention is configured to rotate the medicines at the position where the medicine photographing device is provided as described above, there is a possibility that powder of the medicines or the like is generated due to an influence of friction force at the position where the medicine photographing apparatus is provided.

The medicine packaging apparatus of the present invention provided based on such knowledge is configured so that a tray is provided on the lower side of the medicine photographing device.

According to such a configuration, it is possible to receive powder materials generated in the medicine photographing device with the tray. This makes it possible to suppress time and effort for cleaning the vicinity of the medicine photographing device to a minimum.

Here, in the above-described medicine packaging apparatus of the present invention, the reading control part may perform any reading method as long as it can read the identification information attached to the medicines.

Based on such knowledge, in the medicine packaging apparatus of the present invention, the reading control part may be configured to perform one or both of a process for recognizing the identification information attached to the medicine as textual information and obtaining the identification information based on an identification information text master in which information on the medicine is defined by the textual information and a process for recognizing the identification information attached to the medicine as image information and obtaining the identification information based on an identification information image master in which information on the medicine is defined by the image information.

As described above, the medicine packaging apparatus of the present invention may be configured to perform a process for optically reading the identification information attached to the medicine like a so-called OCR process or the like, collating characters with predetermined patterns to identify the characters, recognizing the characters as textual information and collating the textual information recognized by the OCR process or the like with a medicine text master to obtain the identification information. Further, the medicine packaging apparatus of the present invention may be configured to perform a process for preparing an identification information image master in which the information on the medicine is defined by the image information in advance, recognizing the identification information attached to the medicine as the image information and collating the recognized image information with the identification information image master to obtain the identification information. Even in the case using any one of these methods, it is possible to accurately perform the inspection for the medicine.

Here, in the above-described medicine packaging apparatus of the present invention, there is a concern that the medicines are adversely affected when a temperature in the packaging paper becomes high due to an influence of heat generated by a thermal source such as a sealing portion provided at a position close to the packaging paper for forming a packaging bag after the medicines to be packaged are supplied into the packaging paper in the packaging portion or the like.

In the medicine packaging apparatus of the present invention provided for solving such a concern, the packaging portion includes a heating portion for heating a packaging paper supplied for packaging the medicines, a medicine introducing portion for introducing the medicines into the packaging paper on an upper stream side of a carrying direction of the packaging paper than the heating portion and a blowing portion which can blow air into the packaging paper on the upper stream side of the carrying direction of the packaging paper than the heating portion.

In the medicine packaging apparatus of the present invention, the blowing portion is provided and it is possible to blow the air into the packaging paper on the upper stream side than the heating portion. Thus, according to the present invention, it is possible to suppress the medicines supplied into the packaging paper for preparing the packaging from being adversely affected by the thermal.

Here, as a result of earnest investigation of the present inventors, it has been found that temperature rising in the packaging paper on the upper stream side than the heating portion is likely to occur in a state of standing-by that the medicines are introduced from the medicine introducing portion into the packaging paper compared with a state that the packaging for the medicines is continuously performed.

The medicine packaging apparatus of the present invention provided based on such knowledge is configured so that the blowing due to the blowing portion is performed under a condition that the medicine packaging apparatus are standing-by that the medicines are supplied from the medicine introducing portion into the packaging paper.

According to such a configuration, it is possible to suppress the temperature rising in a situation that the temperature rising in the packaging paper on the upper stream side than the heating portion is expected to a minimum. This makes it possible to suppress problems that the medicines previously supplied into the packaging paper among the medicines to be packaged together as one dose of the medicines are adversely affected by the thermal until the remaining medicines are supplied into the packaging paper.

Here, as a result of earnest investigation of the present inventors, it has been found that inflow and outflow of air in the packaging paper is facilitated and the thermal generated in the heating portion is cooled by forcibly feeding the packaging paper to the side of the heating portion and thereby it is expected that an effect for suppressing excessive temperature rising can be obtained.

The medicine packaging apparatus of the present invention provided based on the above-described knowledge is characterized by feeding the packaging paper to the side of the heating portion by a predetermined amount under a condition that a temperature in the packaging paper exceeds a predetermined temperature condition on the upper stream side of the carrying direction of the packaging paper than the heating portion.

According to such a configuration, it is possible to obtain an effect of suppressing the temperature rising by feeding the packaging paper to the side of the heating portion and thus suppress the medicines from being adversely affected by the thermal.

In the above-described medicine packaging apparatus of the present invention, it is preferable that the packaging portion has a sealing portion for forming a packaging bag from a packaging paper supplied for packaging the medicines, a medicine introducing portion for introducing the medicines into the packaging paper on an upper stream side of a carrying direction of the packaging paper than the sealing portion and an introduction detecting portion for detecting introduction of the medicines from the medicine introducing portion into the packaging paper on the upper stream side of the carrying direction of the packaging paper than the sealing portion and a detection range of the introduction detecting portion is set in the packaging paper.

In the medicine packaging apparatus of the present invention, the detection range of the introduction detecting portion for detecting the introduction of the medicines into the packaging paper is set in the packaging paper. Thus, it is possible to exactly detect whether or not the medicines are introduced into the packaging paper through the medicine introducing portion.

It is preferable that the above-described medicine packaging apparatus of the present invention has a width expanding portion for expanding a width of the packaging paper on the upper stream side of the carrying direction of the packaging paper than the sealing portion, the introduction detecting portion has a light emitting portion which can emit detection light and a light receiving portion which can receive the detection light, the introduction detecting portion is configured to detect passing of the medicines under a condition that light-receiving of the detection light at the light receiving portion is stopped or a received amount of the detection light at the light receiving portion decreases during emitting of the detection light by the light emitting portion, the light receiving portion is arranged on the side of the width expanding portion and the light emitting portion is arranged at a position facing the light receiving portion.

According to such a configuration, it is possible to even more accurately detect whether or not the medicines are introduced into the packaging paper through the medicine introducing portion.

In the above-described medicine packaging apparatus of the present invention, it is preferable that the light emitting portion is provided on a blowing portion which can blow air into the packaging paper on the upper stream side of the carrying direction of the packaging paper than the sealing portion.

According to such a configuration, it is possible to prevent the light emitting portion from getting dirty due to powder caused from the medicines or the like with suppressing the temperature rising in the packaging paper with the blowing portion.

In the above-described medicine packaging apparatus of the present invention, it is preferable that the packaging portion has a sealing portion for forming a packaging bag from a packaging paper supplied for packaging the medicines, a pre-packaging information writing portion for writing information on the packaging paper before the medicines have been packaged on an upper stream side of a carrying direction of the packaging paper than the sealing portion and a post-packaging information writing portion for writing information onto the packaging paper in which the medicines have been packaged on a downstream side of the carrying direction of the packaging paper than the sealing portion.

In the medicine packaging apparatus of the present invention, it is possible to not only write the information onto the packaging paper with the pre-packaging information writing portion before the medicines are packaged but also write the information onto the packaging paper with the post-packaging information writing portion after the medicines have been packaged.

In the above-described medicine packaging apparatus of the present invention, it is preferable that the post-packaging information writing portion has a rear side contacting portion provided on one side of a carrying path for the packaging paper as a border and a writing mechanism portion provided on another side of the carrying path as the border which is opposite to the contacting portion, the writing mechanism portion has a holder for holding a writing member for writing information onto the packaging paper and a front side contacting portion provided integrally with the holder, the front side contacting portion contacts with the packaging paper more preferentially than the writing member by making the holder and the carrying path close to each other to take a packaging paper fixed state that the packaging paper is put between the front side contacting portion and the rear side contacting portion, and the writing member is contacted with the packaging paper by making the holder and the carrying path closer to each other than the packaging paper fixed state to write the information onto the packaging paper.

In the medicine packaging apparatus of the present invention, it is possible to stabilize the packaging paper in the vicinity of the post-packaging information writing portion by taking the packaging paper fixed state that the packaging paper is put between the front side contacting portion and the rear side contacting portion. Thus, it is possible to appropriately write the information on a location of the packaging paper onto which the information should be written by oscillating the holder in a direction for making the holder close to the carrying path in the packaging paper fixed state.

In the above-described medicine packaging apparatus of the present invention, it is preferable that the post-packaging information writing portion has a rear side contacting portion arranged on one side of a carrying path for the packaging paper as a border and a writing mechanism portion arranged on another side of the carrying path as the border which is opposite to the contacting portion, the writing mechanism portion has a holder holding a wring member for writing the information onto the packaging paper, an oscillating portion which can oscillate in a direction for separating the holder away from the carrying path and a front side contacting portion which is provided integrally with the holder and has elasticity, the front side contacting portion contacts with the packaging paper more preferentially than the writing member by approaching the holder toward the carrying path with the oscillating portion to take a packaging paper fixed state that the packaging paper is put between the front side contacting portion and the rear side contacting portion, and the writing member is contacted with the packaging paper by oscillating the holder in a direction for more approaching the holder toward the carrying path than the packaging paper fixed state to write the information onto the packaging paper.

In the above-described medicine packaging apparatus of the present invention, it is preferable that the post-packaging information writing portion is provided at a position adjacent to the downstream side of the carrying direction of the packaging paper than the sealing portion.

According to such a configuration, it is possible to appropriately write the information even if the packaging bag formed by packaging the medicines with the packaging paper has any length.

Further, it is preferable that the above-described medicine packaging apparatus of the present invention is configured so that the post-packaging information writing portion is provided at a position where the packaging paper is carried with a posture that a plane of the packaging paper stands.

At the position where the packaging paper is carried with the posture that the plane of the packaging paper stand, the medicines are eccentrically located on the lower side in the packaging bag, the medicines do not exist on the upper side and an area to which the information is easily written is formed on the upper side. Thus, by taking the configuration like the present invention, it is possible to easily write the information with the post-packaging information writing portion.

Effect of the Invention

According to the present invention, it is possible to provide a medicine packaging apparatus whose reading accuracy for identification information such as an engraved mark attached to a medicine is high and which can provide superior inspection performance.

BRIEF DESCRIPTION OF THE DRAWINGS

FIG. 16(*a*) shows a state that heights of rotational centers of the first rotating roller and the second rotating roller are set to be substantially equal and FIG. 16(*b*) shows a state that the height of the rotational centers of the first rotating roller and the second rotating roller are set to be different from each other.

FIG. 22(*a*) is a table showing one example of prescription data and FIG. 22(*b*) is a view showing a displaying example related to a result obtained by performing an inspection process based on the prescription data shown in FIG. 22(*a*).

FIG. 33(*a*) shows a case where the packaging paper is carried in the vertical direction, FIG. 33(*b*) shows a case where the packaging paper is carried in the horizontal direction and FIG. 33(*c*) shows a case where the packaging paper is carried in the diagonal direction.

MODE FOR CARRYING OUT THE INVENTION

Hereinafter, detailed description will be given to a medicine packaging apparatus 10 according to one embodiment of the present invention with reference to the accompanying drawings. In this regard, although words and terms indicating specific directions or positions (such as words and terms containing "upper", "lower", "side" and "end") are used in the following description as needed, use of these words and terms is merely intended for facilitating understanding of the present invention with reference to the accompanying drawings and the technical scope of the present invention is not limited by meanings of these words and terms. Further, the following description is essentially just only example and not intended to limit the present invention, an application thereof or an intended use thereof. Further, a medicine contains a capsule, a suppository and the like as well as a tablet and means a medicine which can keep a certain dosage form.

Figure 1:
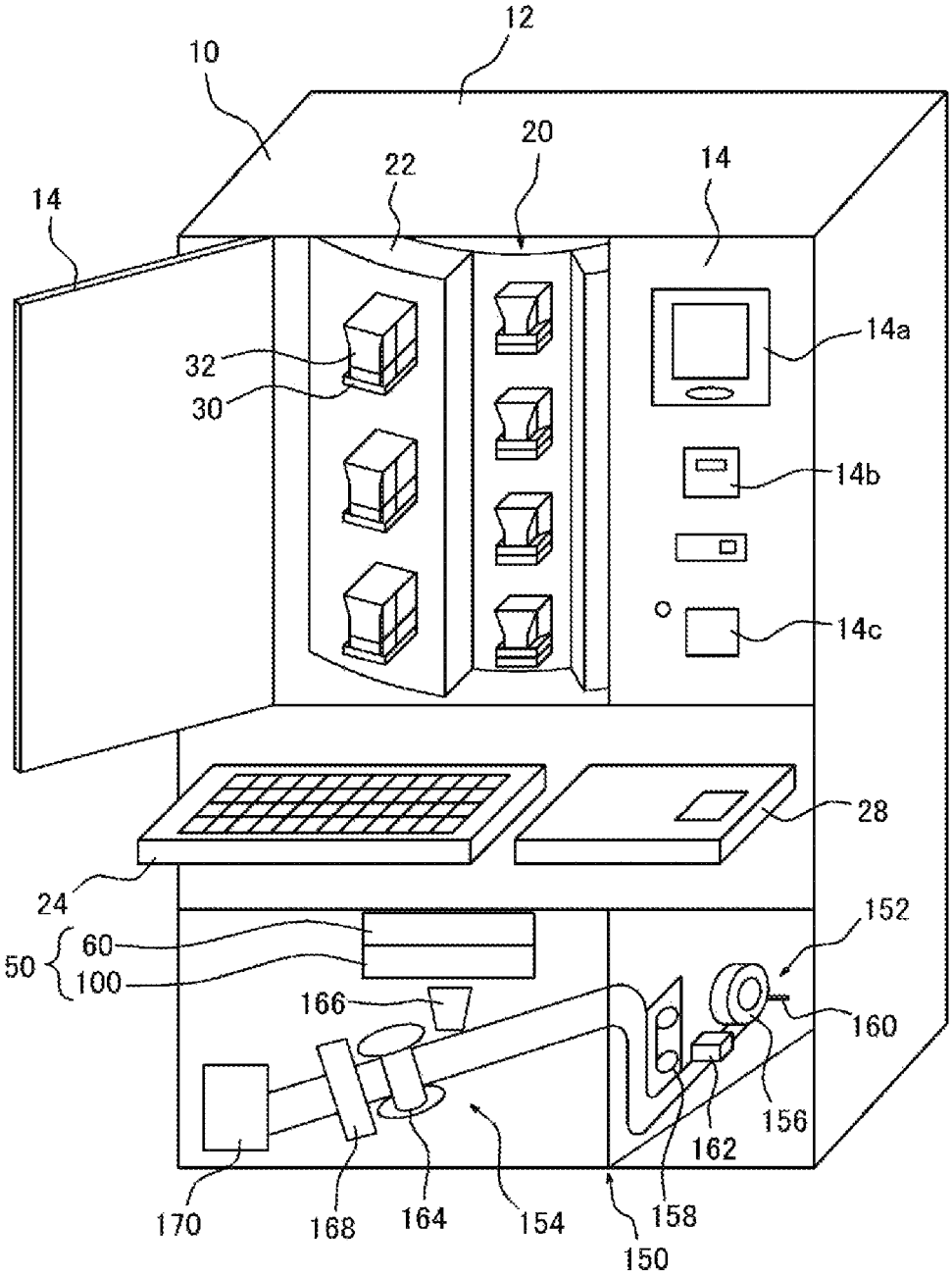
FIG. 1 is an explanation view showing a schematic structure of a medicine packaging apparatus according to one embodiment of the present invention.

As shown in FIG. 1, the medicine packaging apparatus 10 includes a medicine preparing and dispensing portion 20, an inspection unit portion 50, a packaging portion 150 and a control part 200 in an apparatus main body 12. The medicine packaging apparatus is configured to dispense medicines prepared in the medicine preparing and dispensing portion 20 based on prescription data and package the medicines for every one package in the packaging portion 150.

A door 14 is provided on the front side of the apparatus main body 12 and medicine cassettes 32 can be detachably attached to a cassette dispensing portion of the medicine preparing and dispensing portion 20 provided in the apparatus main body 12. A touch panel 14*a*, a barcode reader 14*b* and a journal printer 14*c* are provided on a front surface (such as the door 14) of the apparatus main body 12. Further, in the apparatus main body 12, a supplementary table 28 and a manually distributing portion 24 constituting the medicine preparing and dispensing portion 20 are provided on the lower side of the door 14.

The medicine preparing and dispensing portion 20 is configured to prepare the medicines used for the packaging so that the medicines can be dispensed. The medicine preparing and dispensing portion 20 includes the cassette dispensing portion 22 and the manually distributing portion 24. In the cassette dispensing portion 22, motor bases 30 are provided in a vertical direction and a circumferential direction of a substantially-cylindrical shaped cylinder and the medicine cassettes 32 can be respectively and detachably attached to the motor bases 30. Although details of the motor base 30 are not illustrated in the drawings, the motor base 30 is configured to have a built-in motor and transmit driving force to a rotor of the medicine cassette 32 through a gear. Further, in the cassette dispensing portion 22, medicine paths (not shown in the drawings) are respectively provided for each line of the medicine cassettes 32 arranged in the vertical direction. Due to these medicine paths, the medicines dispensed from the medicine cassettes 32 are smoothly dispensed to the lower side. In this regard, in the medicine paths, a counting sensor (not shown in the drawings) for detecting the number of the dispensed medicines is provided at a portion which is communicated with a discharging port of the medicine cassette 32.

Each medicine cassette 32 has a substantially-rectangular parallelepiped box shape and the medicines of the same kind managed with a lot number are contained in the medicine cassette 32. The rotor not shown in the drawings is provided in the medicine cassette 32 and a plurality of pocket portions are formed on an outer circumferential portion of the medicine cassette 32. The medicines contained in the medicine cassette 32 are one by one held in each pocket portion. The driving force of the motor provided in the motor base 30 is transmitted to the rotor through the gear and thus the rotor rotates. When the rotor rotates, the medicines respectively held in the pocket portions are dispensed to the medicine path in sequence.

Figure 2:
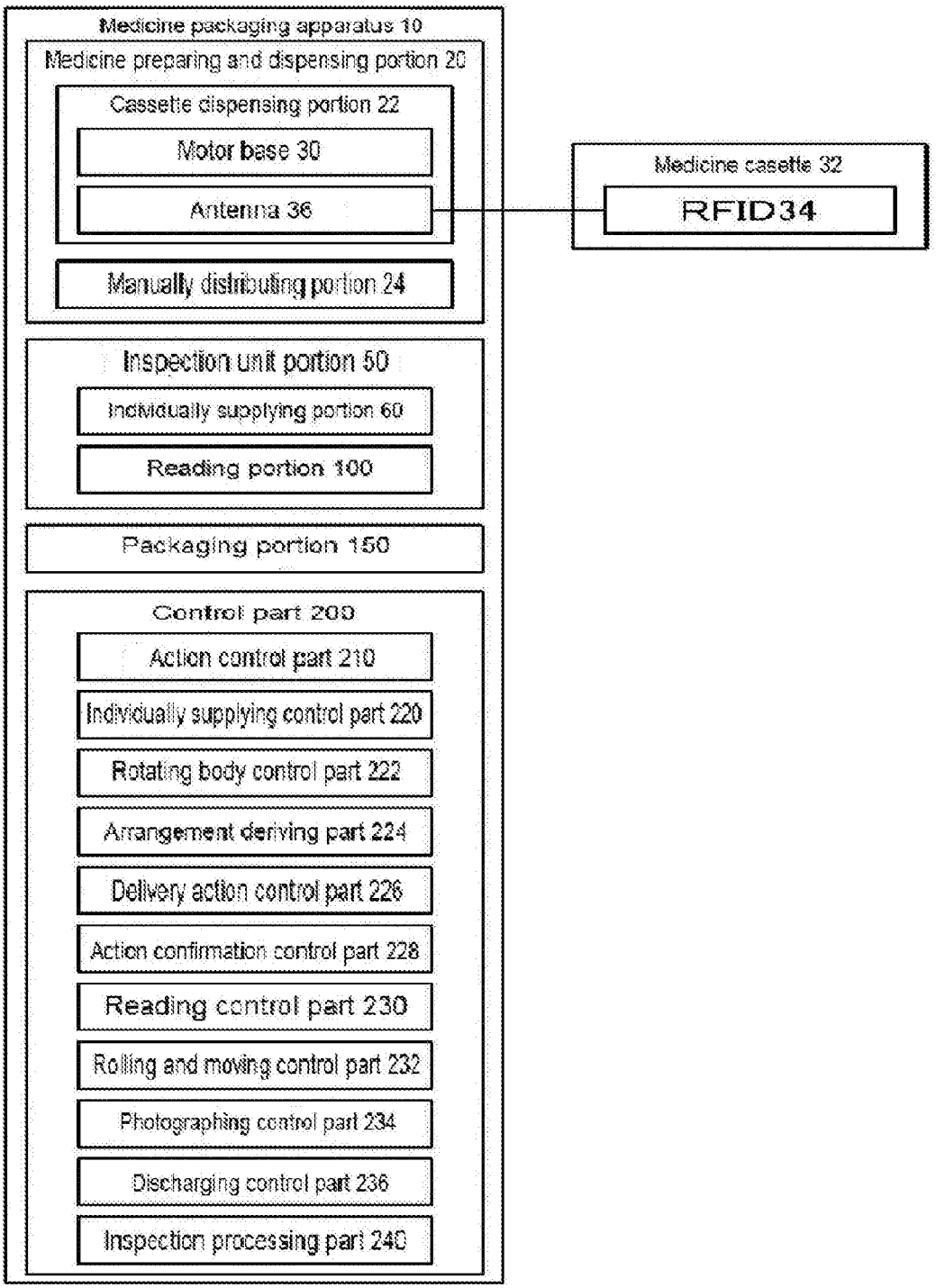
FIG. 2 is a block diagram showing a configuration of the medicine packaging apparatus shown in FIG. 1.

As shown in FIG. 2, an RFID 34 (Radio Frequency IDentification) is provided in each medicine cassette 32 and information on the contained medicines (for example, medicine information such as a name of the medicines and the number of the contained medicines) is stored in the RFID 34. An antenna 36 is provided at each motor base 30 and thus it is possible to communicate with the RFID 34 of each medicine cassette 32. The medicine information and dispensing information for the medicine (for example, information such as the number of the dispensed medicines, the number of the stocked medicines remaining in the medicine cassette 32 and an identification number of a shelf to which the medicine cassette 32 is attached) are read from the RFID 34 through the antenna 36 and stored in a buffer of the control part 200 described later.

As shown in FIG. 1, the manually distributing portion 24 is configured to prepare the medicines for each box formed in a matrix pattern with a manual operation (a manually distributing operation) and dispense the medicines for every one box in sequence to a side of an individually supplying portion 60 of the inspection unit portion 50 described later by opening a bottom surface of each box. The medicines for one package are distributed into each box. Namely, in a case where two or more medicines are prescribed for one package, the plurality of medicines are distributed into a single box. Thus, when the box into which the plurality of medicines are distributed is opened, the two or more medicines are simultaneously dispensed to the side of the individually supplying portion 60. Medicines to be prepared and dispensed by the manual operation (the manually distributing operation) such as a medicine not suitable for the automatic dispensing (for example, a half-tablet medicine) are mainly prepared in the manually distributing portion 24. In this regard, instruction information indicating which medicine should be manually distributed to which position is printed by the journal printer 14*c* based on the prescription data.

Figure 3:
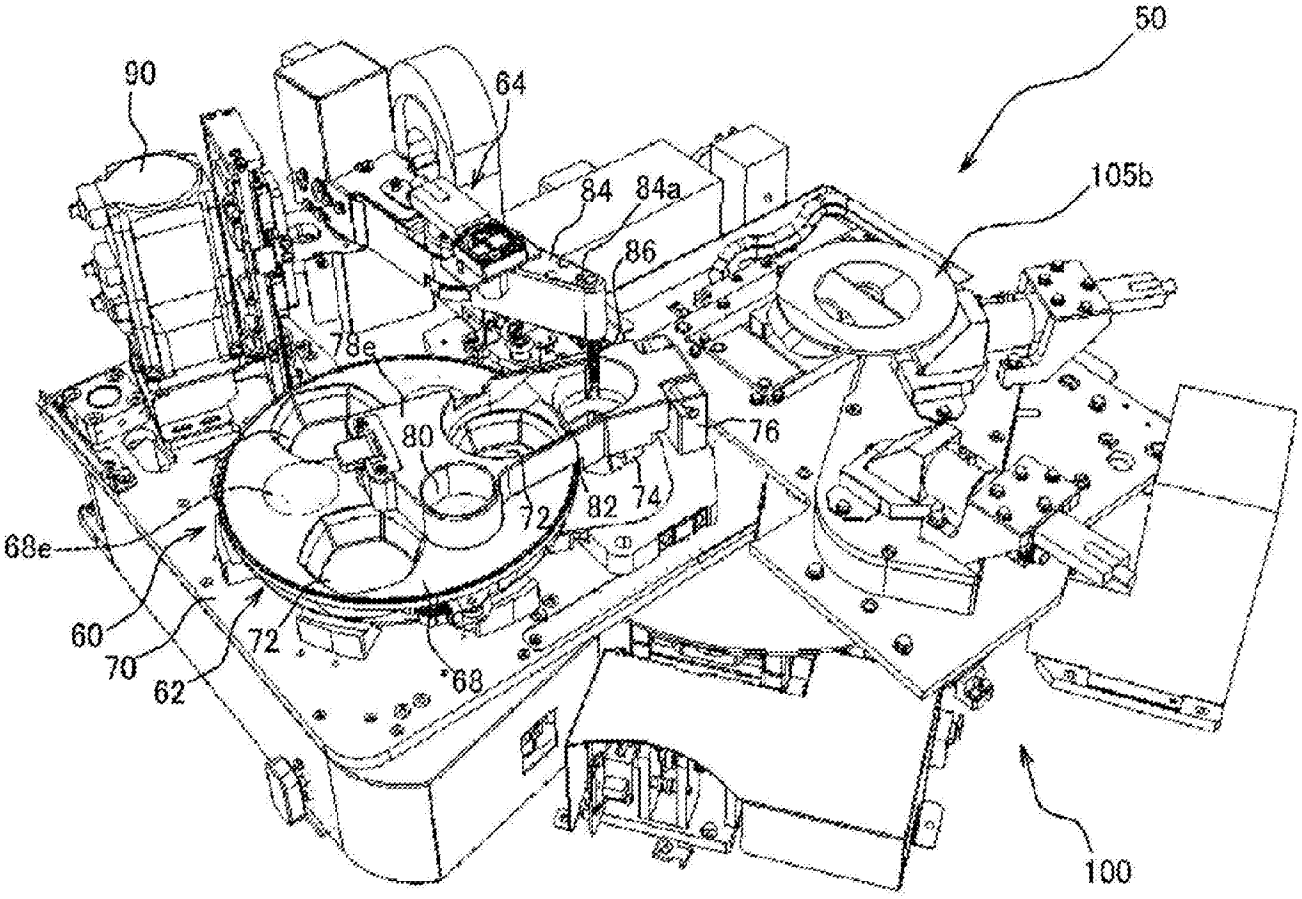
FIG. 3 is a perspective view showing one example of an inspection unit portion.

The inspection unit portion 50 is used for performing a process required for performing an inspection for the medicines dispensed from the medicine preparing and dispensing portion 20. As shown in FIG. 1 and FIG. 3, the inspection unit portion 50 includes the individually supplying portion 60 and a pre-packaging photographing portion 100.

Figure 4:
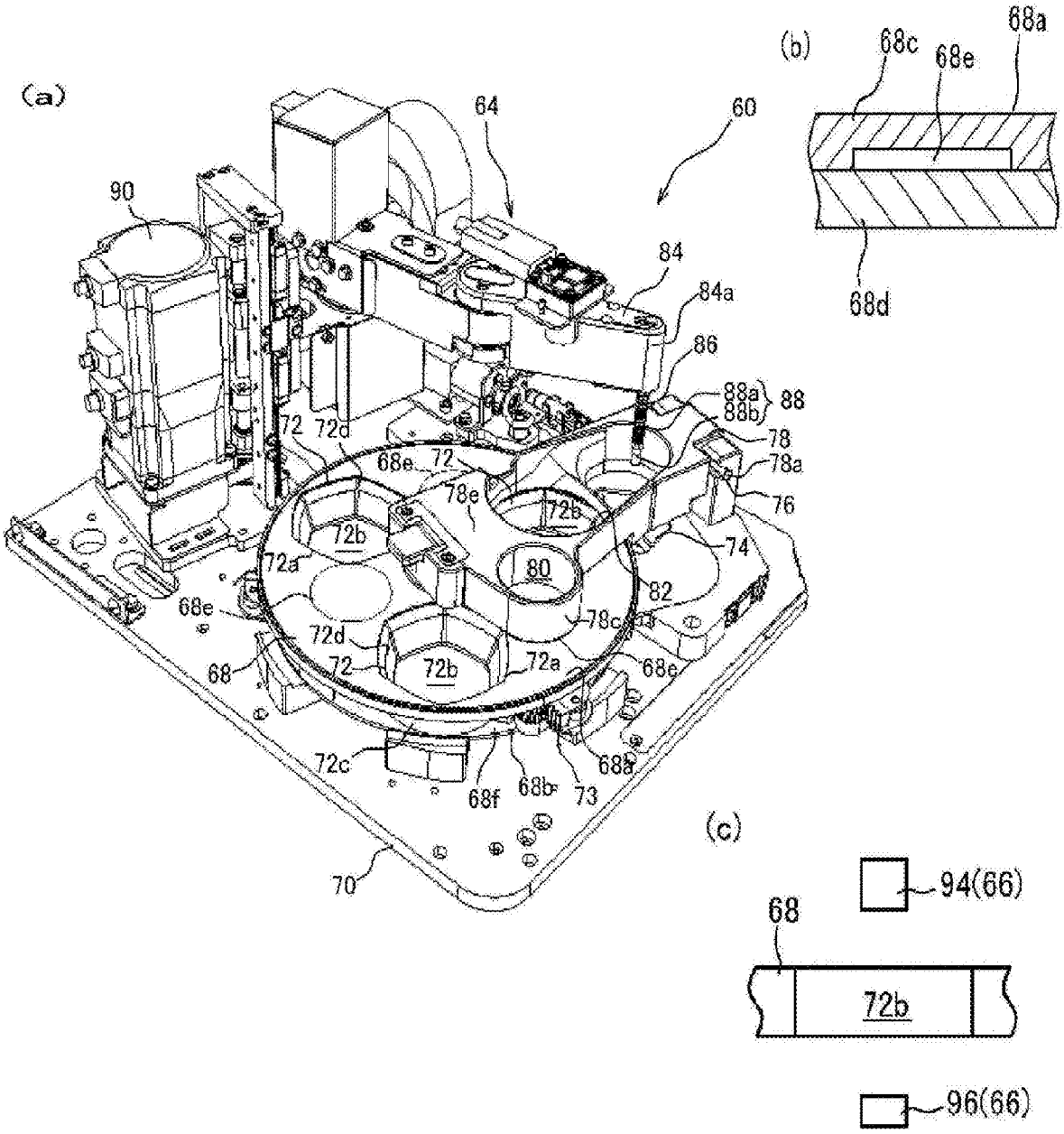
FIG. 4(*a*) is a perspective view showing one example of an individually supplying portion, FIG. 4(*b*) is a cross-sectional view showing a vicinity of a thin-walled portion of a rotating body and FIG. 4(*c*) is a schematic view showing a photographing unit.

The individually supplying portion 60 is used for individually and one by one separating and supplying the medicines received from the side of the medicine preparing and dispensing portion 20 toward the side of the pre-packaging photographing portion 100. In this embodiment, the individually supplying portion 60 is configured to receive the medicines dispensed from the manually distributing portion 24 in the medicine preparing and dispensing portion 20 and individually supply the medicines to the side of the pre-packaging photographing portion 100. As shown in FIG. 3 and FIG. 4, the individually supplying portion 60 includes a receiving unit 62, a delivering device 64 (a delivering portion) and a photographing unit 66.

As shown in FIG. 4(*a*), the receiving unit 62 is constituted around a rotating body 68. The rotating body 68 is a disk-shaped plate member rotatably provided on a base 70. The rotating body 68 is constituted by providing a front plate 68*a* and a rear plate 68*b* each having a discoid shape so as to form a predetermined clearance between the front plate 68*a* and the rear plate 68*b*. As shown in FIG. 4(*b*), the front plate 68*a* is formed of a double-layer structure constituted of a front layer portion 68*c* and a lower layer portion 68*d*. Thin-walled portions 68*e* whose board thickness is thinned by a counterbore work or the like are formed on the rear side of the front layer portion 68*c*. The thin-walled portion 68*e* has an effect of suppressing a bounce of the dropped medicine. Namely, in a case where the medicine is dropped into the thin-walled portion 68*e*, the bounce of the medicine becomes smaller compared with a case where the medicine is dropped into another area than the thin-walled portion 68*e* of the front plate 68*a*. The thin-walled portions 68*e* are respectively provided between openings for receiving ports 72*a* described later. Further, receiving tubes 72*c* respectively constituting receiving portions 72 described later and a space 68*f* for containing members constituting a collectively discharging mechanism 73 or the like are formed between the front plate 68*a* and the rear plate 68*b*. Furthermore, the rear plate 68*b* is formed from a material having translucency. In this embodiment, a transparent plate body is employed as the rear plate 68*b*. In this regard, the rear plate 68*b* may be configured by filling any members on the rear side of the thin-walled portions 68*e* (between the thin-walled portions 68*e* and the lower layer portion 68*d*). This makes it possible to suppress sound caused at the time when the medicine is dropped into the thin-walled portion 68*e*. Although the member filled on the rear side of the thin-walled portions 68*e* may be any member, it is preferable to use a sponge, a cloth or the like as the member.

The plurality of receiving portions 72 (in this embodiment, the number of the receiving portions 72 is three) are provided on the rotating body 68. The receiving portions 72 are configured so that three openings provided in the front plate 68*a* are defined as the receiving ports 72*a* and the receiving portions 72 respectively include receiving areas 72*b* which can receive the medicines from the side of the medicine preparing and dispensing portion 20. The receiving areas 72*b* are areas respectively surrounded by the rear plate 68*b* and the receiving tubes 72*c* provided in the space 68*f* so as to correspond to each receiving port 72*a*. The medicines for one package are contained in the receiving area 72*b* (the receiving tube 72*c*). The receiving tube 72*c* is a tubular member whose inner circumferential surface 72*d* (a receiving portion side wall) is non-circular. In this embodiment, the receiving tube 72*c* is a tubular member in which a curved portion is formed on the inner circumferential surface 72*d*. More specifically, a cross-sectional shape of the receiving area 72*b* is a substantially polygonal shape (in this embodiment, the cross-sectional shape is a hexagonal shape).

Figure 5:
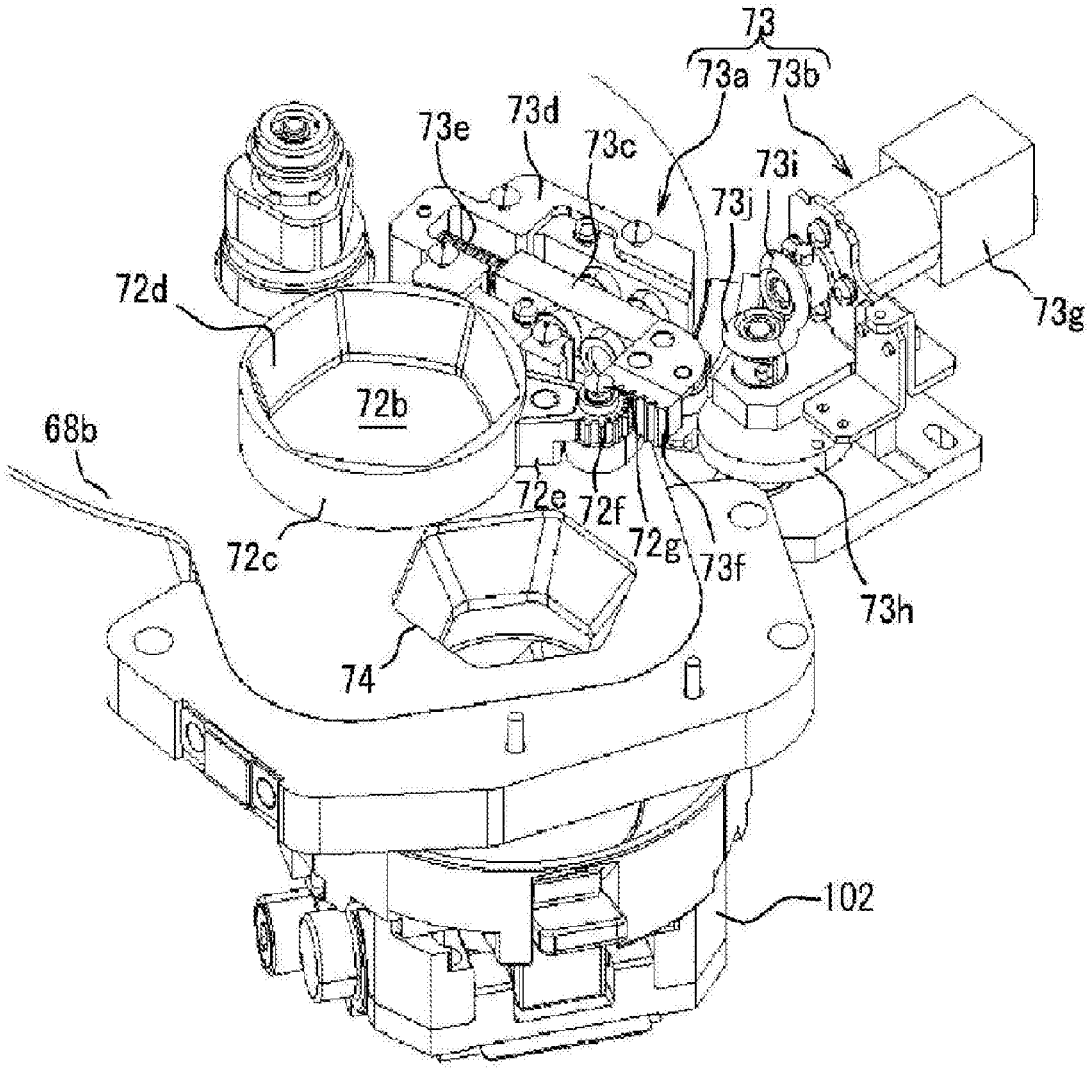
FIG. 5 is a perspective view showing one example of a forcibly discharging mechanism.

Further, the receiving tube 72*c* is configured to be slidably moved between the receiving port 72*a* and a discharging port 74 described later when the collectively discharging mechanism 73 is actuated. The collectively discharging mechanism 73 is used for moving the receiving tube 72*c* from the side of the receiving port 72*a* to the side of the discharging port 74 to collectively discharge the medicines existing in the receiving tube 72*c* toward the discharging port 74. Although the collectively discharging mechanism 73 may be any mechanism as long as it has this described function, the collectively discharging mechanism 73 is configured as follows in this embodiment. Specifically, as shown in FIG. 5, the collectively discharging mechanism 73 is configured to include receiving port side units 73*a* provided so as to correspond to each receiving tube 72*c* and a discharging port side unit 73*b* provided on the side of the discharging port 74.

The receiving port side unit 73*a* is connected to the receiving tube 72*c* and can be combined with the discharging port side unit 73*b* to slidably move the receiving tube 72*c* between the receiving port 72*a* and the discharging port 74. More particularly, the receiving tube 72*c* has an arm 72*e* protruding from an outer circumferential portion toward an outer side of a radial direction of the receiving tube 72*c*. The receiving tube 72*c* has a pinion portion 72*f* provided at a tip end portion of the arm 72*e*. Further, the receiving tube 72*c* is configured to be pivotally moved with respect to the rotating body 68 around a support axis 72*g* provided to stand on a substantially center portion of the pinion portion 72*f*. The receiving port side unit 73*a* includes a slide piece 73*c*, a slide guide 73*d* and a spring 73*e*. The slide piece 73*c* has a rack portion 73*f* at a tip end portion thereof. The slide piece 73*c* is configured to be slidably moved along the slide guide 73*d* fixed to the rear plate 68*b* of the rotating body 68. Further, the rack portion 73*f* is meshed with the pinion portion 72*f*. The spring 73*e* for applying biasing force to the slide piece 73*c* toward a tip end side (the side of the pinion portion 72*f*) thereof is arranged between a base end portion (an end portion opposite to the pinion portion 72*f*) of the slide piece 73*c* and the slide guide 73*d*.

The receiving port side unit 73*a* can pivotally move the pinion portion 72*f* in a positive direction by applying external force against the above-described biasing force to push the slide piece 73*c* along the slide guide 73 in a direction toward the base end side. Further, by pivotally moving the pinion portion 72*f* in the positive direction, it is possible to move (pivotally move) the receiving tube 72*c* around the support axis 72*g*. This makes it possible to move the receiving tube 72*c* existing on the side of the receiving port 72*a* in a normal state to the side of the discharging port 74 to collectively discharge the medicines in the receiving tube 72*c* to the discharging port 74. On the other hand, when the external force in the direction for pushing the slide piece 73*c* toward the base end side is released, the slide piece 73*c* is pushed back by an action of the spring 73*e*. Along with this movement, the receiving tube 72*c* is returned from the side of the discharging port 74 to the side of the receiving port 72*a* and returns to a state that the receiving tube 72*c* can receive the medicines through the receiving port 72*a*.

Whereas the above-described receiving port side units 73*a* are provided for each receiving tube 72*c*, the discharging port side unit 73*b* is only provided at a position adjacent to the discharging port 74. The discharging port side unit 73*b* is used for applying the external force with respect to the slide piece 73*c* of the receiving port side unit 73*a*. The discharging port side unit 73*b* has a motor 73*g* and a cam 73*h* and can pivotally move the cam 73*h* with driving force of the motor 73 transmitted through gears 73*i*, 73*j* connected to rotation axes of the motor 73*g* and the cam 73*h*. The cam 73*h* is arranged at a position at which the cam 73*h* can contact with the slide piece 73*c* of the receiving port side unit 73*a* corresponding to the receiving tube 72*c* reaching a position adjacent to the discharging port 74. The receiving port side unit 73*a* can actuate the motor 73*g* and pivotally move the cam 73*h* to change pressing force acting to the slide piece 73*c*. Thus, the collectively discharging mechanism 73 can move the receiving tube 72*c* between the side of the receiving port 72*a* and the side of the discharging port 74 and collectively discharge the medicines in the receiving tube 72*c* to the discharging port 74 due to an interaction of the receiving port side unit 73*a* and the discharging port side unit 73*b*.

As shown in FIG. 3 and FIG. 4, the discharging port 74 for discharging the medicines to the side of the pre-packaging photographing portion 100 is provided in the base 70. The discharging port 74 is provided at a position adjacent to an outer periphery of the rotating body 68. Further, on the base 70, a frame body supporting portion 76 is provided at a position adjacent to the outer side of the radial direction of the rotating body 68 with respect to the discharging port 74. The frame body supporting portion 76 is used for supporting one end portion of a frame body 78 at the time of erecting the frame body 78 described later.

Figure 6:
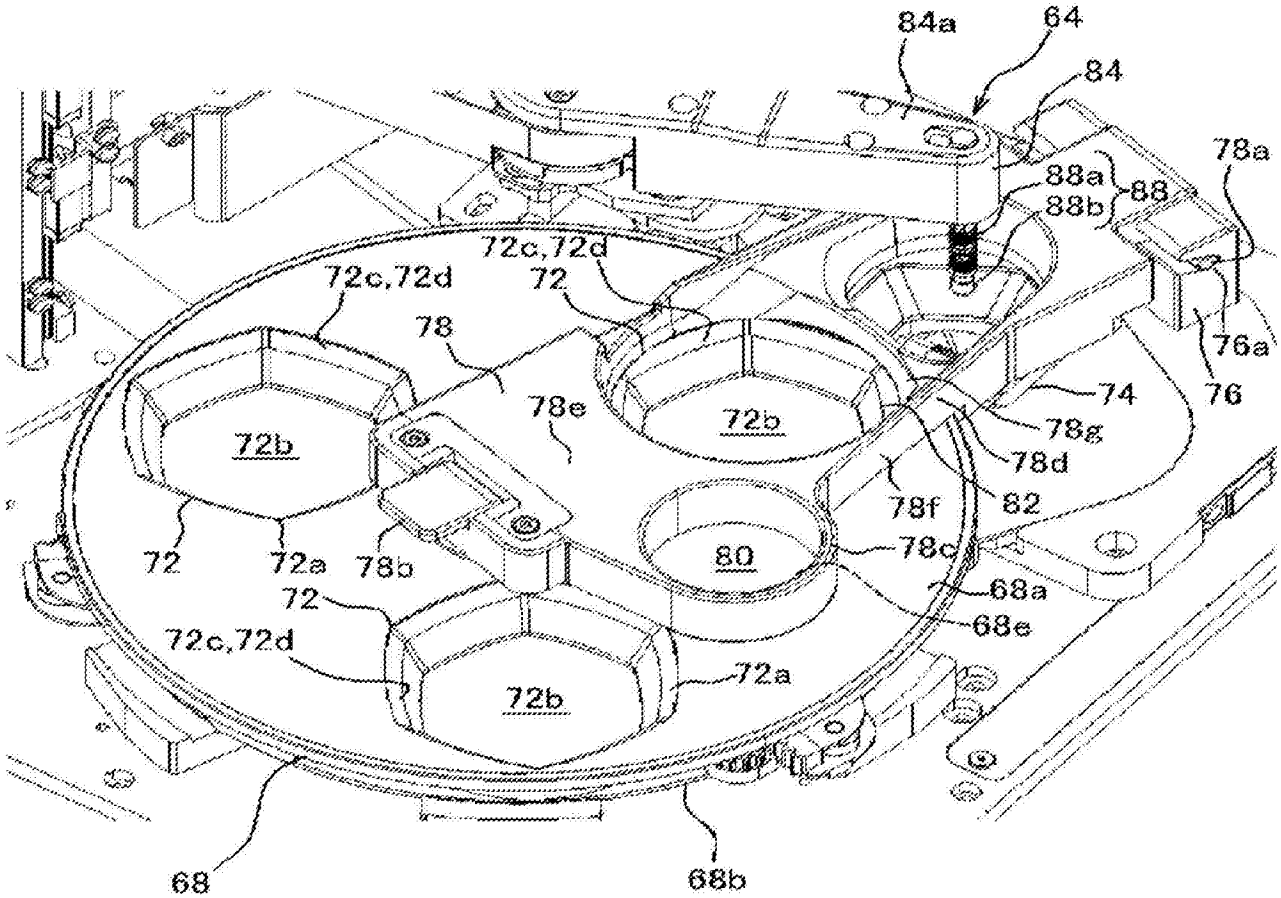
FIG. 6 is an enlarged view of a containing portion of the individually supplying portion shown in FIG. 4.
Figure 7:
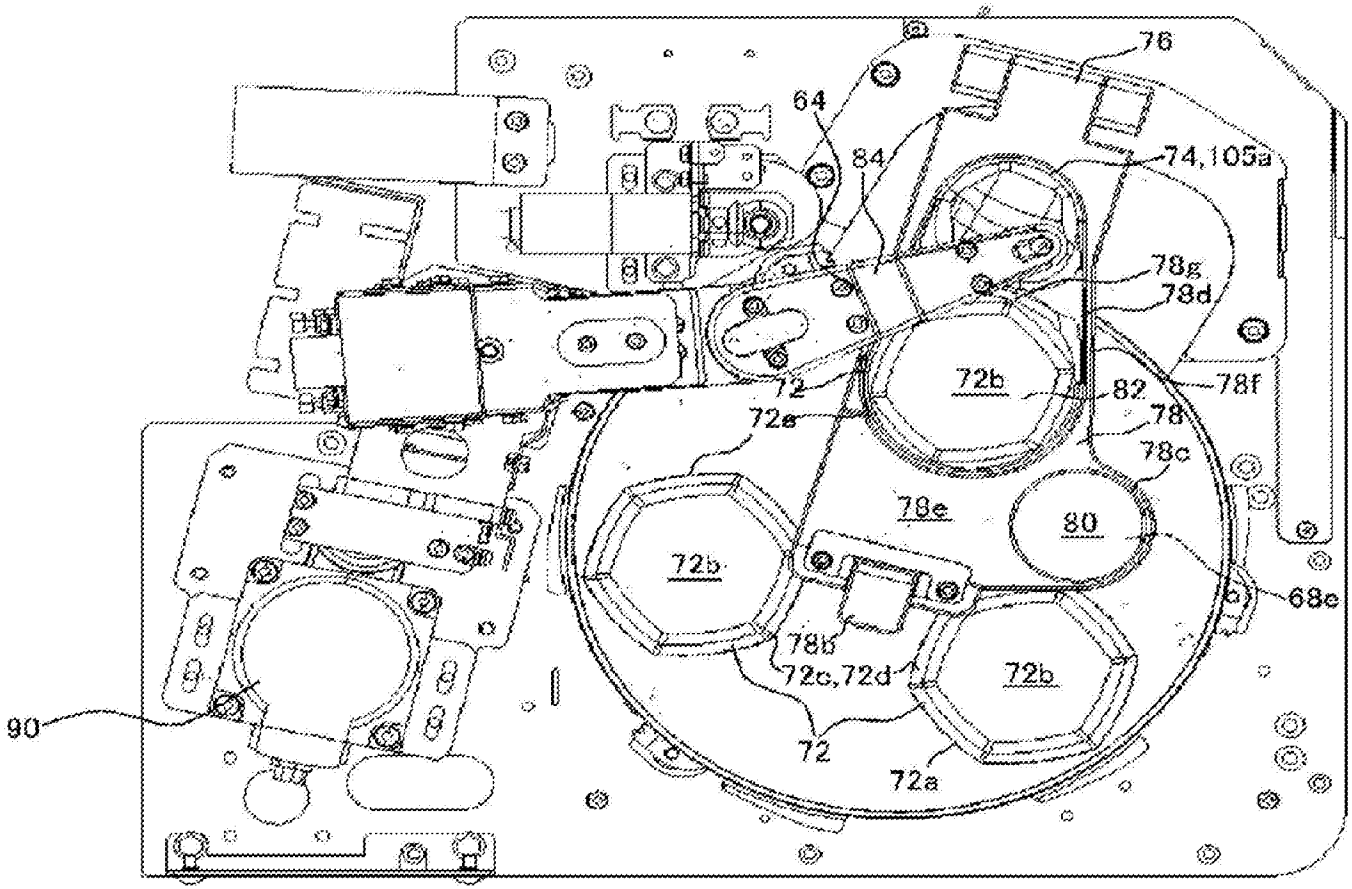
FIG. 7 is a planar view of the individually supplying portion shown in FIG. 4.

As shown in FIG. 6 and FIG. 7, the frame body 78 is a frame-like member to be erected from a position where the discharging port 74 is provided to a substantially center portion of the rotating body 68. The frame body 78 includes a support axis 78*a*, a rock portion 78*b*, a supplied area forming portion 78*c*, a delivering area forming portion 78*d*, a pre-absorbing position forming portion 78*e* and the like. The support axis 78*a* is an axial body for bearing the frame body 78. When the support axis 78*a* is inserted into an axis insert groove 76*a* provided on the frame body supporting portion 76 on the side of the base 70, one end portion side of the frame body 78 is in a state that the one end portion side is supported with respect to the frame supporting portion 76. Further, the rock portion 78*b* is used for fixing the other end portion of the frame body 78 on the side opposite to the support axis 78*a*. Even in a state that the frame body 78 is erected by using the support axis 78*a* and the rock portion 78*b*, the rotating body 68 can freely rotate with respect to the frame body 78.

In a state that one of the plurality of receiving portions 72 provided at the rotating body 68 is arranged at a position adjacent to the discharging port 74, the supplied area forming portion 78*c* is positioned between the receiving portion 72 located at a position adjacent to the discharging port 74 (hereinafter, this is sometimes referred to as "a delivery target receiving portion 72") and the receiving portion 72 adjacent to the upper stream side of the positive rotational direction of the rotating body 68 than the delivery target receiving portion 72 (hereinafter, this is sometimes referred to as "an upper stream side receiving portion 72"). The supplied area forming portion 78*c* is constituted of a through-hole passing through the frame body 78 in the thickness direction thereof. Although the supplied area forming portion 78*c* may have any opening shape, the opening shape thereof is substantially circular in this embodiment.

In a state that one of the plurality of receiving portions 72 is arranged at the position adjacent to the discharging portion 74, the supplied area forming portion 78*c* forms a bottomed space having a bottom formed by an area corresponding to the thin-walled portion 68*e* in the surface (the front plate 68*a*) of the rotating body 68. This space constitutes an area (a supplied area 80) into which the medicines dispensed from the side of the medicine preparing and dispensing portion 20 are supplied before the medicines are received by each receiving portion 72. When the rotating body 68 is positively rotated after the medicines have been supplied into the supplied area 80 to move the upper stream side receiving portion 72 under the supplied area forming portion 78*c*, the medicines in the supplied area 80 are transferred into the upper stream side receiving portion 72. As described above, the bottom of the supplied area 80 can be opened and closed by relatively rotating the rotating body 68 with respect to the supplied area forming portion 78*c* and thus it is possible to transfer the medicines into the receiving portion 72 in a phase before the receiving portion 72 reaches the position adjacent to the discharging port 74.

In a state that one of the plurality of receiving portions 72 provided at the rotating body 68 is arranged at the position adjacent to the discharging port 74, the delivery area forming portion 78*d* is a portion for forming an area (a delivery area 82) containing this receiving portion 72 and the discharging port 74. The delivery area forming portion 78*d* has a side wall portion 78*f* surrounding an outer periphery of the supplied area 80. Further, the delivery area forming portion 78*d* has a partition wall portion 78*g* for separating between an area on the side of the receiving portion 72 constituting the supplied area 80 and an area on the side of the discharging port 74. A height of the partition wall portion 78*g* is lower than that of the side wall portion 78*f*.

The pre-absorbing position forming portion 78*e* is provided in a working area of the delivering device 64 described later. Further, the pre-absorbing position forming portion 78*e* is provided at a location whose surface is smooth in the frame body 78. Although the pre-absorbing position forming portion 78*e* may be provided at any location as long as the location satisfies these conditions, the pre-absorbing position forming portion 78*e* is provided in an area on the center side of the rotating body 68 in a state that the frame body 78 is attached in this embodiment.

The delivering device 64 is configured to individually and one by one hold the medicines in the receiving portion 72 (the delivery target receiving portion 72) reaching the position adjacent to the discharging port 74 and release the medicine in the discharging port 74 to perform an action (a delivery action) for delivering the medicines from the side of the medicine preparing and dispensing portion 20 to the side of the pre-packaging photographing portion 100. Although the delivering device 64 may be any device as long as it can perform the delivery action, the delivering device 64 is configured to include a driving portion 84 and a holding portion 86 as shown in FIG. 3 and FIG. 4 in this embodiment.

The driving portion 84 is configured to move the holding portion 86 between the receiving portion 72 (the delivery target receiving portion 72) and the discharging port 74. Although the driving portion 84 may be any portion as long as it can perform such an action, the driving portion 84 is constituted of a multi-joint robot such as a scalar robot and a manipulator in this embodiment. The driving portion 84 can move a delivering arm 84*a* between the receiving portion 72 (the delivery target receiving portion 72) and the discharging port 74.

The holding portion 86 is configured to perform an action (a holding action) for individually and one by one holding the medicines and an action (a hold releasing action) for releasing the medicine being held. Although the holding portion 86 may be any portion as long as it can perform the holding action and the hold releasing action, the holding portion 86 is configured to include an adsorbing portion 88, a suctioning device 90 and a discharging device 92 in this embodiment. The absorbing portion 88 includes a member obtained by providing a contacting portion 88*b* at a tip end portion of a hollow absorbing tube 88*a*. The suctioning device 90 and the discharging device 92 are connected to the absorbing tube 88*a* through pipes. Further, the contacting portion 88*b* is a portion which contacts with the medicine which is a holding target. It is preferable that the contacting portion 88*b* has elasticity in order to prevent the medicine from being broken or the like. In this embodiment, a pad-like portion formed from an elastic material such as rubber is used as the contacting portion 88*b*.

The suctioning device 90 is a device which is constituted of a pump or the like, for example, so as to provide suctioning force. Thus, when the suctioning device 90 is actuated, the suctioning force acts at the contacting portion 88*b* attached to the tip end of the absorbing tube 88*a*, thereby individually and one by one suctioning and holding the medicines. Further, by stopping the suctioning device 90, it is possible to release the suctioning force acting at the contacting portion 88*b* to release the medicine. Further, the discharging device 92 is constituted of a compressor or the like, for example, and connected to the absorbing tube 88*a* through the pipe. By actuating the discharging device 92, it is possible to discharge air in a direction opposite to a working direction of the suctioning force due to the suctioning device 90. Thus, by actuating the discharging device 92 when the medicine being held by the holding portion 86 is released, it is possible to apply discharging force to the medicine being held and actively release the medicine.

As shown in FIG. 4(*c*), the photographing unit 66 includes a receiving photographing portion 94 and an illuminating portion 96. The receiving photographing portion 94 is arranged on the upper side of the rotating body 68. The receiving photographing portion 94 can move the delivering arm 84*a* above the receiving portion 72 (the delivery target receiving portion 72) reaching the position adjacent to the discharging port 74 and photograph an image so that the delivery target receiving portion 72 is contained in the image to obtain image data. The illuminating portion 96 is arranged on the lower side of the rotating body 68. The illuminating portion 96 can illuminate the delivery target receiving portion 72 from the lower side. As described above, the bottom portion of the delivery target receiving portion is constituted of the rear plate 68*b* having the translucency. Thus, when the photographing is performed by the receiving photographing portion 94 in a state that the illuminating portion 96 illuminates the delivery target receiving portion 72, the medicines existing in the delivery target receiving portion 72 appear in the image obtained by the photographing as shadows. Thus, by identifying portions of the shadows in the image, it is possible to utilize the image obtained by the receiving photographing portion 94 for finding out positions where the medicines exist.

Figure 8:
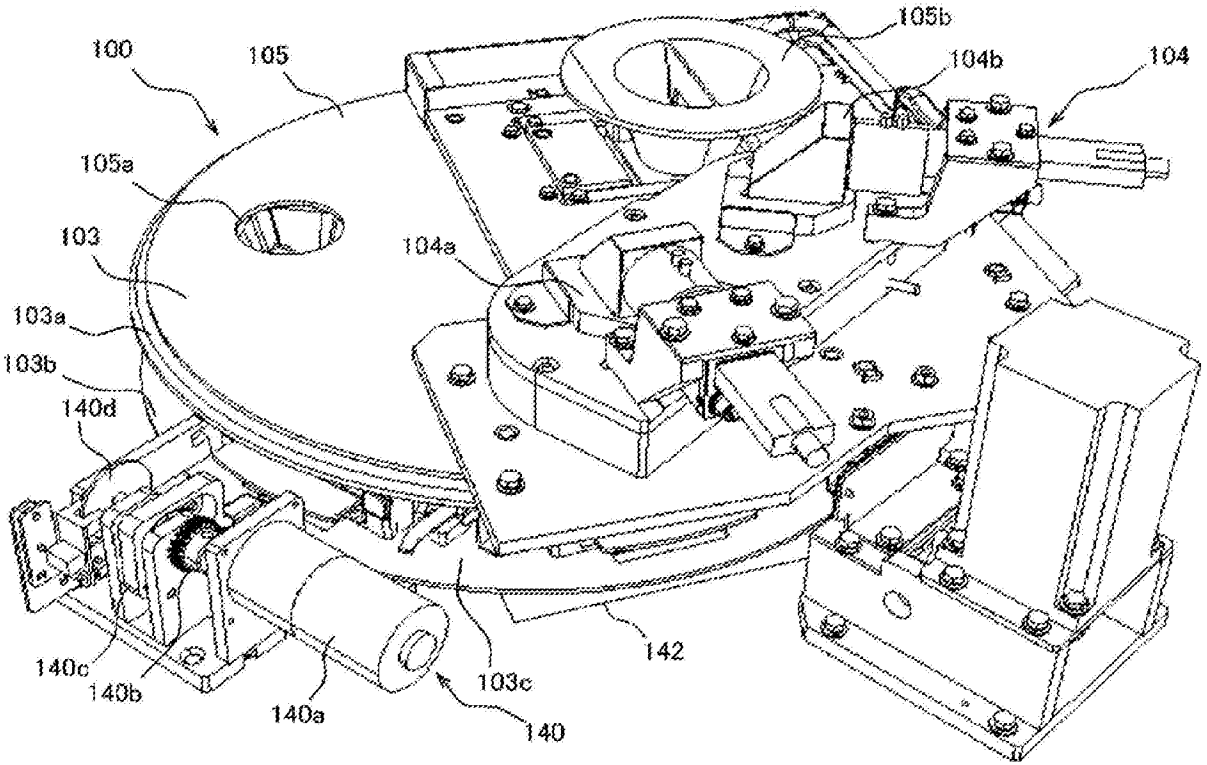
FIG. 8 is a perspective view showing one example of a pre-packaging photographing portion.

The pre-packaging photographing portion 100 is used for photographing the medicines in order to read the identification information attached to the medicines in a phase before the medicines are packaged by the packaging portion 150 described later. As shown in FIG. 8, the pre-packaging photographing portion 100 includes a medicine rolling and moving device 102 and a medicine photographing device 104. The pre-packaging photographing portion 100 can photograph the medicines rolled and moved by the medicine rolling and moving device 102 with the medicine photographing device 104. The medicine rolling and moving device 102 is arranged with respect to a rolling and moving portion rotating body 103 described later. Further, the medicine photographing device 104 is attached to an attachment body 105 provided on the upper side of the rolling and moving portion rotating body 103.

Figure 9:
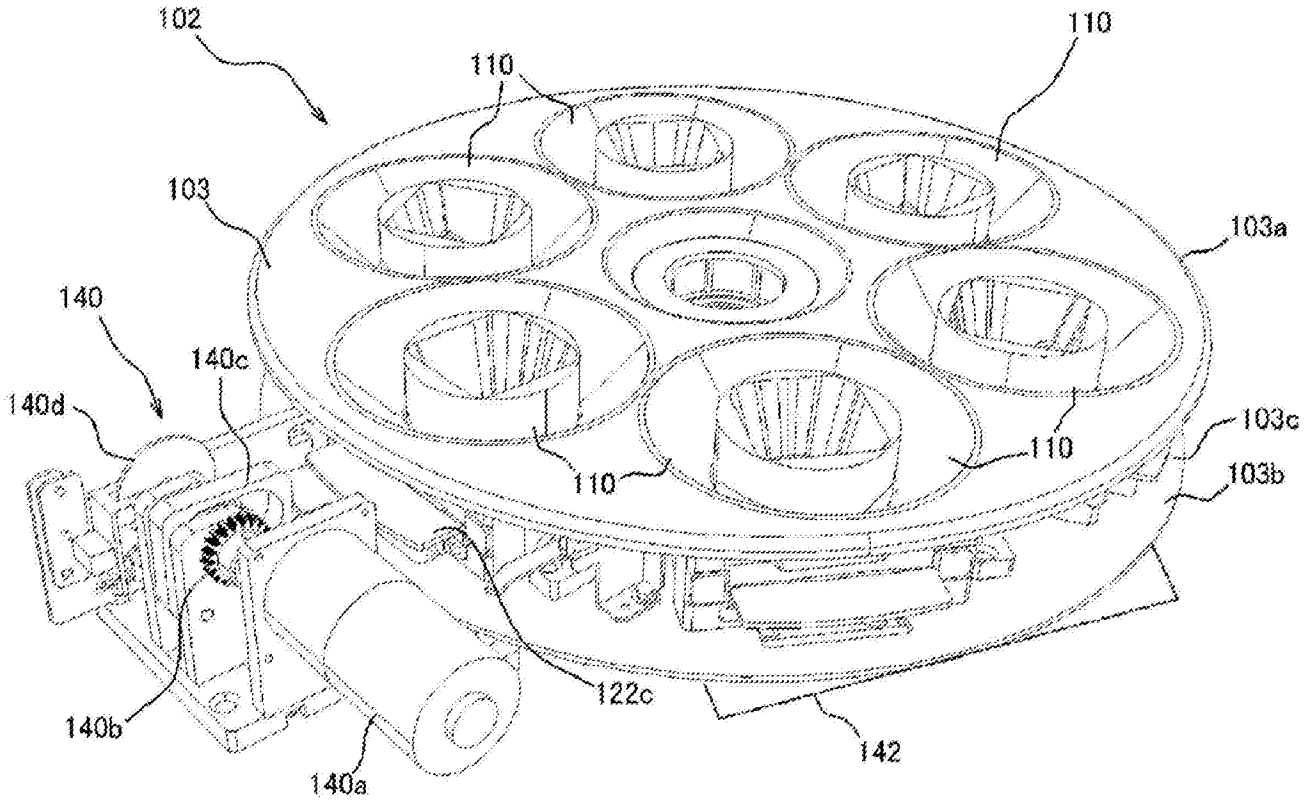
FIG. 9 is a perspective view showing a part of the pre-packaging photographing portion shown in FIG. 8.

As shown in FIG. 8 and FIG. 9, the rolling and moving portion rotating body 103 is a member in which a disk-shaped top face portion 103*a* and a bottom face portion 103*b* arranged in substantially parallel with each other and a space 103*c* where a rolling and moving unit 110 is formed between the top face portion 103*a* and the bottom face portion 130*b*. The rolling and moving portion rotating body 103 is configured to be rotated by a driving source such as a motor not shown in the drawings.

As shown in FIG. 8, the attachment body 105 is a plate-like body arranged in substantially parallel with the top face portion 130*a* on the upper side of the rolling and moving portion rotating body 103. In the attachment body 105, an opening (not shown in the drawings) for allowing the rolling and moving portion rotating body 103 to be photographed is formed at an attachment position for the medicine photographing device 104. Further, an opening 105*a* for supplying the medicines from the manually distributing portion 24 into the medicine rolling and moving device 102 and a hopper 105*b* for supplying the medicines dispensed from the cassette dispensing portion 22 of the medicine preparing and dispensing portion 20 into the medicine rolling and moving device 102 are connected to the attachment body 105.

The medicine rolling and moving device 102 has rolling and moving units 110 and an opening-closing mechanism 140. Each rolling and moving unit 110 includes an operating mechanism for rolling and moving the medicines. In this embodiment, the plurality of rolling and moving units 110 (in the illustrated example, the number of the rolling and moving units 110 is six) are provided in a state that the rolling and moving units 110 are aligned in a circumferential direction of the disk-shaped rolling and moving portion rotating body 130 and the medicines which are inspection targets can be supplied into each of the rolling and moving units 110.

Figure 10:
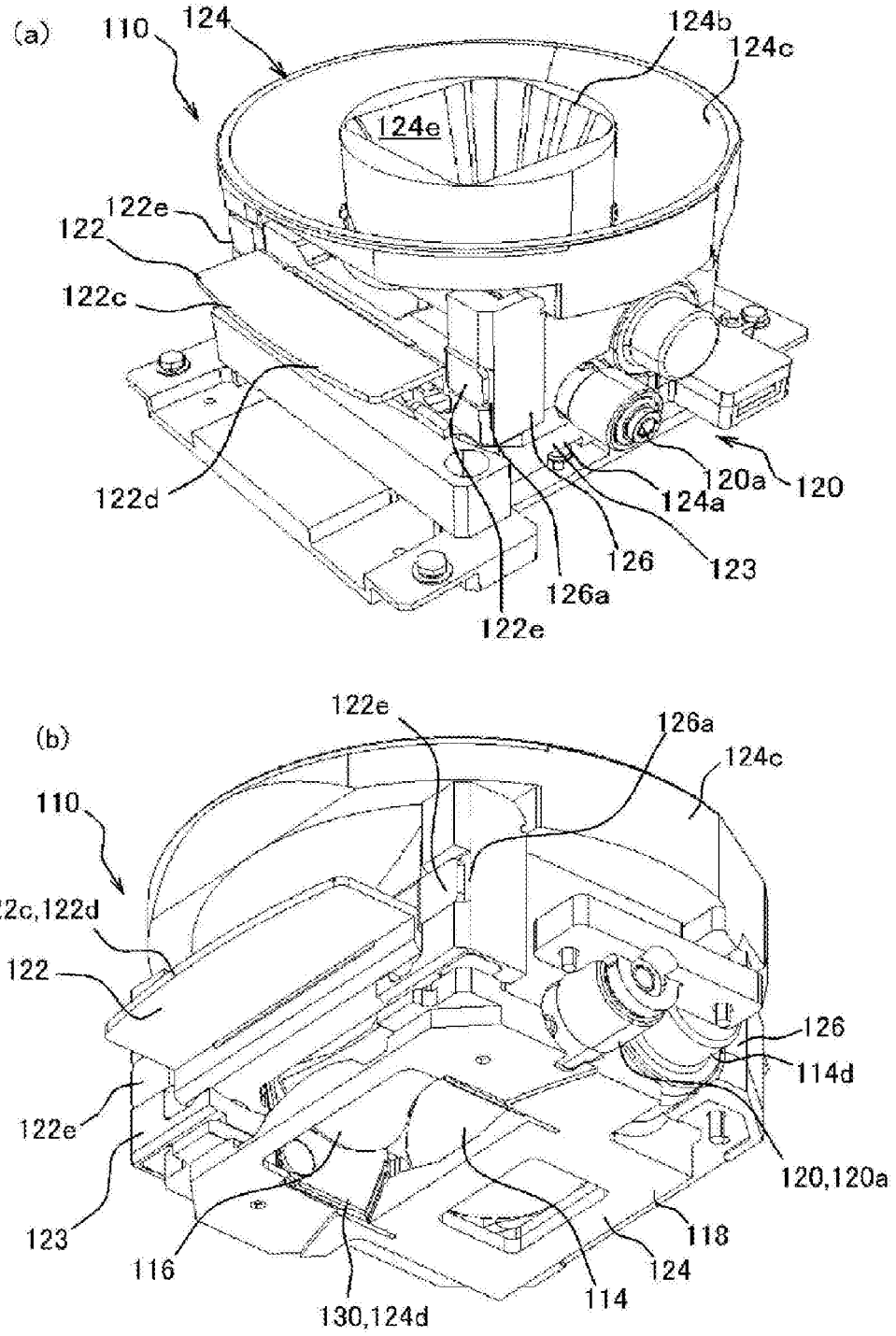
FIG. 10(*a*) is a perspective view of a medicine rolling and moving device included in the pre-packaging photographing portion shown in FIG. 8) seen from the upper side and FIG. 10(*b*) is a perspective view of the medicine rolling and moving device seen from the lower side.

The rolling and moving unit 110 has an external shape as shown in FIGS. 10(*a*), 10(*b*). The rolling and moving unit 110 has a first rotating roller 114 and a second rotating roller 116 which are built-in and can use these rollers 114, 116 to roll and move the medicines supplied from the side of the medicine preparing and dispensing portion 20. The rolling and moving unit 110 includes a fixed portion 118 fixed to the rolling and moving portion rotating body 103, a driving portion 120 and a movable portion 122 which are attached to the fixed portion 118, and an introducing portion 124 opening toward the upper side so that the medicines can be introduced therein.

Figure 13:
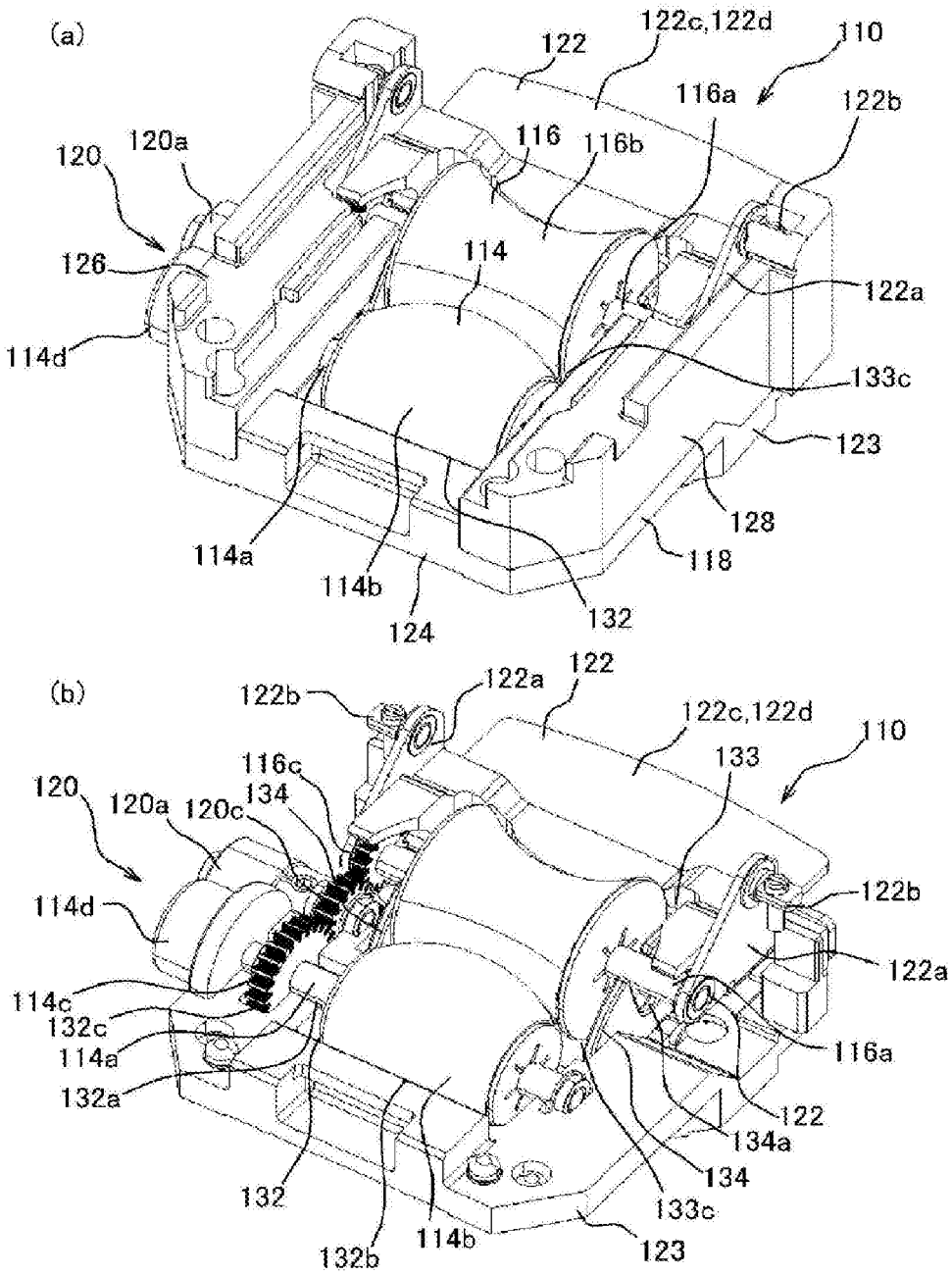
FIG. 13(*a*) is a perspective view showing a state that a bottom constitution member is removed from the medicine rolling and moving device shown in FIG. 12 and FIG. 13(*b*) is a perspective view showing a state that a first side constitution body and a second side constitution body are also removed from the medicine rolling and moving device shown in FIG. 13(*a*).
Figure 14:
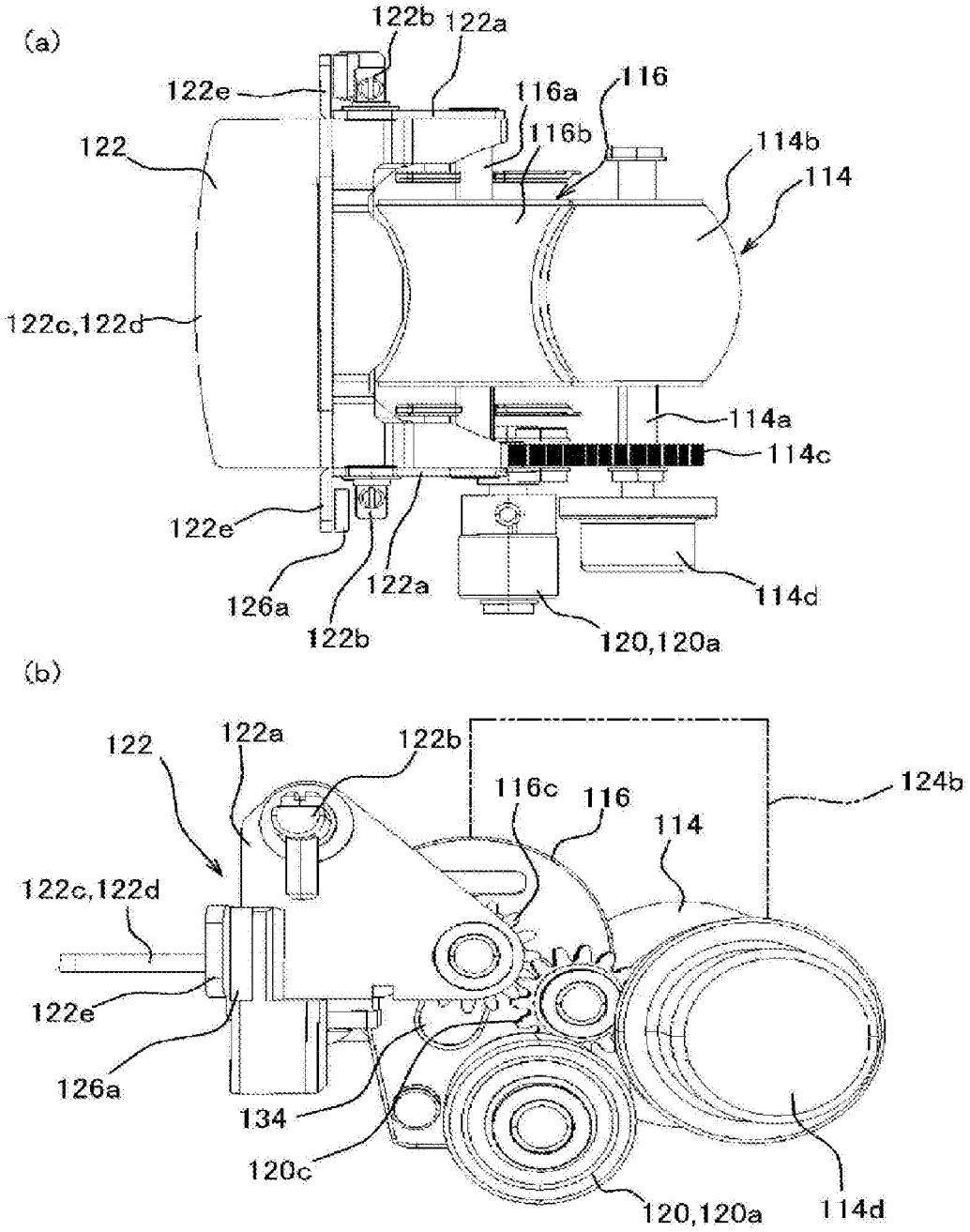
FIG. 14(*a*) is a planar view showing a relationship among a first rotating roller, a second rotating roller and a movable piece included in the medicine rolling and moving device shown in FIG. 10 and FIG. 14(*b*) is a side view of the figure (a).

As shown in FIG. 13 and FIG. 14, the first rotating roller 114 is a member in which a first roller portion 114*b* made of rubber is integrated with a periphery of a first rotational axis 114*a*. The first roller portion 114*b* has a cask-like external shape expanding in an arc-shape toward an outer side of a radial direction thereof (a direction crossing an axial direction thereof) from both end sides in the axial line direction of the first rotational axis 114*a* to a center side of the first rotational axis 114*a*. Namely, the first roller portion 114*b* is configured to be a so-called radial-crown type or taper-crown type roller in which an outer diameter of a portion on the center side of the axial direction is larger than outer diameters of the both end portions. The first rotating roller 114 is rotatably supported by attaching the first rotational axis 114*a* with respect to the fixed portion 118. Further, a first gear 114*c* is integrally attached to one end side of the first rotational axis 114*a*. Further, a handle 114*d* for manually rotating the first rotational axis 114*a* at the time of maintenance or the like is provided on an end portion of the first rotational axis 114*a*.

As shown in FIG. 13 and FIG. 14, the second rotating roller 116 is a member in which a second roller portion 116*b* made of rubber is integrated with a periphery of a second rotational axis 116*a*. The second roller portion 116*b* is formed into a shape narrowing in an arc-shape toward an inner side of an axial direction from both end sides of an axial line direction of the second rotational axis 116*a* to a center side of the second rotational axis 116*a*. Namely, contrary to the first roller portion 114*b*, the second roller portion 116*b* is configured to be a so-called inverted-crown type roller in which an outer diameter of a portion on the center side of the axial direction is smaller than outer diameters of the both end portions. The second roller portion 116*b* is curved into a shape along the first roller portion 114*b*. The second rotating roller 116 is rotatably supported by attaching the second rotational axis 116*a* with respect to the movable portion 122. Further, a second gear 116*c* is integrally attached to one end side (the side on which the first gear 114*c* is provided in the first rotating roller 114) of the second rotating roller 116.

The fixed portion 118 is a member arranged so as to fit a position where an opening (not shown in the drawings) for discharging the medicines is formed in the rolling and moving rotating body 103. The fixed portion 118 includes a base portion constitution body 123, a first side constitution body 126 and a second side constitution body 128. The base portion constitution body 123 forms a bottom portion of the fixed portion 118 and is fixed on the rolling and moving rotating body 103. As shown in FIG. 10(*b*), a discharging port 130 for discharging the medicines is formed in the base portion constitution body 123. The base portion constitution body 123 is positioned and fixed with using the discharging port 130 and the opening for discharging the medicines formed in the rolling and moving rotating body 103 as a reference.

As shown in FIG. 13, a roller attachment portion 132, a driving portion attachment portion 133 and the like are provided on the base portion constitution body 123. The first rotating roller 114 is freely rotatably attached to the roller attachment portion 132. Specifically, an axis arrangement portion 132*a*, a roller arrangement portion 132*b* and a gear arrangement portion 132*c* are provided in the roller attachment portion 132 and the first rotational axis 114*a*, the first roller portion 114*b* and the first gear 114*c* are respectively arranged on these portions. Further, a portion adjacent to a front side (an outer side of an axial direction of the rolling and moving rotating body 103) of the rolling and moving unit 110 with respect to an arrangement area for the first rotating roller 114 is set as an arrangement area for the second rotating roller 116. Guide portions 134, 134 are arranged in the portion to be set as the arrangement area for the second rotating roller 116. Guide grooves 134*a*, 134*a* are respectively formed on the guide portions 134, 134. The guide grooves 134*a*, 134*a* are used for guiding the second rotational axis 116*a* at the time when the second rotating roller 116 oscillates together with the movable portion 122 described later.

Figure 12:
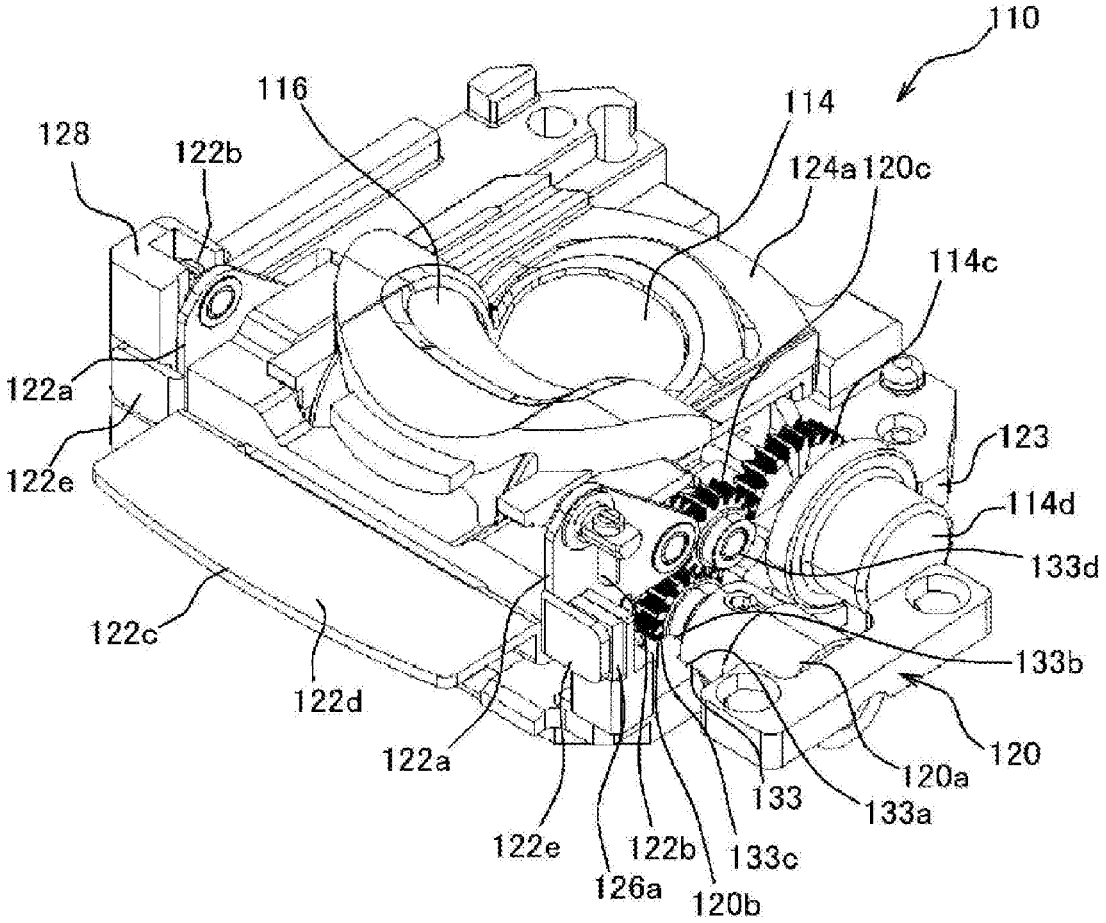
FIG. 12 is a perspective view showing a state that an introducing member is removed from the medicine rolling and moving device shown in FIG. 11.

Further, as shown in FIG. 12 and the like, the driving portion 120 is attached to the driving portion attachment portion 133. The driving portion 120 is used for driving the first rotating roller 114 and the second rotating roller 116. The driving portion 120 includes a driving force applying portion 120*a*, a driving gear 120*b* and a driven gear 120*c*. Although it is possible to employ any conventionally known motor as the driving force applying portion 120*a*, it may be possible to employ any mechanism which can apply the driving force with a combination of a driving force transmission mechanism such as a magnet gear and a driving source such as a motor provided at another location than the medicine photographing device 104 and the like as the driving force applying portion 120*a*, for example. A motor attachment portion 133*a* (see FIG. 12), a rotational axis arrangement portion 133*b* (see FIG. 12), a driving gear arrangement portion 133*c* (see FIG. 12) and a driven gear arrangement portion 133*d* (see FIG. 13) are provided in the driving portion attachment portion 133. A main body portion and a rotational axis of the driving force applying portion 120*a* are respectively arranged on the motor attachment portion 133*a* and the rotational axis arrangement portion 133*b*. The driving gear 120*b* attached to the rotational axis of the driving force applying portion 120*a* is freely rotatably arranged on the driving gear arrangement portion 133*c*. Further, the driven gear 120*c* is freely rotatably arranged on the driven gear arrangement portion 133*d* so as to be meshed with the driving gear 120*b*.

Figure 11:
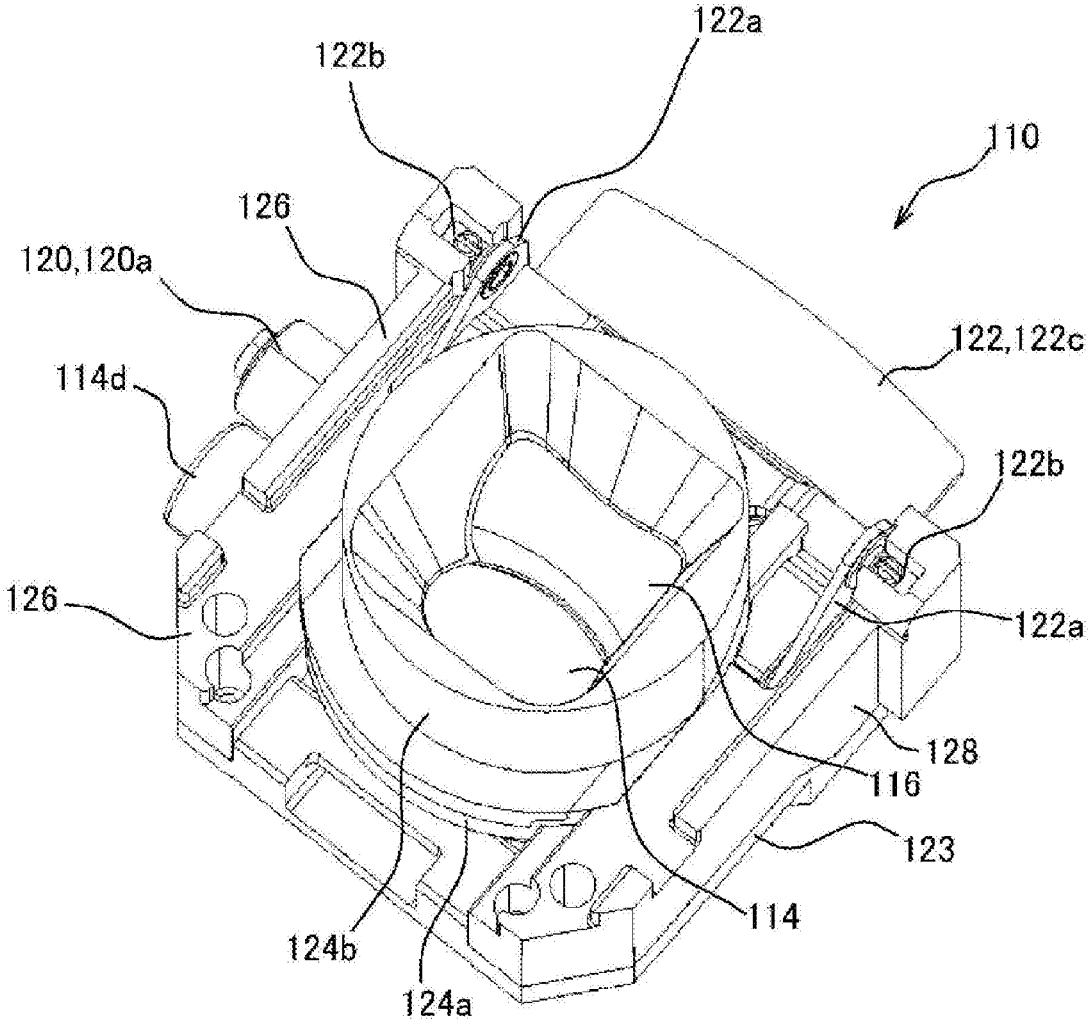
FIG. 11 is a perspective view showing a state that a reflecting member is removed from the medicine rolling and moving device shown in FIG. 10.

As shown in FIG. 10, FIG. 11, FIG. 13 and the like, the first side constitution body 126 and the second side constitution body 128 are constitution bodies respectively arranged substantially symmetric with respect to the base portion constitution body 123. Each of the first side constitution body 126 and the second side constitution body 128 is provided to stand on an upper portion of the base portion constitution body 123 and constitutes a side wall of the medicine rolling and moving device 102. Support axes 122*b*, 122*b* for supporting the movable portion 122 are respectively attached to the first side constitution body 126 and the second side constitution body 128. This makes it possible to support the movable portion 122 so that the movable portion 122 can oscillate with respect to the first side constitution body 126 and the second side constitution body 128.

The movable portion 122 is configured by providing an operating piece 122*c* so as to bridge between (inside) a pair of movable pieces 122*a*, 122*a* and integrating these pieces. Each of the movable pieces 122*a*, 122*a* is constituted of a plate-like body having a substantially triangle shape in a front view thereof. The seconds rotating roller 116 is provided between the movable pieces 122*a*, 122*a*. The second rotating roller 116 is rotatably supported by respectively connecting one end side and the other end side of the second rotational axis 116*a* to the movable pieces 122*a*, 122*a*. Further, the support axes 122*b*, 122*b* are respectively provided at the movable pieces 122*a*, 122*a* so as to protrude toward the outside. As described above, the support axes 122*b*, 122*b* are respectively inserted into the first side constitution body 126 and the second side constitution body 128. With this configuration, the movable portion 122 is supported so that the movable portion 122 can oscillate around the support axes 122*b*, 122*b*.

Figure 15:
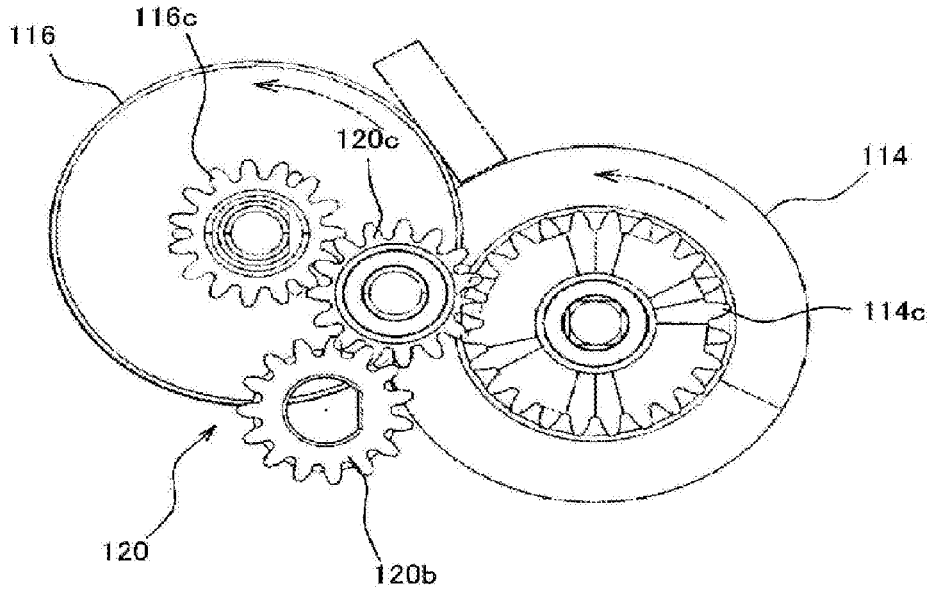
FIG. 15 is a side view showing a relationship among the first rotating roller, the second rotating roller and a driving portion included in the medicine rolling and moving device shown in FIG. 10.

As shown in FIG. 10 to FIG. 14, the operating piece 122*c* has an operating portion 122*d* and fixed portions 122*e*. The operating portion 122*d* is a plate-like portion formed so as to protrude toward the front side of the rolling and moving unit 110 (the outer side of the axial direction of the rolling and moving portion rotating body 103). The operating portion 122*d* is a portion operated by the opening-closing mechanism 140 described later. The operating portion 122*d* is set with a substantially horizontal posture as shown in FIG. 10 to FIG. 14 in the normal state. In this state, the first rotating roller 114 and the second rotating roller 116 are in a nearest positional relationship as shown in FIG. 13 to FIG. 15 and thus it is possible to arrange the medicines which are the inspection targets on the first rotating roller 114 and the second rotating roller 116.

Here, in a state that the first rotating roller 114 and the second rotating roller 116 are close to each other and the medicines which are the inspection targets can be arranged on them, an axial center position (a rotational center) of the second rotating roller 166 is positioned on the upper side than an axial center position (a rotational center) of the first rotating roller 114. This makes it possible to reliably rotate the medicines on the first rotating roller 114 and the second rotating roller 116.

Figure 16:
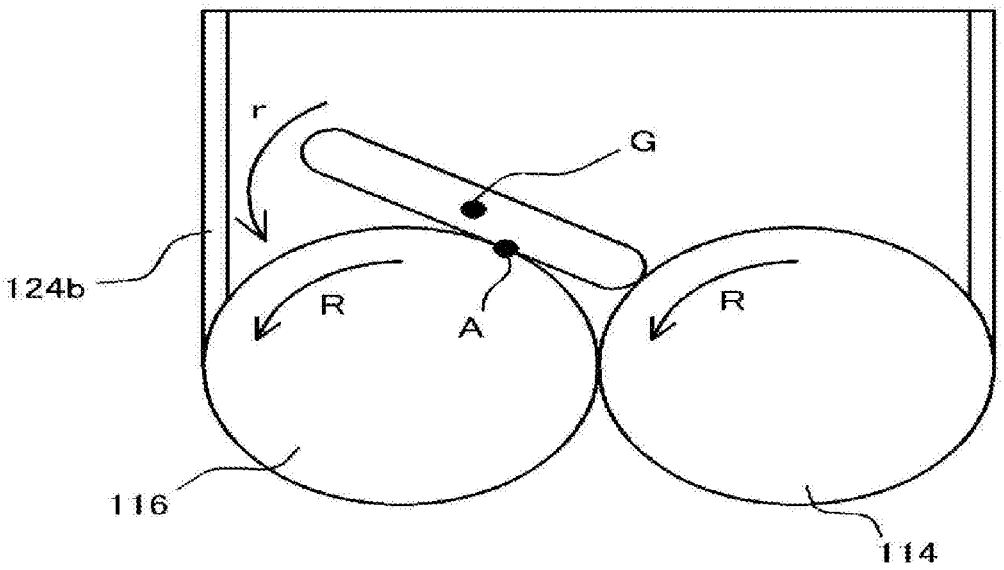
FIG. 16 is an explanation view for explaining a rotating principle of medicines due to the first rotating roller and the second rotating roller.
Figure 16:
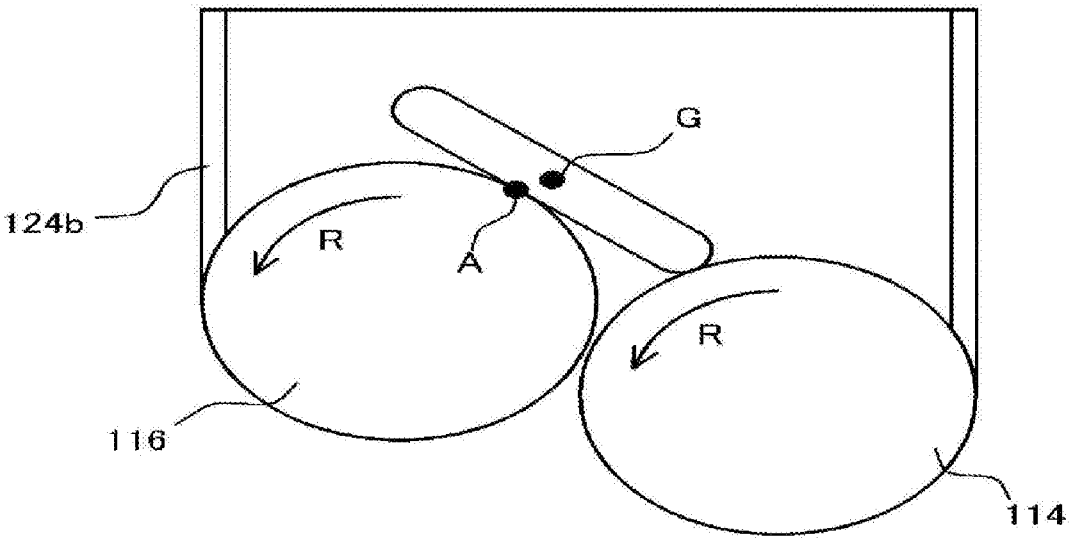

Specifically, if the first rotating roller 114 and the second rotating roller 116 are arranged at the same or same level height as shown in FIG. 16(*a*), there is a concern that the medicines do not rotate even when the first rotating roller 114 and the second rotating roller 116 are rotated due to the following principle. Namely, when the rollers 114, 116 are rotated in a direction indicated by an arrowed line R in the figure (a left rotating direction in the illustrated example), ratting force in a direction (a right rotating direction in the illustrated example) opposite to the rotation of the rollers 114, 116 is applied to the medicine. Here, in a case where a gravity center G of the medicine is positioned on the side (the right side in the illustrated example) getting away from the roller 114 than a contact portion A of the medicine with respect to the roller 116 due to reasons such as that the diameters of the rollers 114, 116 are smaller than a size of the medicine, force in the same direction (the left rotational direction) as the rollers 114, 116 acts to the medicine as indicated by an arrowed line r in the figure due to an effect of a weight of the medicine. Due to such a reason, in a case where the rollers 114, 116 are arranged at the same or same level height, there is the concern that the medicine cannot be rotated even when the rollers 114, 116 are rotated.

In contrast, in a case where one of the rollers 114, 116 (in this embodiment, the second rotating roller 116) is arranged at a higher position than the other one of the rollers 114, 116 as shown in FIG. 16(*b*), the medicine is in a state that the medicine stands compared with the case that the rollers 114, 116 are arranged at the same or same level height. Specifically, in a case where the rollers 114, 116 rotate in the right direction around the first rotational axis 114*a* and the second rotational axis 116*a*, the rotational center of one of the rollers 114, 116 provided on the right side is arranged so as to be positioned at a higher position than the rotational center of the other one of the rollers 114, 116. In contrast, in a case where the rollers 114, 116 are rotated in the left direction around the rotational axes 114*a*, 116*a* as shown in FIG. 16(*b*), the rotational center of one of the rollers 114, 116 provided on the left side is arranged so as to be positioned at a higher position than the rotational center of the other one of the rollers 114, 116.

By taking the above-described configuration, the gravity center G of the medicine arranged on the rollers 114, 116 is in a state that the gravity center G is positioned on the side (the right side in the illustrated example) nearer to the roller 114 than the contact portion A between the roller 116 and the medicine and thus the rotation of the medicine is not interfered. Thus, by positioning the rotational center of one of the first rotating roller 114 and the second rotating roller 116 (in this embodiment, the second rotating roller 116) at a higher position than the rotational center of the other one of the first rotating roller 114 and the second rotating roller 116, it is possible to reliably rotate the medicine even if a roller whose diameter is relatively small is employed as the rollers 114, 116. Further, since it is possible to employ a small diameter roller as the rollers 114, 116, it is possible to reduce the size of the apparatus structure.

In addition to this matter, as shown in FIG. 15, the first gear 114*c* and the second gear 116*c* respectively attached to the first rotating roller 114 and the second rotating roller 116 are connected to the driving gear 120*b* connected to the rotational axis of the driving force applying portion 120*a* through the driven gear 120*c*. Thus, when the driving force is transmitted to each gear along with the driving of the driving force applying portion 120*a*, the first rotating roller 114 and the second rotating roller 116 rotate in the same direction. In the example shown in FIG. 15, the first rotating roller 114 and the second rotating roller 116 rotate in the left direction. Thus, as indicated by a dotted line in FIG. 15, when the medicine is arranged on the first rotating roller 114 and the second rotating roller 116, an outer peripheral surface of the second rotating roller 116 moves in a direction separating from the side of the first rotating roller 114 along with the rotation of the second rotating roller 116 at the contact portion between the medicine and the second rotating roller 116. Further, along with the rotation of the first rotating roller 114, an outer peripheral surface of the first rotating roller 114 moves in a direction getting close to the side of the second rotating roller 116 at the contact portion between the medicine and the first rotating roller 114. With this configuration, the medicine rotates with remaining in the vicinity of a border portion between the first rotating roller 114 and the second rotating roller 116. Further, the medicine rotates as if an imaginary rotational axis extending in a direction along the axial line direction of the first rotating roller 114 and the second rotating roller 116 exists. This makes it possible to periodically expose the identification information (information for identifying the kind of the medicine) attached to the surface of the medicine with an engraved mark or a print toward the medicine photographing device 104.

Further, as described above, the first rotating roller 114 is configured to be the so-called radial-crown type or taper-crown type roller and the first rotating roller 114 expands toward the outer side of the radial direction from the both end sides of the axial line direction to the center side of the first rotational axis 114*a*. Thus, along with the rotation of the first rotating roller 114, propulsive force in a direction toward the substantially center portion of the axial line direction of the first rotating roller 114 acts to the medicine. Therefore, even if the medicine supplied into the rolling and moving unit 110 exists at a position away from the center portion of the axial line direction, the medicine is moved to the substantially center position of the axial line direction by the propulsive force caused by the rotation of the first rotating roller 144 and rotates at this position. Specifically, in a case of using the first rotating roller 114 of the radial-crown type, a speed difference occurs on the surface of the first rotating roller 114 being rotating due to a difference of the diameters of the center portion and the both end portions of the axial line direction. This makes it possible to obtain an effect (that is a so-called crown effect or an effect similar to the crown effect) that the medicine is moved to the center side where the speed is fast even if the medicine is supplied to a position deviated toward the both end sides of the first rotating roller 114.

As described above, by employing the radial-crown type roller as the first rotating roller 114, it is possible to rotate the medicine at a fixed position with respect to camera units 104*a*, 104*b* included in the medicine photographing device 104. This makes it possible to improve a photographing accuracy for the medicine by the camera units 104*a*, 104*b*. Further, by configuring the second rotating roller 116 to be the inverted-crown type roller curved along the first rotating roller 114, it is possible to prevent a clearance which can be a cause of the dropping of the medicine to be photographed from being formed between the rollers 114, 116.

On the other hand, when an operation for lifting up the operating portion 122*d* being in the substantially horizontal posture in the normal state is performed, the movable pieces 122*a*, 122*a* oscillate around the support axes 122*b*, 122*b*. Along with this movement, the second rotational axis 116*a* is guided by the guide grooves 134*a*, 134*a* of the guide portions 134, 134 provided in the base portion constitution body 123 and thus the second rotating roller 116 is lowered toward the diagonal lower side. This makes it possible to expand the clearance between the first rotating roller 114 and the second rotating roller 116, thereby dispensing the medicine on these rollers 114, 116 toward the lower side.

As shown in FIG. 10, FIG. 12, FIG. 14 and the like, each of the fixed portions 122*e*, 122*e* is a piece-like portion formed so as to protrude toward the outer side (the lateral side) with respect to each of the movable pieces 122*a*, 122*a*. Each of the fixed portions 122*e*, 122*e* is substantially perpendicular to the operating piece 122*c* and makes a surface contact with the front surfaces of the first side constitution body 126 and the second side constitution body 128 in the normal state. Each of the fixed portions 122*e*, 122*e* is formed from a magnetic body such as iron, for example. Thus, in the normal state, the fixed portion 122*e* on the side of the first side constitution body 126 absorbs (adheres) and is fixed with respect to a magnet 126*a* provided on the front side of the first side constitution body 126 as shown in FIG. 12 and FIG. 14 in the normal state. Therefore, the operating piece 122*c* is not lifted up until external force exceeding adsorption force acting to the fixed portion 122*e* acts to the operating piece 122*c*.

The introducing portion 124 has a configuration (see FIG. 10) in which a reflecting member 124*c* is attached to a member obtained by combining a bottom constitution member 124*a* and an introducing member 124*b* (see FIG. 11). As shown in FIG. 11 and FIG. 12, the bottom constitution member 124*a* is a member to be attached to the first rotating roller 114 and the second rotating roller 116 attached to the fixed portion 118 so as to cover the first rotating roller 114 and the second rotating roller 116 from the upper side. The bottom constitution member 124*a* is configured to be the member having dark color (in this embodiment, black color).

As shown in FIG. 11, the introducing member 124*b* is a tubular member to be connected on the upper side of the bottom constitution member 124*a*. The introducing member 124*b* is formed from a material (preferably, a colorless and transparent material) having translucency such as an acrylate resin. This makes it possible to introduce reflected light caused on the reflecting member 124*c* described later to the inside through the introducing member 124*b*. The introducing member 124*b* is a cylindrical member in which an introduced area 124*e* whose cross-sectional shape is non-circular is formed. In this embodiment, as the introducing member 124*b*, a cylindrical member communicating in the vertical direction whose outer circumferential surface has a substantially circular cross-sectional shape but an inner circumferential surface has a polygonal cross-sectional surface (in this embodiment, the inner circumferential surface has a substantially square cross-sectional surface).

Here, in a case where the introducing member 124*b* having the translucency as described above is connected to the bottom constitution portion 124*a*, there is a concern that light is reflected on a bottom (a contacting end 124*f*) of the introducing member 124*b* and this reflected light adversely affects the photographing for the medicines by the medicine photographing device 104. Specifically, due to an effect of the reflected light caused on the contacting end 124*f*, the introducing member 124*b* appears in the image photographed by the medicine photographing device 104 as a white artifact and thus it becomes difficult to distinguish the medicines from the introducing member 124*b*.

Figure 17:
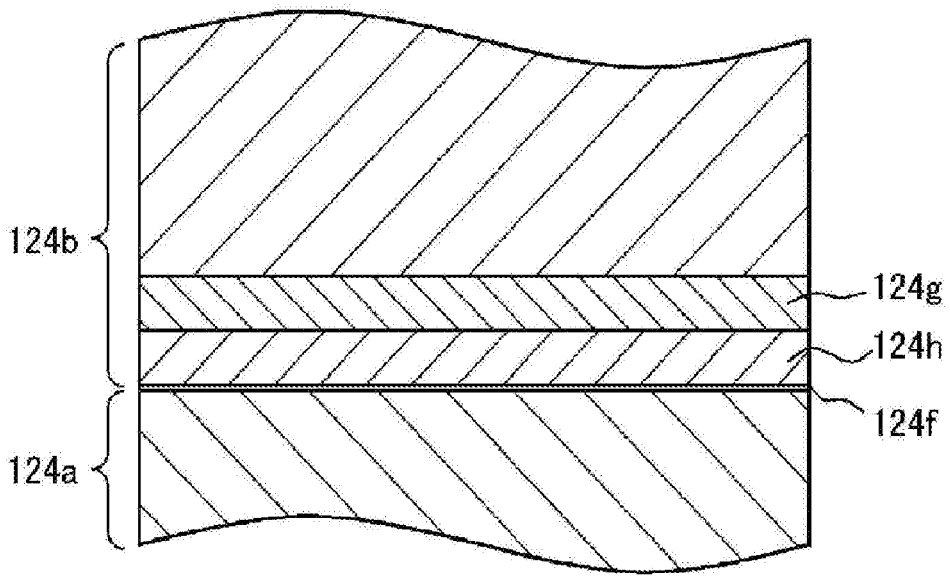
FIG. 17 is an explanation view for explaining a structure in a vicinity of a connecting portion between the bottom constitution member and the introducing member included in the medicine rolling and moving device shown in FIG. 10.

In order to address the above-described concern, in this embodiment, as shown in FIG. 17, an end portion (the contacting end 124*f*) on the side of the introducing member 124*b* contacting with the bottom constitution member 124*a* along with the connecting of the introducing member 124*b* to the bottom constitution member 124*a* is colored with dark color (in this embodiment, black color). More specifically, a colored layer 124*g* colored with matte-black color is provided on the contacting end 124*f* of the introducing member 124*b*. This makes it possible to suppress light from being reflected on the contacting end 124*f*. In addition to this matter, in this embodiment, since the bottom constitution member 124*a* also has the dark color (in this embodiment, matte-black color) as described above, it is possible to even more suppress the reflection of light. Further, by providing the bottom constitution member 124*a*, it is possible to prevent the colored layer 124*g* attached to the contact end 124*f* of the introducing member 124*b* from being released and fallen by the rotation of the first rotating roller 114 and the second rotating roller 116.

Further, in this embodiment, an antistatic layer 124*h* made of an antistatic agent is provided on a surface of the colored layer 124*g*. This makes it possible to suppress static electricity caused when the medicine pivotally moves in the introducing member 124*b* with the antistatic layer 124*h*. In this regard, although the antistatic layer 124*h* is provided as another layer than the colored layer 124*g* in this embodiment, it may be possible to take a configuration in which the antistatic layer 124*h* is not provided and the colored layer 124*g* has an antistatic effect by mixing the antistatic agent into the colored layer 124*g*.

When the introducing member 124*b* is attached to the bottom constitution member 124*a*, the introduced area 124*e* is formed on the upper side of the first rotating roller 114 and the second rotating roller 116 as shown in FIG. 11 and the like. As indicated by a dotted line in FIG. 14(*b*), the introducing member 124*b* is formed so that an inner circumferential surface thereof is inscribed with a vertical plane passing through the axial center of the first rotating roller 114 and a vertical plane passing through the axial center of the second rotating roller 116. This makes it possible to prevent the medicines introduced into the introduced area 124*e* from leaking out of the introducing member 124*b* along with the rotation of the first rotating roller 114 and the second rotating roller 116.

The reflecting member 124*c* is constituted of a plate-like body having gloss. As shown in FIG. 10(*a*) and the like, the reflecting member 124*c* is a member having a conical inner surface whose opening area gradually decreases as it gets toward the lower side (the side of the introducing member 124*b*). An inner circumferential surface of the reflecting member 124*c* has a slope inclined with about 45 to 60 degrees. This makes it possible to reflect light toward the introducing member 124*b* and introduce the reflected light into the introducing member 124*b* (the introduced area 124*e*).

Figure 18:
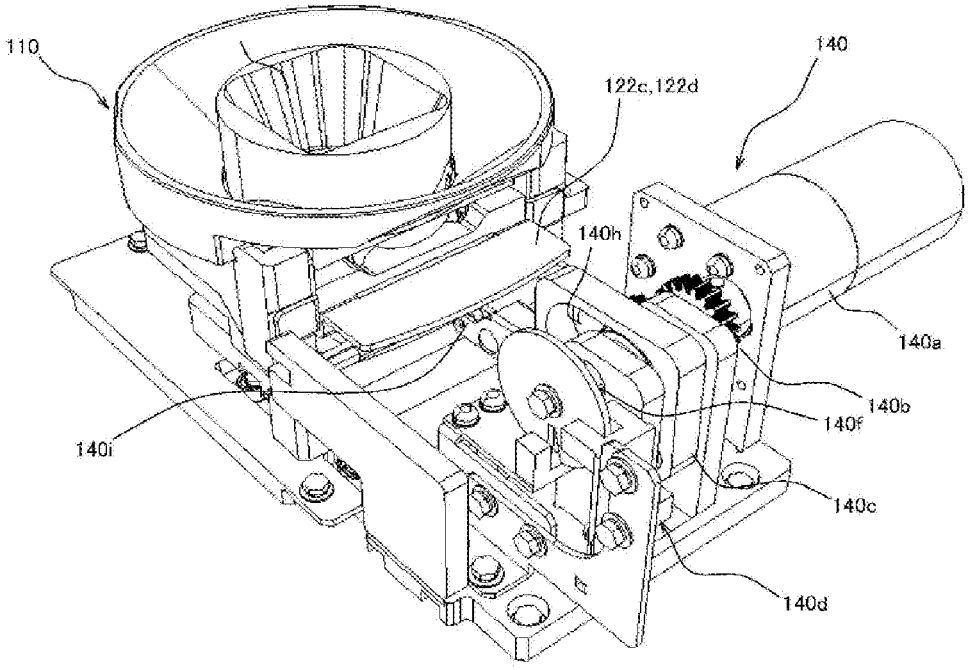
FIG. 18 is a perspective view showing the medicine rolling and moving device shown in FIG. 10 and an opening-closing mechanism.
Figure 19:
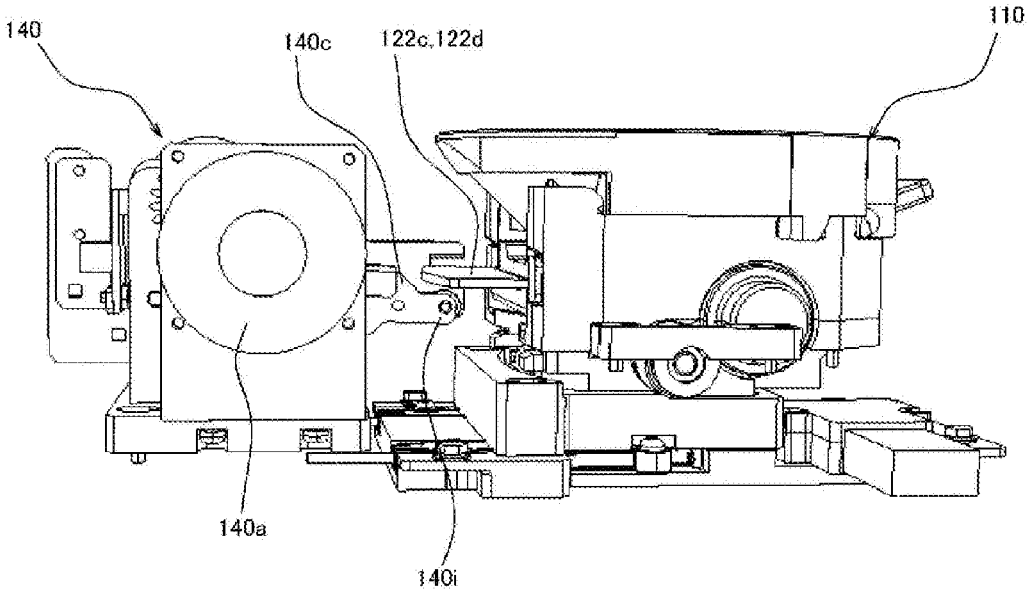
FIG. 19 is a side view showing the medicine rolling and moving device shown in FIG. 10 and the opening-closing mechanism.

As shown in FIG. 9, the opening-closing mechanism 140 is provided at a position adjacent to the outer side of the axial direction of the above-described rolling and moving portion rotating body 103. The opening-closing mechanism 140 is used for performing an operation for expanding the clearance between the first rotating roller 114 and the second rotating roller 116 by lifting up the operating piece 122*c* of the rolling and moving unit 110 reaching to a position adjacent thereto along with the rotation of the rolling and moving portion rotating body 103. As shown in FIG. 9, FIG. 18 and FIG. 19, the opening-closing mechanism 140 includes an opening-closing driving source 140*a*, a driving force transmission portion 140*b*, a working piece 140*c* and a rotational amount detecting portion 140*d*.

The opening-closing driving source 140*a* is a portion for providing driving force in the opening-closing mechanism 140. Although the opening-closing driving source 140*a* may be constituted of any members, the opening-closing driving source 140*a* is constituted of a motor in this embodiment. The driving force transmission portion 140*b* is a portion for transmitting the driving force from the opening-closing driving source 140*a* to the working piece 140*c*.

Figure 20:
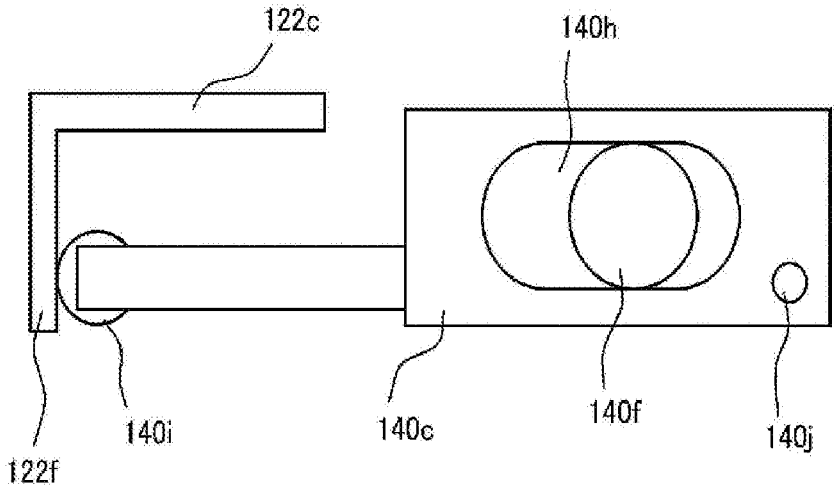
FIG. 20 is an explanation view showing a relationship between a working piece and an operating piece.

The working piece 140*c* is a piece-like portion which is actuated by the driving force received from the opening-closing driving source 140*a* through the driving force transmission portion 140*b*. As shown in FIG. 18 and FIG. 20, the working piece 140*c* is configured to have an insertion hole 140*h* for inserting a working axis 140*f* into a base end side of the working piece 140*c* in a lengthwise direction thereof and have a contacting portion 140*i* contacting with the operating piece 122*c* at a tip end side thereof. The working piece 140*c* is arranged so that the contacting portion 140*i* is directed toward the side of the rolling and working rotating body 103. The insertion hole 140*h* has an oval opening shape elongated in the lengthwise direction of the working piece 140*c*. The working axis 140*f* can be pivotally rotated in the insertion hole 140*h*. Further, the working piece 140*c* is rotatably supported by a support axis 140*j* provided at a position away from the insertion hole 140*h* and in substantially parallel with the working axis 140*f*. By taking such a configuration, by only rotating the rotational axis of the opening-closing driving source 140*a* in a predetermined direction (a positive direction), it is possible to move the operating piece 122*c* up and down and open and close the clearance between the first rotating roller 114 and the second rotating roller 116. Further, it is possible to push a vertical wall 122*f* of the operating piece 122*c* with the contacting portion 140*i* provided at the tip end of the working piece 140*c* (in this embodiment, this is a roller) at the time of lowering the operating piece 122*c* in order to close the clearance between the first rotating roller 114 and the second rotating roller 116.

The rotational amount detecting portion 140*d* is used for detecting a rotational amount of the rotational axis of the opening-closing driving source 140*a*. Although the rotational amount detecting portion 140*d* may be constituted of any member, the rotational amount detecting portion 140*d* is constituted of a rotary encoder in this embodiment.

The medicine photographing device 104 is used for photographing the medicines rolled and moved by the rolling and moving unit 110. Although the medicine photographing device 104 may be any device as long as it can photograph the medicines, the medicine photographing device 104 is configured to include a plurality of camera units 104*a*, 104*b* (the number of the camera units is two in the illustrated example) in this embodiment. As described above, the medicine photographing device 104 is attached to the attachment body 105 arranged on the upper side of the rolling and moving portion rotating body 103. The medicine photographing device 104 is provided at a position deviated from the position where the opening-closing mechanism 140 is arranged toward the upper stream side of the positive rotational direction of the rolling and moving portion rotating body 103 (this is the clockwise direction in the illustrated example). In this embodiment, in a state that the rolling and moving unit 110 remains at the position adjacent to the opening-closing mechanism 140, the camera units 104*a*, 104*b* are respectively arranged at positions (hereinafter, sometimes referred to as "photographing positions") corresponding to positions where the two rolling and moving units 110, 110 adjacent to the upper stream side of the positive rotational direction of the rolling and moving portion rotating body 103 are arranged.

Figure 21:
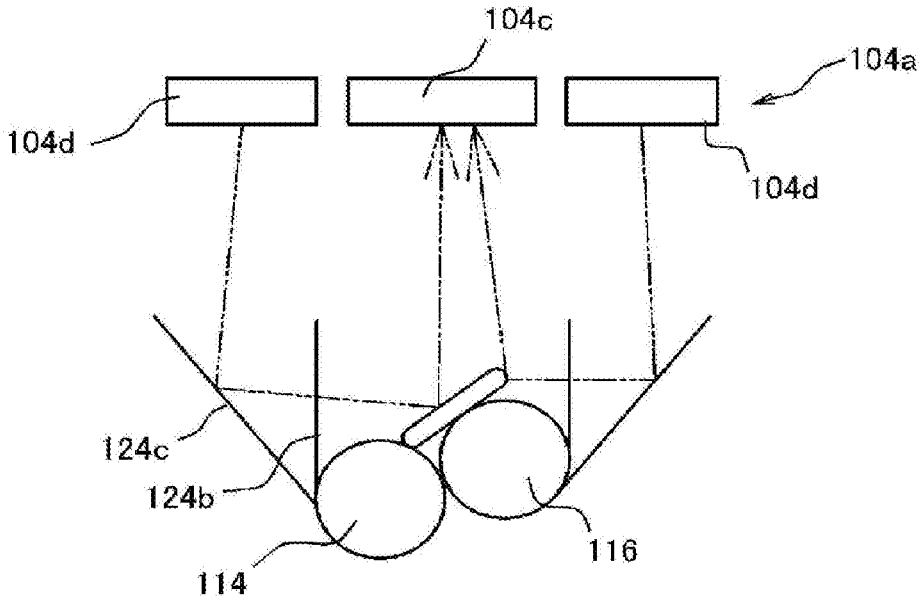
FIG. 21(*a*) is an explanation view showing a camera unit used for photographing the medicines to which identification information is attached with an engraved mark mainly and FIG. 21(*b*) is an explanation view showing a structure of the camera unit used for photographing the medicines to which the identification information is attached with printing mainly.
Figure 21:
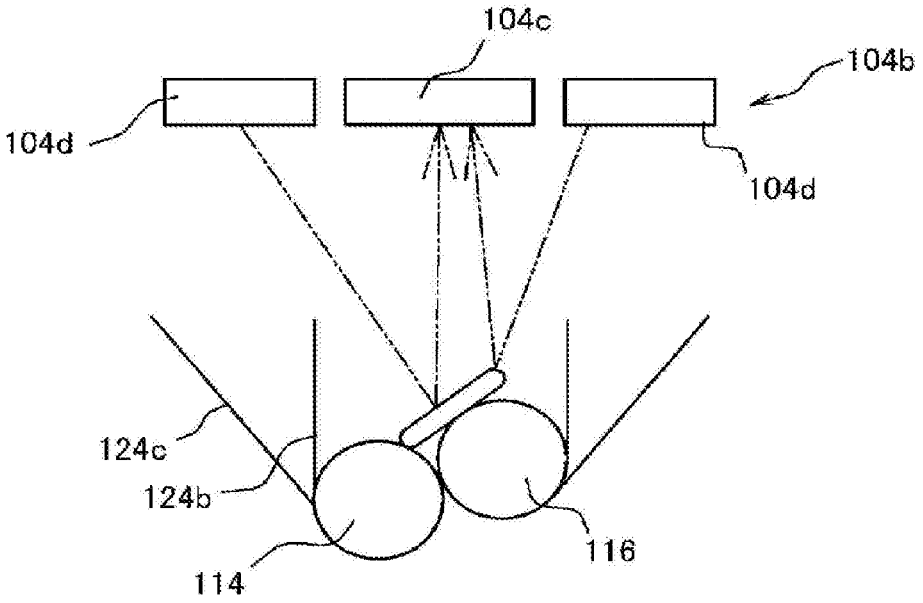

Although the camera units 104*a*, 104*b* are common in a point of including a camera 104*c* and a light source 104*d*, there is differences between them in the kind of the medicine to be photographed and a photographing method. Specifically, the medicine has two kinds containing one kind that the identification information is mainly attached with the engraved mark and another kind that the identification information is mainly attached with the print. The camera unit 104*a* is used for photographing the medicine to which the identification information is mainly attached with the engraved mark and the camera unit 104*b* is used for photographing the medicine to which the identification information is mainly attached with the print. As shown in FIG. 21(*a*), in the camera unit 104*a*, light emitted from the light source 104*d* is reflected on the reflecting member 124*c* and introduced into the introduced area 124*e* through the introducing member 124*b*. This makes it possible to photograph the medicine with the camera 104*c* with illuminating the medicine being rotating on the first rotating roller 114 and the second rotating roller 116 with the light from a lateral direction (a direction crossing a direction from the camera 104*c* toward the medicine). On the other hand, as shown in FIG. 21(*b*), in the camera unit 104*b*, light is directly illuminated to the medicine existing in the introducing member 124*b* (the introduced area 124*e*). With this configuration, the medicine is photographed with the camera 104*c* with illuminating the medicine being rotating on the first rotating roller 114 and the second rotating roller 116 with the light in a direction from the camera 104*c* toward the medicine.

Further, trays 142 are respectively provided at positions on the lower side of the rolling and moving portion rotating body 103 and corresponding to the above-described photographing positions. The trays 142 are used for receiving powder or the like generated by rotating the medicine in the rolling and moving unit 110.

The packaging portion 150 is provided on the lower side of the above-described pre-packaging photographing portion 100. The packaging portion 150 includes a printing unit 152 for subjecting the packaging paper to printing and a package unit 154 for packaging the medicines with the packaging paper. The printing unit 152 includes a roll 156 around which the packaging paper which is two-folded is wound and a printer 158 for printing a name of the medicine, a dosage method or the like onto the surface of the packaging paper unwound from the roll 156 based on the inputted prescription data. The remaining amount of the packaging paper wound around the roll 156 is detected by a remaining amount detecting sensor 160 and a remaining amount signal is transmitted to the control part 200. Further, a paper stock-out sensor 162 is provided in the middle of the carrying path for the packaging paper unwound from the roll 156 and a stock-out signal is transmitted to the control part 200 at the time of detecting that the packaging paper becomes lack of stock.

The packaging unit 154 is used for applying heat to the packaging paper with heater rollers 164 (heating portions) to seal the packaging paper in order to form a packaging bag from the packaging paper. The packaging unit 154 includes the heater rollers 164 respectively arranged on both sides of the packaging paper carried from the diagonal upper direction toward the diagonal lower direction. The heater rollers 164 can rotate to carry the packaging paper and package the medicines for one package. A hopper 166 for supplying the medicines dispensed from the side of the pre-packaging photographing portion 100 for packaging the medicines is arranged on an upper stream side of the heater rollers 164 with respect to the carrying direction of the packaging paper. A tip end portion of the hopper 166 is inserted between the two-folded packaging paper in the middle of the carrying path due to the packaging unit 154. Further, a cutter 168 is provided on a downstream side of the heater rollers 164 with respect to the carrying direction of the packaging paper and thus it is possible to cut the packaging paper by desired packaging numbers. Furthermore, a carrying device 170 for carrying the cut packaging paper to a taken position is provided on a downstream side of the cutter 168 with respect to the carrying direction of the packaging paper.

In this regard, although the example of the packaging unit 154 in which the heater rollers 164 having the functions of carrying and sealing the packaging paper are provided is described in this embodiment, the present invention is not limited thereto. Namely, it may be possible to take a configuration in which the heater rollers 164 are not provided, the packaging unit 154 is configured to include a pair of heating bodies (heating portions) for heat-sealing the packaging paper by sandwiching the packaging paper from both sides and a carrying roller for carrying the packaging paper and the packaging bag is formed from the packaging paper by using these members.

The control part 200 transmits and receives a signal to and from a server in which a plurality of prescription data are stored. The control part 200 stores commands checked from the server into a buffer and controls the driving of the medicine preparing and dispensing portion 20 according to the commands to dispense the medicines corresponding to the prescription data. At the same time, the control part 200 controls the driving of the packaging portion 150. This makes it possible to allow the printing unit 152 to print dosage information or the like related to the medicines to be dispensed onto the packaging paper and drive the packaging unit 154 to package the medicines for every one dose. Further, it is possible to allow a display device such as the touch panel 14*a* to display a result of the inspection for the medicines performed as described later. In this regard, a data table constituted of medicine information (medicine identification information, a medicine name, a medicine code, a dosage method, an effect, a medicine image and the like) is stored in a storage portion of the server in addition to the prescription data. These kinds of information may be stored in a storage portion of the control portion 200.

Each portion 224 of the medicine packaging apparatus 10 is connected to the control portion 200 so that each portion of the medicine packaging apparatus 10 can perform one or both of receiving and transmitting a signal. In this embodiment, the control part 200 is connected so as to receive and transmit a signal from and to the medicine preparing and dispensing portion 20, the individually supplying portion 60, the inspection unit portion 50 and the packaging portion 150.

The control part 200 includes an action control part 210 and is configured to use the action control part 210 to appropriately control an action of each of the medicine preparing and dispensing portion 20, the individually supplying portion 60, the inspection unit portion 50 and the packaging portion 150. In this embodiment, in order to realize distinguishing actions in the medicine packaging apparatus 10, the control part 200 includes an individually supplying control part 220, a reading control part 230 and an inspection processing part 240 in addition to the action control part 210. Hereinafter, each part constituting the action control part 210 will be further described in detail.

The individually supplying control portion 220 is used for controlling an action of the individually supplying portion 60. The individually supplying control part 220 includes a rotating body control part 222, an arrangement deriving part 224, a delivery action control part 226 and an action confirmation control part 228. In this regard, each part constituting the individually supplying control part 220 is not necessarily essential and it may be possible to take a configuration in which some of parts are omitted or any other configurations are added thereto as long as it can perform the action for individually and one by one supplying the medicines to the side of the pre-packaging photographing portion 100 in the individually supplying portion 60.

The rotating body control part 222 is used for controlling an action of the rotating body 68. In order to prepare for the receiving of the medicines from the manually distributing portion 24 to each receiving portion 72, the rotating body control part 222 performs a control for rotating the rotating body 68 so that the receiving portion 72 is arranged at a position suitable for receiving the medicines. Further, in order to prepare for the delivery action (the action for delivering the medicines received from the side of the medicine preparing and dispensing portion 20 to the side of the pre-packaging photographing portion 100 with the delivering device 64), the rotating body control part 222 performs a control for moving the receiving portion into the working area of the delivering device 64. Regarding the control related to the movement of the receiving portion 72, the rotating body control part 222 first rotates the rotating body 68 in the positive direction so that the receiving portion 72 rotates to respectively reach a position over a predetermined position (a discharging port adjacent position) adjacent to the discharging port 74. After that, the rotating body control part 222 performs a control for inversely rotating the rotating body 68 so that the receiving portion 72 returns to the discharging port adjacent position.

The arrangement deriving part 224 is used for deriving an arrangement of the medicines in the receiving portion 72 reaching to the discharging port adjacent position under the control of the rotating body control part 222. The arrangement deriving part 224 allows the receiving photographing portion 94 to photograph the receiving portion 72 with turning on the illuminating portion 96 to illuminate the receiving portion 72 from the lower side after the receiving portion 72 has reached the discharging port adjacent position. The arrangement deriving part 224 analyzes the image date obtained by the receiving photographing portion 94 to find out the locations where the medicines appear as the shadows. Based on this analysis result, the arrangement deriving part 224 derives the arrangement of the medicines in the receiving portion 72.

The delivery action control part 226 is used for performing an execution control for the delivery action performed with using the delivering device 64 and the like. Here, although various execution methods can be considered as the execution control for the delivery action, a method of combining a plurality of actions such as an arm driving action, a suctioning action and a separating action is performed as the execution method for the delivery action in this embodiment. Here, the arm driving action represents an action for driving the delivering arm 84*a* of the delivering device 64, the suctioning action represents an action for allowing the holding portion 86 of the delivering device 64 to suction and hold the medicine and the separating action represents an action for separating the medicine which has been suctioned and held from the holding portion 86. In this regard, the delivery action may be any action as long as it can deliver the medicines to the side of the pre-packaging photographing portion 100 with using the delivering device 64 and it may be also possible to omit some of actions from the delivery action and add other actions to the delivery action.

The delivery action control part 226 is used for performing an execution control for the arm driving action. The delivery action control part 226 moves the delivering arm 84*a* based on the analysis result obtained by the arrangement deriving part 224. This makes it possible to move the delivering arm 84*a* so that the holding portion 86 reaches the position where the medicine is arranged. Further, after the holding portion 86 has held the medicine, it is possible to lift up the medicine to move the medicine to the side of the discharging port 74 by actuating the delivering arm 84*a* with the delivery action control part 226. At this time, the delivery action control part 226 actuates the delivering arm 84*a* with limiting the working range so that the medicine held by the holding portion 86 is moved in an area surrounded by the frame body 78 within a range not exceeding a height of the side wall portion 78*f* of the frame body 78.

The action confirmation control part 228 is used for performing an action confirmation for each portion constituting the individually supplying portion 60. Although the action confirmation control part 228 can be configured to perform various confirmation actions, the action confirmation control part 228 is configured to perform a confirmation action combining an action confirmation for the suctioning device 90 and an attachment confirmation for the frame body 78 before the delivery action is performed in this embodiment. Specifically, the action confirmation control part 228 moves the holding portion 86 attached to the delivering arm 84*a* to a predetermined pre-suctioning position deviating from the location where the medicine is arranged before the delivery action is performed to allow the contacting portion 88*b* to make contact and actuates the suctioning device 90. In this embodiment, the suctioning device 90 is actuated with allowing the contacting portion 88*b* to contact with the predetermined suctioning position forming portion 78*e* arranged in the frame body 78. The action confirmation control part 228 confirms whether or not a certain level of the suctioning force is provided by such actions. With this configuration, in a case where it is confirmed that the certain level of the suctioning force is provided, the action confirmation control part 228 confirms that the suctioning device 90 is in a normal state and the frame body 78 is correctly attached. On the other hand, in a case where it is not confirmed that the certain level of the suctioning force is provided, the action confirmation control part 228 confirms that one or both of a bad condition of the suctioning device 90 and an attachment failure of the frame body 78 has occurred.

The reading control part 230 is used for performing an action control for the pre-packaging photographing portion 100 to read the identification information attached to the medicine. The reading control part 230 includes a rolling and moving control part 232, a photographing control part 234, a discharging control part 236 and the like. In this regard, each part constituting the reading control part 230 is not necessarily essential and it may be possible to omit some of them and add other configurations as long as it can perform the action for reading the identification information attached to the medicine.

The rolling and moving control part 232 is used for performing an action control for the rolling and moving unit 110 constituting the medicine rolling and moving device 102. The rolling and moving control part 232 performs a rotation control of the rolling and moving portion rotating body 103 to perform a control (a movement control) for moving each rolling and rolling unit 110 to a proper position in sequence. Specifically, each rolling and moving unit 110 is moved to the proper position for receiving the medicines which are the inspection targets and a control for moving the rolling and moving units 110 in which the medicines have been received to the position where the medicine photographing device 104 is provided is performed in sequence at the same time. Further, the rolling and moving control part 232 actuates the first rotating roller 114 and the second rotating roller 116 of the rolling and moving unit 110 reaching the position where the medicine photographing device 104 is provided to perform a control (a rolling and moving control) for rolling and moving the medicine on these rollers 114, 116. The rolling and moving control part 232 rolls and moves the medicines over a substantially entire of a time period when the image of the medicine is photographed by the photographing control part 234 described later.

The photographing control part 234 performs an action control for the medicine photographing device 104 to photograph the image of the medicine rolled and moved along with the actuation of the first rotating roller 114 and the second rotating roller 116. The image data obtained by this control is outputted to the inspection processing part 240 described later and used for performing the inspection process.

The discharging control part 236 is used for performing an action control for the opening-closing mechanism 140 to discharge the medicine whose image has been already photographed under the above-described control of the photographing control part 234 from the rolling and moving unit 110. At the time of discharging the medicine from the rolling and moving unit 110, the discharging control part 236 actuates the opening-closing driving source 140*a* to allow the working piece 140*c* to perform an action for lifting up the operating piece 122*c* of the rolling and moving unit 110. This makes it possible to expand the clearance between the first rotating roller 114 and the second rotating roller 116 in the rolling and moving unit 110 to drop down the medicine between the rollers 114, 116. Due to this control, the medicine is discharged to the side of the packaging portion 150.

The inspection processing part 240 performs a process for obtaining the identification information such as the engraved mark and the print attached to the medicine with using the image data obtained from the photographing control part 234. Further, the inspection processing part 240 identifies the medicine matching with the identification information obtained from a database stored in a server or the like based on the identification information obtained based on the image data. With this configuration, the inspection processing part 240 identifies the medicine information on the medicine which is actually dispensed from the identification information obtained based on the photographed image data of the medicine. Further, based on the prescription data, the medicine information on the medicine to designated to be packaged is identified. The inspection processing part 240 compares the medicine information derived based on the image data with the medicine information derived based on the prescription data. As a result, in a case both of the medicine information match with each other, it is determined that the medicine is appropriately dispensed. On the other hand, in a case where both of the medicine information do not match with each other, it is determined that the dispensing of the medicine is improper. In the case where it is determined that the dispensing of the medicine is proper, there is no problem even if the dispensing of the medicine is continued as it is. On the other hand, in the case where it is confirmed that the dispensing of the medicine is improper, it is preferable to perform an alert action such as an action for displaying a message indicating this error on the display device such as the touch panel 14*a* or emitting an alert sound, for example.

In this regard, it is preferable that the result of the above-described inspection (image inspection) based on the image data is displayed not only in the case of determining that the dispensing is improper but also in the case of determining that the dispensing is proper. Further, at the time of displaying the result of the image inspection, it may be possible to output one or more images obtained by the camera units 104*a*, 104*b* as data for providing supplementation of the inspection result. Specifically, an image of the front surface or the rear surface of the medicine utilized for obtaining the identification information on the medicine may be outputted as data for providing supplementation of the inspection result.

Although an aspect of displaying the result of the image inspection on the displaying device such as the touch panel 14*a* may be any kinds of aspects, it may be possible to take a configuration in which the image data of the medicines is displayed so that the medicines can be distinguished in a package unit (dosage time) packaged in the packaging portion 150, for example. Further, the image data of the medicines displayed in the package unit may be listed according to a predetermined order of the kinds of the medicines. By taking such a configuration, it is possible to easily confirm the inspection result based on the displayed image data. As a result of the inspection, in a case where it is determined that the improper dispensing of the medicine is performed, it is preferable that a message indicating that the error has occurred is informed by changing a color of the image of the medicine displayed on the touch panel 14*a* or displaying the image of the medicine with a blinking state on the touch panel 14*a*.

More specifically, for example, in a case where the inspection is performed for the medicine dispensed according to the prescription data as shown in FIG. 22(*a*), it may be possible to display its inspection result with an image displaying aspect as shown in FIG. 22(*b*). In FIG. 22(*b*), although sections corresponding to one determined to be improper are displayed with diagonal lines for the purpose of illustration, the sections may be displayed with red color in a case where this result is displayed on a screen, for example. When an example is described based on the example shown in FIG. 22(*a*), the prescription data for the noon dosage indicates that two tablets of medicine A (○), one tablet of medicine B (Δ) and one tablet of medicine C (□) should be prescribed, for example. In a case where the prescription data is such one as described above, if the medicines are properly dispensed according to the above-described method of rearranging the image data of the medicines displayed in the package unit with the predetermined order of the kinds of the medicines, an order of "○, ○, Δ, □" is displayed.

Here, with referring to the example of the image displaying aspect indicating the inspection result shown in FIG. 22(*b*), all of the medicines for the noon dosages for the first day to the fifth day are displayed in the order of "○, ○, Δ, □". Thus, it can be understood that each medicine is properly dispensed for each of the noon dosages for the first day to the fifth day. On the other hand, it can be understood that the medicines for the noon dosage for the sixth day are displayed in the order of "○, -, Δ, □" and the mark "-" indicating the error is displayed in the section in which the mark "○" should be displayed. Further, the medicine A which should be packaged for the noon dosage for the sixth day is mixed in the medicines for the noon dosage for the seventh day and the marks "○, ○, Δ, □, ○" are displayed in the sections for the noon dosage for the seventh day. Diagonal lines indicating that this section is improper are attached to both of the mark "-" contained in the sections for the noon dosage for the sixth day and the mark "○" indicating an excess amount of the medicine A contained in the sections for the noon dosage for the seventh day in the figure and these sections are displayed with the red color or the like in the case where the result is displayed on the screen. By displaying the result as described above, it is possible to even more reduce the burden of pharmacists in the inspection work and thus suppressing the inspection failure to a minimum.

In this regard, although the example in which the medicine is displayed with the simplified graphic such as the mark "○" is described in FIG. 22(*b*), it is preferable to take an image display aspect which allows a person who performs the inspection work to even more intuitively understand the result by displaying the image data of the medicine or the like in actuality. Further, it is preferable that another section for the inspection result is provided, the mark "○" is displayed therein in the case where the medicine is proper and a mark "x" is displayed therein in the case where the medicine is improper, for example, to take a display imaging aspect for allowing the person who performs the inspection work to easily understand the result. Further, it may be possible to take a configuration in which an enlarged image of the medicine is pop-up displayed when the image date of the medicine is clicked on the screen or the like. This makes it possible to even more easily and reliably perform the confirmation for the external view of the medicine and the identification information such as the engraved mark attached to the surface of the medicine.

Subsequently, description will be given to the action of the medicine packaging apparatus 10. In this regard, the inspection process for the medicine performed before the medicines are packaged which is the main distinguishing part of the present invention, will be described in the following description with emphasis.

Figure 23:
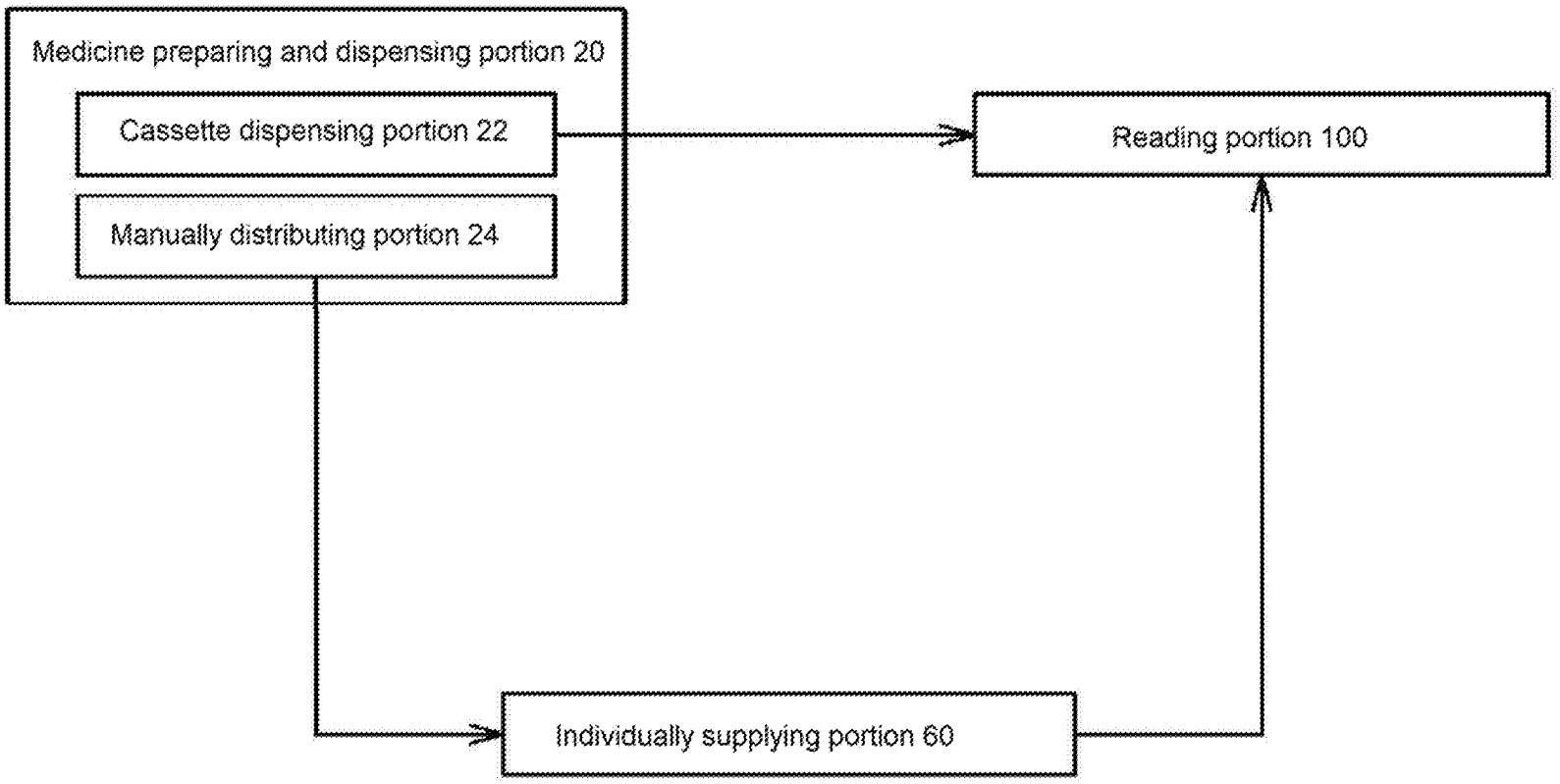
FIG. 23 is an explanation view explaining a passing path for the medicines in the medicine packaging apparatus shown in FIG. 1.

The medicines dispensed from the medicine preparing and dispensing portion 20 according to the prescription data reach the pre-packaging photographing portion 100 through a path as shown in FIG. 23. Specifically, the medicines dispensed from the manually distributing portion 24 in the medicine preparing and dispensing portion 20 reach the pre-packaging photographing portion 100 through the individually supplying portion 60. In contrast, the medicines dispensed from the cassette dispensing portion 22 directly reach the pre-packaging photographing portion 100 with bypassing the individually supplying portion 60.

More specifically, the medicines dispensed from the manually distributing portion 24 are introduced into the receiving portions 72 of the individually supplying portion 60. In the individually supplying portion 60, the rotating body 68 is rotated and the medicines dispensed from the manually distributing portion 24 for one box are introduced into each of the empty receiving portions 72 in sequence. When the receiving portion 72 in which the medicines have been supplied reaches the position adjacent to the discharging port 74 along with the rotation of the rotating body 68, the action (the delivery action) for individually and one by one delivering the medicines from the receiving portion 72 toward the discharging port 74 is performed by the delivering device 64.

Even more specifically, the medicines dispensed from the manually distributing portion 24 are supplied into an area eccentrically located on the side of the rotational center of the rotating body 68 in the receiving portion 72 of the individually supplying portion 60. After that, at the time when the rotating body 68 is rotated and the receiving portion 72 in which the medicines have been supplied reaches the position adjacent to the discharging port 74, the rotating body is rotated in the positive direction so that the receiving portion 72 is first moved to a position over a predetermined position (a discharging port adjacent position) adjacent to the discharging port 74 under the control of the rotating body control part 222. After that, the rotating body 68 is rotated in the inverted direction so that the receiving portion 72 returns to the discharging port adjacent position. By performing such an action, the medicines in the receiving portion 72 are separated from the inner circumferential surface 72*d* of the receiving tube 72*c*. Further, since the cross-sectional shape of the receiving portion 72 is non-circular (in this embodiment, the cross-sectional shape is the substantially polygonal shape), the medicines are soon stopped after the medicines are dispersed in the receiving portion 72.

When the receiving portion 72 reaches the discharging port adjacent position as described above, the arrangement of the medicines in the receiving portion 72 is found out under the control of the arrangement deriving part 224. Although the method for deriving the arrangement of the medicines may be any method, an analysis process for finding out shadow portions in the image data obtained by photographing the receiving portion 72 by using the receiving photographing portion 94 with illuminating the receiving portion 72 from the lower side by using the illuminating portion 96 is performed to derive the arrangement of the medicines based on positions of the shadows in this embodiment. When the receiving portion 72 returns to the discharging port adjacent position, the medicines are separated from the inner circumferential surface 72*d* of the receiving tube 72*c* as described above. Thus, since shadow images of the medicines appear at positions away from the receiving tube 72*c*, it is possible to accurately identify the positions of the medicines.

When the arrangement of the medicines in the receiving portion 72 reaching the discharging port adjacent position is derived as described above, the delivery action is performed based on this result under the control of the delivery action control part 226 by the delivering device 64 and the like. Although the delivery action may be performed with any method, the delivery action is performed after an action for confirming that any cause of action failure does not exist in each portion constituting the individually supplying portion 60 is performed by the action confirmation control part 228 in advance in this embodiment.

Specifically, the delivering arm 84*a* is moved to the pre-suctioning position provided in the frame body 78 under the control of the action confirmation control part 228 to allow the contacting portion 88*b* to make contact with the pre-suctioning position and actuate the suctioning device 90. With this configuration, it is confirmed that an action failure of the suctioning device 90, an attachment failure of the frame body 78 or the like does not occur. After that, the delivering arm 84*a* is actuated by the delivery action control part 226 and the holding portion 86 of the delivering device 64 is moved to the location where the medicine is arranged in the receiving portion 72. Further, by actuating the suctioning device 90, the medicine is suctioned and held by the holding portion 86.

After that, the holding portion 86 which keeps suctioning and holding the medicine is moved to the side of the discharging port 74 in the frame body 78. When the holding portion 86 reaches the discharging port 74, the delivering arm 84*a* is stopped and the medicine suctioned and held is released from the holding portion 86. At this time, by stopping the suctioning device 90, closing a valve provided in a path from the suctioning device 90 to the holding portion 86 or the like, the suctioning device 90 becomes in a state that the suctioning force is not applied to the medicine. In addition, by actuating the discharging device 92, discharging air onto the medicine being held by the holding portion 86 in the direction opposite to the working direction of the suctioning force and the like to apply the discharging force to the medicine. This makes it possible to reliably release the medicine from the holding portion 86 and discharge the medicine to the side of the discharging port 74. In this regard, although the example in which the discharging device 92 is actuated at the time of releasing the medicine is described in this embodiment, it may be possible to take a configuration in which the discharging device 92 is not provided and the discharging force is not applied or a configuration in which the discharging device 92 is actuated only in a case where the discharging device 92 is considered to be necessary.

By repeating the action for suctioning the medicine in the frame body 78 and releasing the medicine after the medicine has been moved to the side of the discharging port 74 as describe above, it is possible to individually and one by one supply all of the medicines supplied from the manually distributing portion 24 into the frame body 78 to the side of the pre-packaging photographing portion 100 through the discharging port 74. The medicines dispensed through the discharging port are one by one supplied into each medicine rolling and moving device 102 which is in the empty state through the opening 105*a* provided in the attachment body 105 of the pre-packaging photographing portion 100, respectively.

Further, the medicines dispensed from the cassette dispensing portion 22 are transmitted to the side of the pre-packaging photographing portion 100 through a pipe or the like not shown in the drawings. After that, these medicines are one by one supplied into each medicine rolling and moving device 102 which is in the empty state through the hopper 105*b* connected to the attachment body 105.

On the other hand, the action control for the rolling and moving unit 110, the medicine photographing device 104 and the opening-closing mechanism 140 are performed on the side of the pre-packaging photographing portion 100 under the control of the reading control part 230 in order to receive the medicines from the manually distributing portion 24 or the cassette dispensing portion 22. Specifically, in order to allow the medicines to be received in the pre-packaging photographing portion 100, the rolling and moving control part 232 pivotally moves the rolling and moving portion rotating body 112 to reach the empty rolling and moving unit 110 in which the medicines are not supplied to the lower side of the discharging port 74. After that, the rolling and moving portion rotating bodies 112 are rotated in sequence and the rolling and moving unit 110 in which the medicines have been supplied is moved to the position where the medicine photographing device 104 is arranged.

When the rolling and moving unit 110 reaches the position of the medicine photographing device 104 after the medicines have been supplied to the rolling and moving unit 110 as described above, the driving force applying portion 120*a* is actuated based on the control of the rolling and moving control part 232 to perform a control (a rolling and moving control) for rotating the first rotating roller 114 and the second rotating roller 116. Along with this operation, the medicine existing on the rollers 114, 116 is moved to the substantially center portions of the axial lines of the rollers 114, 116 with being rotated. While the medicine is being rotated as described above, the control for actuating the medicine photographing device 104 is performed by the photographing control part 234 to obtain the image date of the medicine being rotating on the rollers 114, 116.

When the image data of the medicine which is the inspection target is obtained as described above, an action for dispensing the medicine from the rolling and moving unit 110 toward the packaging portion 150 is performed under the control of the discharging control part 236. Specifically, the discharging control part 236 actuates the motor constituting the opening-closing driving source 140*a* by a predetermined amount to incline the tip end side of the working piece 140*c* toward the upper side. Along with this action, the working piece 140*c* contacts with the operating portion 122*d* of the operating piece 122*c* provided on the front side of the rolling and moving unit 110 from the lower side and thus the operating piece 122*c* becomes in a state that the operating piece 122*c* is lifted up. This makes it possible to move the second rotating roller 116 in the direction separating away from the first rotating roller 114 and thus expand the clearance between the rollers 114, 116, thereby dispensing the medicine existing on the rollers 114, 116 from the rolling and moving unit 110.

When the dispensing of the medicine finishes as described above, the discharging control part 236 further rotates the motor constituting the opening-closing driving source 140*a*. With this action, the working piece 140*c* inclining toward the upper side returns to a substantially horizontal posture. Along with this movement, the operating portion 122*d* of the operating piece 122*c* also returns to a substantially horizontal posture due to its own weight and the fixed portion 122*e* on the side of the first side constitution body 126 becomes in a state that the fixed portion 122*e* is absorbed and fixed with respect to the magnet 126*a* provided on the front side of the first side constitution body 126. With this configuration, the second rotating roller 116 returns to a state close to the first rotating roller 114 and thus the medicine can be arranged on the rollers 114, 116.

When the image data of the medicine which is the inspection target is obtained as described above, the inspection process is performed under the control of the inspection processing part 240 as described above. Namely, whereas the identification information such as the engraved mark on the medicine which is the inspection target is found out from the image date and the medicine information is identified, the identification information on the medicine to be inspected is obtained from the prescription data. Then, these kinds of the identification information are compared with each other and a judge for determining whether or not the medicine is appropriately dispensed according to the prescription data is performed. The judge result is indicated with an appropriate method such as the displaying means such as the touch panel 14*a*, sound, blinking of a lamp or the like.

The medicines whose inspections have finished as described above are discharged into the hopper 166 provided between the inspection unit portion 50 and the packaging portion 150 and stored in the hopper 166 in sequence. Further, the medicines for one dose (one dose unit) are stored and the medicines are dispensed from the hopper 166 toward the packaging portion 150 if the inspection result has no problem. The medicines dispensed to the packaging portion 150 are packaged for every one dose by the packaging unit 154 with the packaging paper on which corresponding dosage information (a name of the medicine, a dosage method or the like) is printed by the printing unit 152. The packaging by the packaging unit 154 may be appropriately performed. For example, the packaging may be automatically performed or a confirmation button is once displayed and the packaging is performed under a condition that the confirmation button is pushed. This makes it possible to reliably supply and package the medicines remaining in the hopper 166 into one bag to which the printing is performed. On the other hand, if a problem occurs as the result of the inspection, a message indicating that an error has occurred may be printed on the corresponding one bag or the printing of the message may be performed on a subsequent packaging paper continuing the one bag if the printing has been performed to the one bag.

In this regard, the medicine packaging apparatus 10 of the present invention may be configured so that the medicines for one dose (in the one dose unit) are stored in the hopper 166 and the medicines are dispensed from the hopper 166 to the packaging portion 150 after the result of the inspection is obtained as described above or may be configured so that the medicines for one dose are not stored in the hopper 166 and the medicines are dispensed toward the packaging portion 150. Further, the packaging portion 150 may be configured to include a blowing portion 300 and a post-packaging information writing portion 320 described later. Namely, the packaging portion 150 may be configured so that the medicines are once packaged without waiting the inspection result for the medicines and then the information on the inspection result is written onto the packaging bag after the medicines have been packaged with using the post-packaging information writing portion 320 described later.

As described above, in the medicine packaging apparatus 10 of this embodiment, the medicines received from the side of the medicine preparing and dispensing portion 20 to the receiving portion 72 by the individually supplying portion 60 are individually held by the delivering device 64 and can be supplied to the side of the pre-packaging photographing portion 100. This makes it possible to accurately read the identification information on the medicines supplied through the individually supplying portion 60 with the pre-packaging photographing portion 100, thereby contributing the improvement of the inspection performance.

Since the medicine packaging apparatus 10 of this embodiment is configured so that the medicines supplied into the manually distributing portion 24 are supplied to the pre-packaging photographing portion 100 through the individually supplying portion 60, it is possible to reliably and one by one supply the medicines to the pre-packaging photographing portion 100 even if the plurality of medicines are dispensed from the manually distributing portion 24 at one time. This makes it possible to reliably and one by one read the identification information of the medicines in the pre-packaging photographing portion 100. On the other hand, the medicines dispensed from the cassette dispensing portion 22 including the medicine cassettes 32 which can individually dispense the medicines stored therein are supplied to the pre-packaging photographing portion 100 with the path bypassing the individually supplying portion 60 and inspected. Thus, in the medicine packaging apparatus 10 of this embodiment, the process in the individually supplying portion 60 can be omitted for the medicines, which are not necessarily separated one by one, such as the medicines dispensed from the medicine cassette 32 and thus it is possible to improve the efficiency and the speed of the inspection process.

In this regard, although the medicines dispensed from the cassette dispensing portion 22 are supplied to the pre-packaging photographing portion 100 through the path bypassing the individually supplying portion 60 in this embodiment, the present invention is not limited thereto and it may be possible to also supply the medicines dispensed from the cassette dispensing portion 22 to the pre-packaging photographing portion 100 through the individually supplying portion 60. Further, although the above-described medicine packaging apparatus 10 is configured to supply all of the medicines dispensed from the manually distributing portion 24 to the pre-packaging photographing portion 100 through the individually supplying portion 60, the present invention is not limited thereto. Specifically, the medicine packaging apparatus 10 may be configured to supply the medicines to the pre-packaging photographing portion 100 through the individually supplying portion in a case where the plurality of medicines are collectively dispensed and may be configured to directly supply the medicines to the pre-packaging photographing portion 100 without passing through the individually supplying portion 60 in a case where the medicine packaging apparatus 10 is used in an operation that the medicines are one by one dispensed from the manually distributing portion 24.

As described above, the medicine packaging apparatus 10 of this embodiment is configured so that the delivering device 64 includes the suctioning device and the medicines can be one by one suctioned and held by the suctioning device 90. Thus, it is possible to reliably, one by one and individually hold and supply the medicines supplied to the individually supplying portion 60 to the side of the pre-packaging photographing portion 100. In this regard, the delivering device 64 is not necessarily configured to individually hold the medicines with using the suctioning force as described above and may be configured to one by one grip the medicines, for example.

Further, in the medicine packaging apparatus 10 of this embodiment, although the example in which the contacting portion 88*b* is provided at the tip end of the absorbing tube

Figure 24:
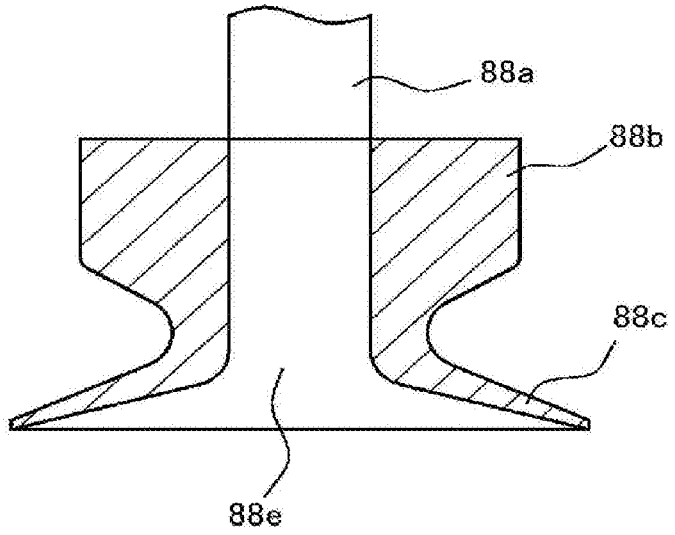
FIG. 24 Each of FIGS. 24(*a*) and 24(*b*) is a cross-sectional view showing one example of a suctioning portion.
Figure 24:
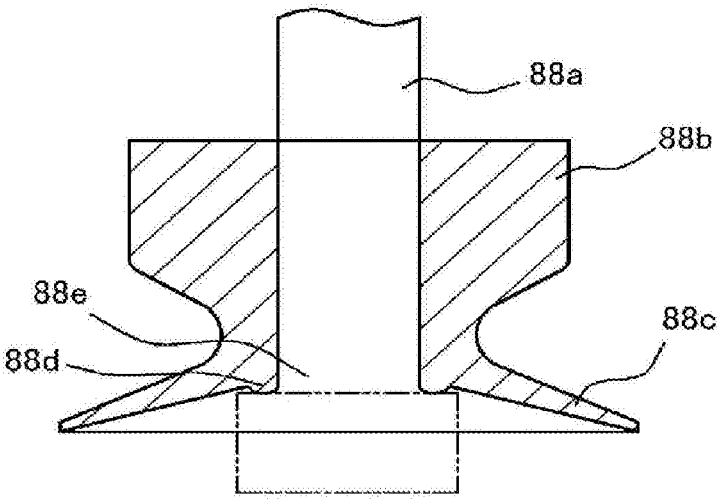

88*a* is described as the absorbing portion used for absorbing the medicines in the delivering device 60, the shape and the like of the contacting portion 88*b* can be appropriately modified. Specifically, although the above-described contacting portion 88*b* may be configured to be constituted of the pad portion 88*c* as shown in FIG. 24(*a*), the contacting portion 88*b* may be configured to further include a protruding portion 88*d* as shown in FIG. 24(*d*), for example. Specifically, the examples in FIGS. 24(*a*), 24(*b*) are common in a point of including the bowl-like pad portion 88*c* having a cross-sectional shape tapered around the inlet port 88*e* provided for taking air therein. In the example shown in FIG. 24(*b*), there is a difference from the example in FIG. 24(*a*) in a point that a protruding portion 88*d* formed so as to protrude inside the pad portion 88*c* along the outer edge of the inlet port 88*e* is provided. Namely, the contacting portion 88*b* in FIG. 24(*b*) is characterized in that the rib-like protruding portion 88*d* formed so as to surround the inlet port 88*e* is provided in the pad portion 88*c*. In a case of taking the configuration as shown in FIG. 24(*b*) as is a case of taking the configuration as shown in FIG. 24(*a*), it is possible to elastically deform the pad portion 88*c* by allowing the pad portion 88*c* to contact with the medicine to reliably absorb the medicine in a case where the medicine whose size is equal to or larger than the outer diameter of the pad portion 88*c*. In the case of taking the configuration as shown FIG. 24(*b*), it is also possible to absorb the medicine whose size is smaller than the outer diameter of the pad portion 88*c* and which is not likely to be absorbed. Specifically, in a case of providing the protruding portion 88*d* as shown in FIG. 24(*b*), it takes a state that the protruding portion 88*d* contacts with the surface of the small medicine and air leak does not occur even if the suctioning of the air is performed through the inlet port 88*e*, thereby providing sufficient suctioning force. Thus, it is also possible to reliably absorb the small medicine by taking the configuration as shown in FIG. 24(*b*).

Further, the medicine packaging apparatus 10 of this embodiment is configured so that the delivering device 64 includes the discharging device 92 in addition to the suctioning device 90 and discharges air at the time of releasing the medicine. By taking such a configuration, it becomes possible to even more reliably release the medicine held by the delivering device 64. In this regard, although the example in which the delivering device 64 includes the discharging device 92 is described in this embodiment, the present invention is not limited thereto and it may be possible to take a configuration in which the delivering device 64 does not include the discharging device 92.

As described above, the medicine packaging apparatus 10 is configured so that the delivering device includes the contacting portion 88*b* contacting with the medicine at the time of the delivery actin and performs the action (the pre-suctioning action) for allowing the contacting portion 88*b* to contact with the pre-absorbing position forming portion 78*e* which is not related to the suctioning for the medicine to apply the suctioning force before the delivery action is performed. By allowing the delivering device 64 to perform such an action, it is possible to perform a pre-check for confirming whether or not the proper suctioning force is caused for holding the medicine in the delivery device 64. Further, by providing the pre-absorbing position 74*e* in the frame body 78, the pre-absorbing action is also utilized for confirming an arrangement status of the frame body 78. With this configuration, it becomes unnecessary to provide a sensor or the like for confirming the attachment status of the frame body 78 and thus it is possible to contribute to simplification of the device structure or action. In this regard, although the example in which the pre-suctioning action is performed is described in this embodiment, the medicine packaging apparatus 10 may be configured not to perform the pre-suctioning action. Further, although the example in which the pre-absorbing position forming portion 78*e* is provided in the frame body 78 is described, other portions may be defined as the pre-absorbing position forming portion 78*e*.

The medicine packaging apparatus 10 of this embodiment is configured so that the medicine is moved from the side of the receiving portion 72 to the side of the discharging port 74 in the area lower than the upper end of the frame body 78 provided so as to surround the receiving portion 72 and the discharging port 74. With this configuration, even if the medicine drops down from the delivering device 64 during the delivery action by any possibility, the dropped medicine remains inside the frame body 78 and it is possible to prevent a failure that the medicine drops down to an unexpected location or the like. In this regard, the example in which the medicine is moved within the range of the height of the frame body 78 to prepare for the drop of the medicine during the delivery action is described in this embodiment, the present invention is not limited thereto. Specifically, it may be possible to take a configuration in which the medicine is moved over the height of the frame body 78 or the frame body 78 itself is not provided. In this regard, even in a case of taking such a configuration, it is preferable to take any way for preparing for the drop of the medicine during the delivery action.

In the medicine packaging apparatus 10, the bottom portion of the receiving portion 72 is formed from the translucent material having the translucency. Further, the arrangement of the medicines in the receiving portion 72 is derived by the arrangement deriving part 224 based on the image data obtained by photographing the receiving portion 72 from the upper side by the receiving photographing portion 94 with illuminating the receiving portion 72 from the lower side by the illuminating portion 96 and the medicines can be held by actuating the delivering device 64. By taking such a configuration, it is possible to precisely find out the arrangement of the medicines supplied to the receiving portion 72 and accurately perform the delivery action due to the delivering device 64. In this regard, the example in which the above-described portion is employed as means for finding out the arrangement of the medicines for delivering the medicines is described in this embodiment, the present invention is not limited thereto and any other replaceable method may be employed.

As described above, the medicine packaging apparatus 10 is configured so that the collectively discharging mechanism 73 is provided at the individually supplying portion 60 and it becomes possible to collectively discharge the medicines in the receiving portion 72. This makes it possible to rapidly discharge the medicines in the receiving portion 72 in a case where the medicines introduced into the receiving portion 72 need to be collected, in a case where the packaging is stopped while the medicines are one by one discharged to the side of the pre-packaging photographing portion 100 or the like. In this regard, the example in which the collectively discharging mechanism 73 is provided at the individually supplying portion 60 is described in this embodiment, it may be possible to take a configuration in which the collectively discharging mechanism 73 is not provided. Further, the collectively discharging mechanism 73 may be any other structure which can be replaced with the above-described structure.

The medicine packaging apparatus 10 of this embodiment is configured so that the plurality of receiving portions 72 are arranged on the rotating body along the circumferential direction thereof and the delivery action for the medicines in the receiving portion 72 arranged in the working area of the delivering device 64 can be performed along with the rotation of the rotating body 68. With this configuration, it is possible to prepare the medicines supplied from the side of the medicine preparing and dispensing portion 20 into the plurality of receiving portions 72 in sequence and moves the rotating body 68 into the working are of the delivering device 64 to perform the delivery action. This makes it possible to efficiently perform the action for individually and one by one supplying the medicines to the side of the pre-packaging photographing portion 100 in the individually supplying portion 60.

In this regard, although the example in which the plurality of receiving portions 72 are provided is described in this embodiment, the present invention is not limited thereto and it may be possible to take a configuration in which a single receiving portion 72 is provided. Further, the example in which the plurality of receiving portions 72 are moved into the working area of the delivering device 64 in sequence by the rotating body 68 is described, the present invention is not limited thereto and it may be possible to take a configuration in which each receiving portion 72 is moved into the working area of the delivering device 64 by moving means other than the rotating body 68. Further, it may be possible to take a configuration in which the plurality of receiving portions 72 are provided and a plurality of delivering devices 64 are also provided to enable the delivery action without moving the receiving portions 72 or a configuration in which the delivering device 64 is configured to be moved with respect to the plurality of receiving portions 72 to relatively move the delivering device 64 and each receiving portion 72 for enabling the delivery action.

The medicine packaging apparatus 10 of this embodiment is configured so that the medicines supplied from the side of the medicine preparing and dispensing portion 20 are supplied to the position on the side of the axial center position of the rotating body 68 in the receiving portion 72. This makes it possible to individually disperse the medicines in the receiving portion 72 along with the rotation of the rotating body 68 and thus it becomes possible to smoothly perform the action for one by one holding and delivering the medicines with the delivering device 64. In this regard, the position for supplying the medicines with respect to the receiving portion 72 is not limited to the above-described position, the medicines may be supplied to any other location.

Further, in the medicine packaging apparatus 10, the rotating body 68 is rotated over the predetermined position where the receiving portion 72 should be arranged at the time of delivering the medicines when the rotating body 68 is rotated to prepare for the delivery action and then the rotating body 68 is reversely rotated so as to return the predetermined position. With this configuration, the medicines are likely to be in the state that the medicines are separated from the wall surface constituting the receiving portion 72 when the receiving portion 72 reaches the above-described predetermined position. Thus, by actuating the rotating body 68 as described above, it is possible to make the action for one by one holding the medicines with the delivering device 64 much easier. In this regard, the medicine packaging apparatus 10 is not necessarily configured to actuate the rotating body 68 as described above.

The medicine packaging apparatus 10 of this embodiment is configured so that the receiving portion 72 has the receiving area 72*b* on the inner side of the inner circumferential surface 72*d* and the cross-sectional shape of the receiving area 72*b* is non-circular (in this embodiment, the cross-sectional shape is substantially polygonal). Namely, a curved portion is provided on the inner circumferential surface 72*d*. With this embodiment, the medicines supplied into the receiving area 72*b* become unlikely to be rotated along the inner circumferential surface 72*d*. Thus, it is possible to suppress the time duration until the medicines are rotated and then stopped after the medicines are received in the receiving portion 72 to a minimum. In this regard, the medicine packaging apparatus 10 is not necessarily configured so that the cross-sectional shape of the receiving area 72*b* is non-circular (in this embodiment, the cross-sectional shape is substantially polygonal) or the inner circumferential surface 72*d* is curved. For example, the medicine packaging apparatus 10 may be configured so that the cross-sectional shape of the receiving area 72*b* is circular.

The medicine packaging apparatus 10 of this embodiment is configured so that the pre-packaging photographing portion 100 can photograph the medicines by the medicine photographing device 104 with rolling and moving the medicines by the medicine rolling and moving device 102 to obtain the identification information attached to the medicines by using its image data with the reading control part 230. Namely, in the medicine packaging apparatus 10, it is possible to read the identification information based on the photographed image without intervening the packaging paper or the like. Further, in the medicine packaging apparatus 10, the medicines can be photographed by the medicine photographing device 104 with rolling and moving the medicines by the medicine rolling and moving device 102. Thus, it is possible to read the identification information without being affected by the postures of the medicines at the time of supplying the medicines to the pre-packaging photographing portion 100. Thus, according to the medicine packaging apparatus 10, it is possible to improve the inspection process accuracy for the medicines.

Further, in the medicine packaging apparatus 10, the first rotating roller 114 and the second rotating roller 116 arranged side by side are included as the medicine rolling and moving device 102 and the first rotating roller 116 and the second rotating roller 116 are rotated in the same direction at the time of reading the identification information. This makes it possible to roll and move the medicine regardless of the size and the shape of the medicine and photograph the image in a state of allowing the identification information to be recognized with the medicine photographing device 104. In this regard, the example in which the first rotating roller 114 and the second rotating roller 116 are used as the medicine rolling and moving device 102 for rolling and moving the medicine is described in this embodiment, the present invention is not limited thereto and it may be possible to take a configuration in which the medicine is rolled and moved by any other configuration.

Further, the medicine packaging apparatus 10 is configured so that the cross-sectional shape of the introduced area 124*e* into which the medicines are introduced is non-circular (in this embodiment, the cross-sectional shape is substantially polygonal) in the medicine rolling and moving device 102. Thus, the medicines supplied into the introduced area 124*e* are not likely to move along the inner circumferential surface of the medicine rolling and moving device 102 and thus it is possible to suppress the time duration while the medicines move along the inner circumferential surface of the medicine rolling and moving device 102 to a minimum. This makes it possible to smoothly start the operation such as the reading process for the identification information. In this regard, the example in which the cross-sectional shape of the introduced area 124*e* is non-circular is described in this embodiment, the present invention is not limited thereto and it may be possible to take a configuration in that the cross-sectional shape of the introduced area 124*e* is modified so as not to provide the curved portion on the inner circumferential surface such as a circular shape, for example.

The above-described medicine packaging apparatus 10 of this embodiment is configured so that the medicine rolling and moving device 102 has the introducing portion 124 and the introduced area 124*e* into which the medicines are supplied is provided inside the introducing portion 124. Further, the introducing portion 124 is configured so that the bottom constitution member 124*a* and the introducing member 124*b* are provided as the constitution bodies and the bottom constitution member 124*a* and the introducing member 124*b* are connected to each other in the vertical direction so that the end surfaces of the bottom constitution member 124*a* and the introducing member 124*b* contact with each other. Further, the end surfaces of the bottom constitution member 124*a* and the introducing member 124*b* have the dark color. This makes it possible to prevent light from entering into the introduced area from the connecting portion between the bottom constitution member 124*a* and the introducing member 124*b*, thereby avoiding the image obtained by the medicine photographing device 104 from being unclear. In this regard, although the example in which the end surfaces constituting the connecting portion between the bottom constitution member 124*a* and the introducing member 124*b* have the dark color to prevent the light from entering into the introduced area 124*e* is described in this embodiment, the present invention is not limited thereto and may be configured to obtain the same effect with any other configuration.

Further, the medicine packaging apparatus 10 is configured so that the first rotating roller 114 and the second rotating roller 116 arranged side by side in the medicine rolling and moving device 102 have the dark color. This makes it possible to clearly distinguish the medicines from the first rotating roller 114 and the second rotating roller 116 in the image obtained by photographing the medicines with the medicine photographing device 104 to read the identification information, thereby contributing to the improvement of the inspection accuracy. In this regard, the example in which the first rotating roller 114 and the second rotating roller 116 have the dark color is described in this embodiment, the present invention is not limited thereto and one or both of the first rotating roller 114 and the second rotating roller 116 may have light color such as white color.

The medicine packaging apparatus 10 of this embodiment is configured so that the members constituting the medicine rolling and moving device 102 have a charging suppressing effect. Thus, even if the medicines are rolled and moved in the medicine rolling and moving device 102, it is possible to reduce the possibility that the medicines and/or the medicine rolling and moving device 102 itself take charge due to the static electricity. This makes it possible to suppress the adverse effect that the medicines adhere to the medicine rolling and moving device 102 or the like due to the static electricity. In this regard, the example in which the constitution members of the medicine rolling and moving device 102 have the charging suppressing effect with considering that the static electricity occurs along with the rolling and moving of the medicines is described in this embodiment, it is not necessary to configure so that the constitution members of the medicine rolling and moving device 102 have the charging suppressing effect in a case where it is possible to reduce the adverse effect of the static electricity with any other configuration, in a case where it is unnecessary to consider the effect of the static electricity or the like.

The medicine packaging apparatus 10 of this embodiment has the movable portion 122 movably supporting the second rotational axis 116*a* of the second rotating roller 116 constituting the medicine rolling and moving device 102 and it is possible to expand the clearance between the first rotating roller 114 and the second rotating roller 166 to discharge the medicines by actuating the opening-closing mechanism 140 to lift up the movable portion 122. Further, by releasing the external force applied to the movable portion 122, the movable portion 122 is lowered by its own weight and thus it is possible to return the first rotating roller 114 and the second rotating roller 116 to the state that the medicine can be arranged on the first rotating roller 114 and the second rotating roller 116. Thus, in the medicine packaging apparatus 10 of this embodiment, a mechanism or the like for returning the movable portion 122 to the original posture after the medicines are dispensed is unnecessary and thus it is possible to simplify the apparatus structure. In this regard, the example in which the movable portion 122 returns to the original posture by its own weight when the external force is released after the medicine are dispensed is described in this embodiment, the present invention is not limited thereto and may be configured so that the movable portion 122 returns to the original posture by using a biasing member such as a spring or the like, for example.

The medicine packaging apparatus 10 of this embodiment can fix the movable portion 122 by using the fixing force due to the magnet with keeping the state that the movable portion 122 is lowered. Thus, when only external force weaker than the fixing force provided by the magnet is applied to the movable portion 122, the medicine rolling and moving device 102 is not actuated and the medicines are not leaked. In this regard, the example in which the movable portion 122 is fixed by the magnetic force is described in this embodiment, the present invention is not limited thereto and may be configured to provide any other fixing device to fix the movable portion 122.

Further, in the medicine packaging apparatus 10, the tray 142 is provided on the lower side of the medicine photographing device 104. Thus, by rotating the medicine at the position where the medicine photographing device 104 is provided to read the identification information, even if the powder of the medicine generates due to the effect of the friction force, it is possible to receive the powder with the tray 142. This makes it possible to suppress the time and effort required for cleaning the vicinity of the medicine photographing device 104 to a minimum.

Although the configuration in which only one medicine is arranged on the first rotating roller 114 and the second rotating roller 116 of the medicine rolling and moving device 102 and the medicine is rotated to read the identification information is described in this embodiment, the present invention is not limited thereto. Specifically, it may be possible to take a configuration in which a process (an integrated process) for rolling and moving the plurality of medicines on the first rotating roller 114 and the second rotating roller 116 at one time and photographing the plurality of medicines with the medicine photographing device 104 is performed to obtain the identification information on the plurality of medicines based on the image data obtained by the integrated process.

In this regard, in order to enable the integrated process, it is preferable that the medicines are not overlapped with each other on the first rotating roller 114 and the second rotating roller 166 and the medicines are supplied to the medicine rolling and moving device 102 in an area that the medicines can be aligned in the axial line direction of these rollers 114, 116. Based on such knowledgement, when a length of a portion which is the longest in the medicine is defined as a medicine length x and a length of a border line between the first rotating roller 114 and the second rotating roller 116 is defined as a border length X, a condition that a sum of the medicine lengths x of the plurality of medicines which are targets of the integrated process is equal to or less than the border length X is set as an execution condition for the integrated process. By performing the integrated document under such an execution condition, the plurality of medicines can rotate in the medicine rolling and moving device 102 without overlapping with each other. This makes it possible to obtain the identification information on the plurality of medicines from the image obtained by the medicine photographing device 104 and thus it is possible to make the operation required for the inspection even more efficient.

Figure 25:
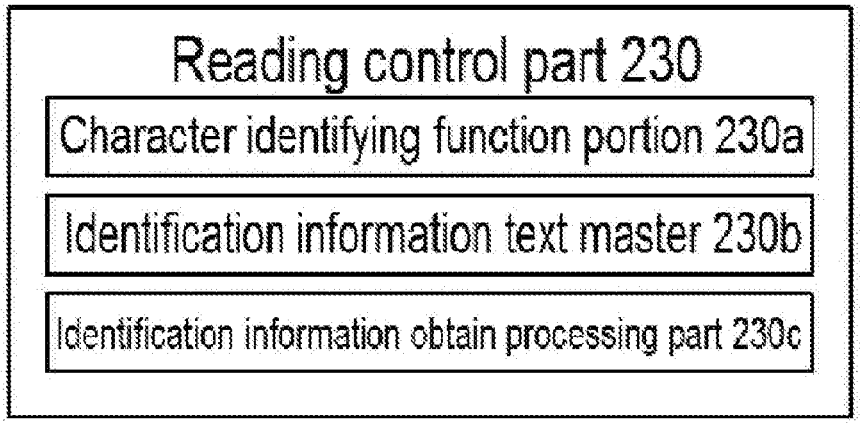
FIG. 25 Each of FIGS. 25(*a*) and 25(*b*) is a block diagram showing one example of a reading control part.
Figure 25:
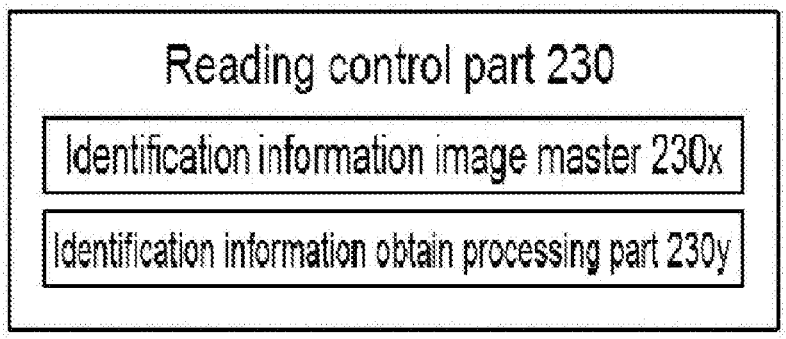

Further, as described above, the reading control part 230 may be any part as long as it can perform the action for reading the identification information attached to the medicine. Specifically, as shown in FIG. 25(*a*), the reading control part 230 may be configured to include a character identifying function part 230*a*, an identification information text master 230*b* and an identification information obtain processing part 230*c*. The character identifying function part 230*a* is configured to optically read a character printed on the medicine and identify the character by collating the optically-read character with predetermined patterns as represented by a so-called OCR process, for example. The identification information text master 230*b* is a database in which the information on the medicine is defined by textual information. The identification information obtain processing part 230*c* can collate the textual information recognized by the character identifying function part 230*a* with the identification information text master 230*b* to perform a process for reading the identification information attached to the medicine. As described above, the reading control part 230 shown in FIG. 25(*a*) is configured to employ the reading method for reading the textual information from the image obtained by photographing the medicine with the character identifying function part 230*a*.

Further, as shown in FIG. 25(*b*), the reading control part 230 may be configured to include an identification information image master 230*x* and an identification information obtain processing part 230*y*. The identification information image master 20*x* is a database in which the information on the medicine is defined by image information. The identification information obtain processing part 230*y* obtains the identification information shown in the image obtained by photographing the medicine without converting the image information and collates the obtained image information with an identification information image master 230*c* to perform a process for obtaining the identification information. As described above, the reading control part 230 shown in FIG. 25(*b*) is configured to employ the reading method for reading the identification information attached to the medicine without converting the image of the identification information contained in the image obtained by photographing the medicine into the textual information.

Although the reading control part 230 may be configured to include one of the above-described configurations shown in FIG. 25(*a*) and FIG. 25(*b*), the reading control part 230 may be configured to include both of them. Even in a case of employing either one of the reading methods, it is possible to accurately read the identification information attached to the medicine. Further, the reading control part 230 may be configured to include both of the configurations shown in FIG. 25(*a*), 25(*b*) and appropriately select which reading method should be employed depending on various conditions. Further, the reading control part 230 may be configured to include both of the configurations shown in FIG. 25(*a*), 25(*b*) and collate two kinds of the identification information obtained with the reading methods with each other to further improve the reading accuracy.

Figure 26:
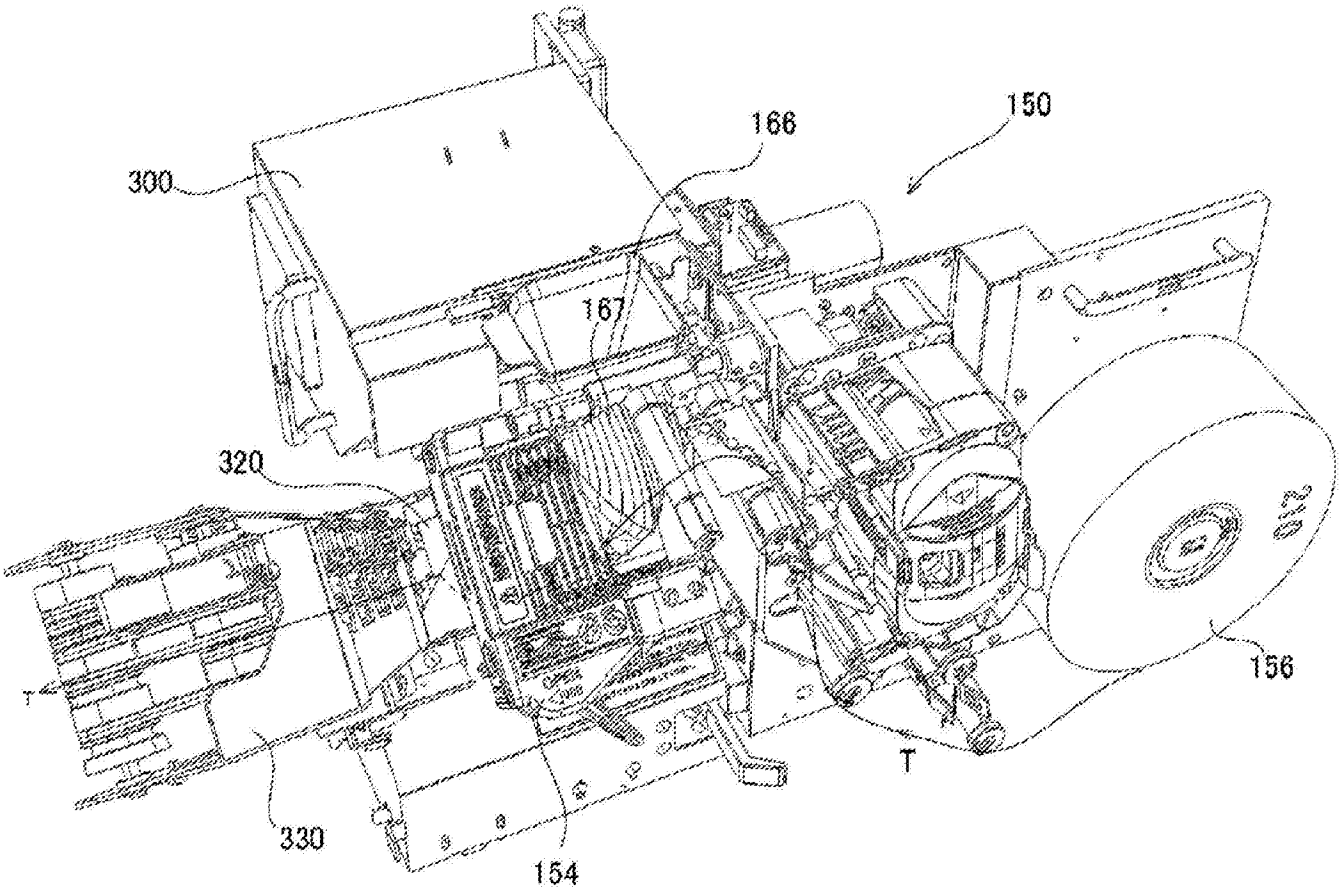
FIG. 26 is a perspective view showing a packaging portion according to a modified example.
Figure 27:
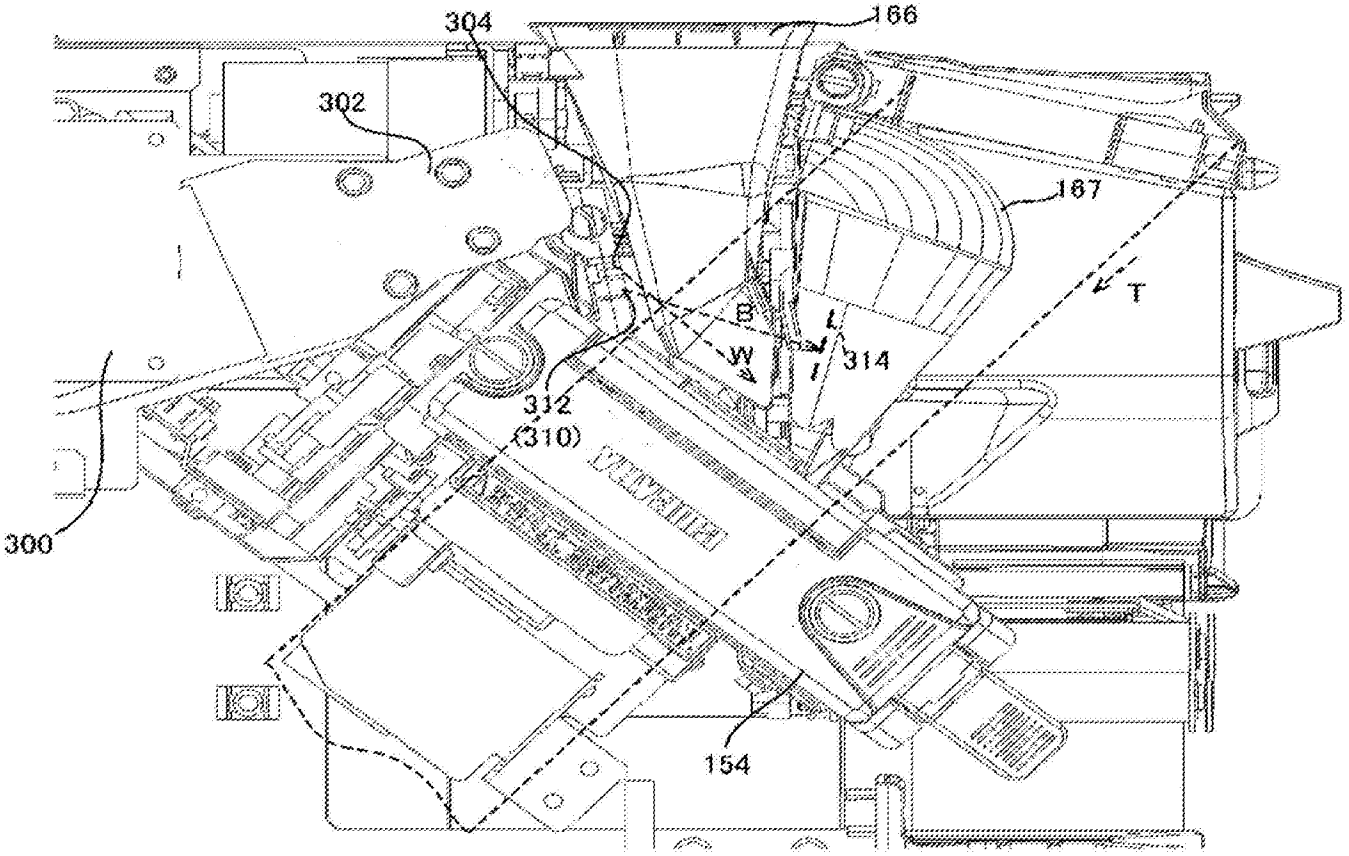
FIG. 27 is an enlarged front view of a main portion of the packaging portion shown in FIG. 26.
Figure 28:
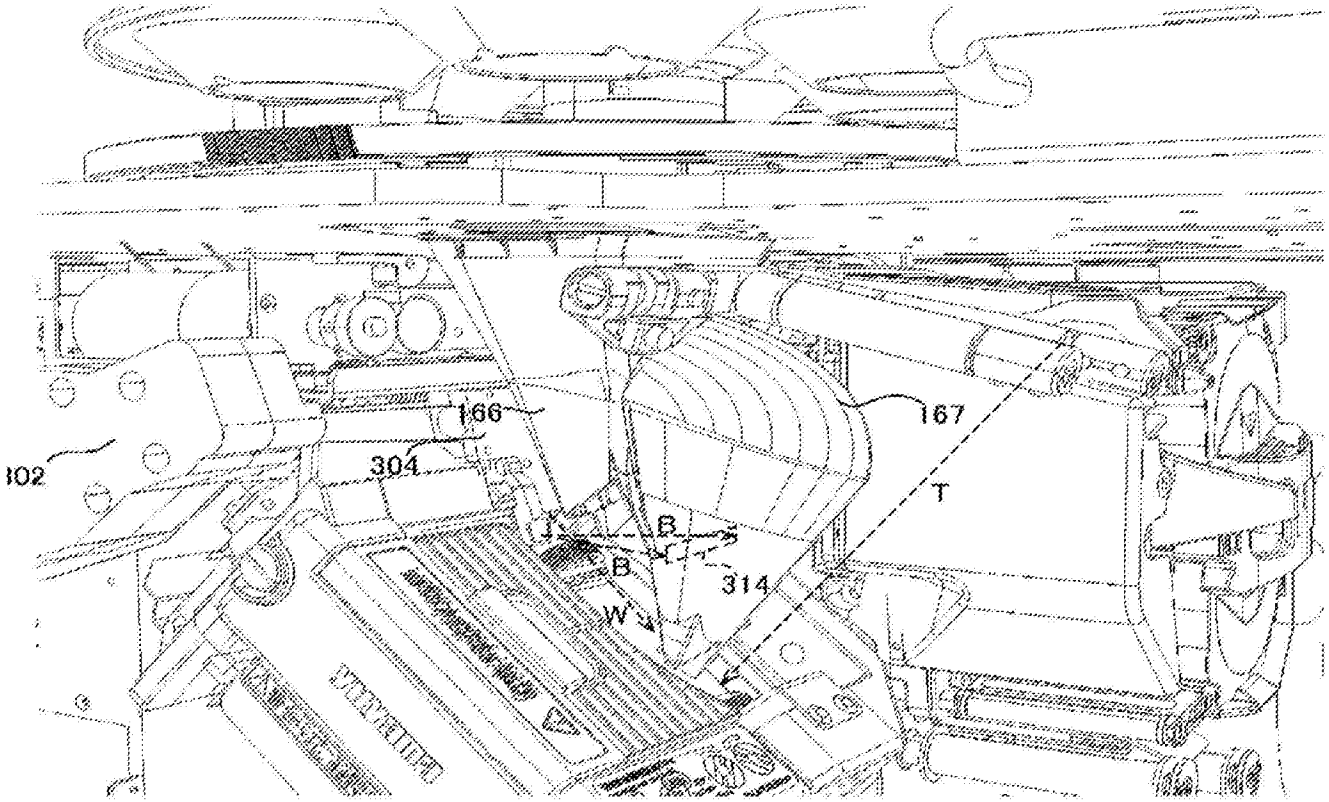
FIG. 28 is an enlarged perspective view of the main portion of the packaging proportion shown in FIG. 26.

Although the example in which the portion including the printing unit 152 (the pre-packaging information writing portion) and the packaging unit 154 is described as the packaging portion 150 in this embodiment, the present invention is not limited thereto and the packaging portion 150 may be configured to further include other configurations as shown in FIG. 26 to FIG. 28 and the like. More specially, the packaging portion 150 shown in FIG. 26 or the like also includes the printing unit 152 (not shown in FIG. 26 to FIG. 28), the packaging unit 154 (a sealing portion) for sealing the packaging paper to package the medicines, the roll 156 (a packaging paper supplying portion) for supplying the packaging paper for packaging the medicines, the hopper 166 (a medicine introducing portion) for introducing the medicines which are the packaging targets into the packaging paper and the like as is the above-described case. Further, the packaging portion 150 shown in FIG. 26 is different from the above-described one in a point that the packaging portion 150 shown in FIG. 26 includes the blowing portion 300, an introduction detecting portion 310, the post-packaging information writing portion 320 and the like.

The blowing portion 300 is used for blowing air into the packaging paper on the upper stream side of the carrying path (illustrated by an arrowed line T in FIG. 27 and FIG. 28) of the packaging paper than the packaging unit 154. The blowing portion 300 is formed by connecting a blowing device 302 and a blowing nozzle 304 with a pipe not shown in the drawings. When the blowing device 302 is actuated, external air can be taken and gas stream can be blown off from the blowing nozzle 304. As shown in an arrowed line W in FIG. 27 and FIG. 28, the blowing nozzle 304 is positioned so as to introduce the gas stream into the packaging paper on the upper stream side of the carrying direction of the packaging paper than the packaging unit 154. Specifically, a width expanding portion 167 is provided on the upper stream side of the packaging unit 154. When the packaging paper supplied in a two-folded state from the roll 156 is unfolded (a width of the packaging paper is expanded) by the width expanding portion 167, the medicines can be introduced into the packaging paper through the hopper 166. The blowing nozzle 304 is positioned so as to blow the gas stream toward the inside of the packaging paper unfolded by the width expanding portion 167.

Although the position from which the gas stream is blown by the blowing nozzle 304 may be any appropriate position, it is preferable that the position is set as follows, for example. Namely, it is preferable that the blowing nozzle 304 is configured so that the blowing nozzle 304 is positioned on the upper stream side of the carrying direction of the packaging paper than the packaging unit 154 and the gas stream is blown toward the downstream side of the carrying direction of the packaging paper than the hopper 166. Alternatively, as another concrete example, it is preferable that the blowing nozzle 304 is configured so that the position of the gas stream to be introduced into the packaging paper by the blowing nozzle 304 is located on the upper stream side of the carrying direction of the packaging paper than the packaging unit 154 and the gas stream is blown toward the downstream side of the carrying direction of the packaging paper than the width expanding portion 167.

Although an opening provided in the blowing nozzle 304 for blowing the gas stream may be arranged at any position, it is preferable that the opening is arranged so as to be located inside the two-folded packaging paper. Namely, it is preferable that the opening of the blowing nozzle 304 for blowing the gas stream is arranged in an area sandwiched by the packaging paper.

The introduction detecting portion 310 is used for detecting the introduction of the medicines from the hopper 166 into the packaging paper on the upper stream side of the carrying direction of the packaging paper than the packaging unit 154. The introduction detecting portion 310 includes a light emitting portion 312 which can emit detection light and a light receiving portion 314 which can receive the detection light. The introduction detecting portion 310 can detect the passing of the medicine on a condition that receiving of the detection light from the light emitting portion 312 at the light receiving portion 314 is stopped or a received amount of the detection light at the light receiving portion 314 decreases during the receiving of the detection light. The light receiving portion 314 is provided on the upper stream side of the carrying direction of the packaging paper than the light emitting portion 312. In this embodiment, the light receiving portion 314 is arranged on the side of the width expanding portion 167. Further, the light emitting portion 312 is arranged at a position facing the light receiving portion 314. In this embodiment, the light emitting portion 312 is provided at the blowing nozzle 304 of the blowing portion 300. Here, the widths of the both ends of the two-folded packaging paper in the width direction thereof are expanded by the width expanding portion 167 in a zone from the width expanding portion 167 to the heater roller 167 and a clearance between the both ends of the packaging paper in the width direction thereof narrows as it approaches the heater roller 164. As shown in an arrowed line B in FIG. 27 and FIG. 28, the light emitting portion 312 is configured to emit the light toward the area inside the packaging paper unfolded by the width expanding portion 167. Further, the light emitting portion 312 is configured to emit the light over the entire of the packaging paper in the direction (the width direction) in which the width expanding portion 167 expands the width of the packaging paper. Further, the light receiving portion 314 is configured to receive the light over the entire of the packaging paper in the width expanding direction (the width direction) of the packaging paper. This makes it possible to make a detecting range of the introduction detecting portion 310 be the whole area in the packaging paper.

A lower end portion of the hopper 166 is positioned on the inner side of the packaging paper whose width is expanded by the width expanding portion 167. Further, the detecting range of the introduction detecting portion 310 is set so as to detect the introduction of the medicines in an area lower than the lower end portion of the hopper 166.

The post-packaging information writing portion 320 is used for writing the information onto the packaging paper in which the medicines have been packaged on the downstream side of the carrying direction of the packaging paper than the packaging unit 154. Whereas the printing unit 152 (the pre-packaging information writing portion) is provided for writing the information onto the packaging paper before the medicines are packaged on the upper stream side than the packaging unit 154, the post-packaging information writing portion 320 is different from the printing unit 152 in a point that the post-packaging information writing portion 320 is provided for writing the information onto the packaging paper after the medicines have been packaged.

Figure 29:
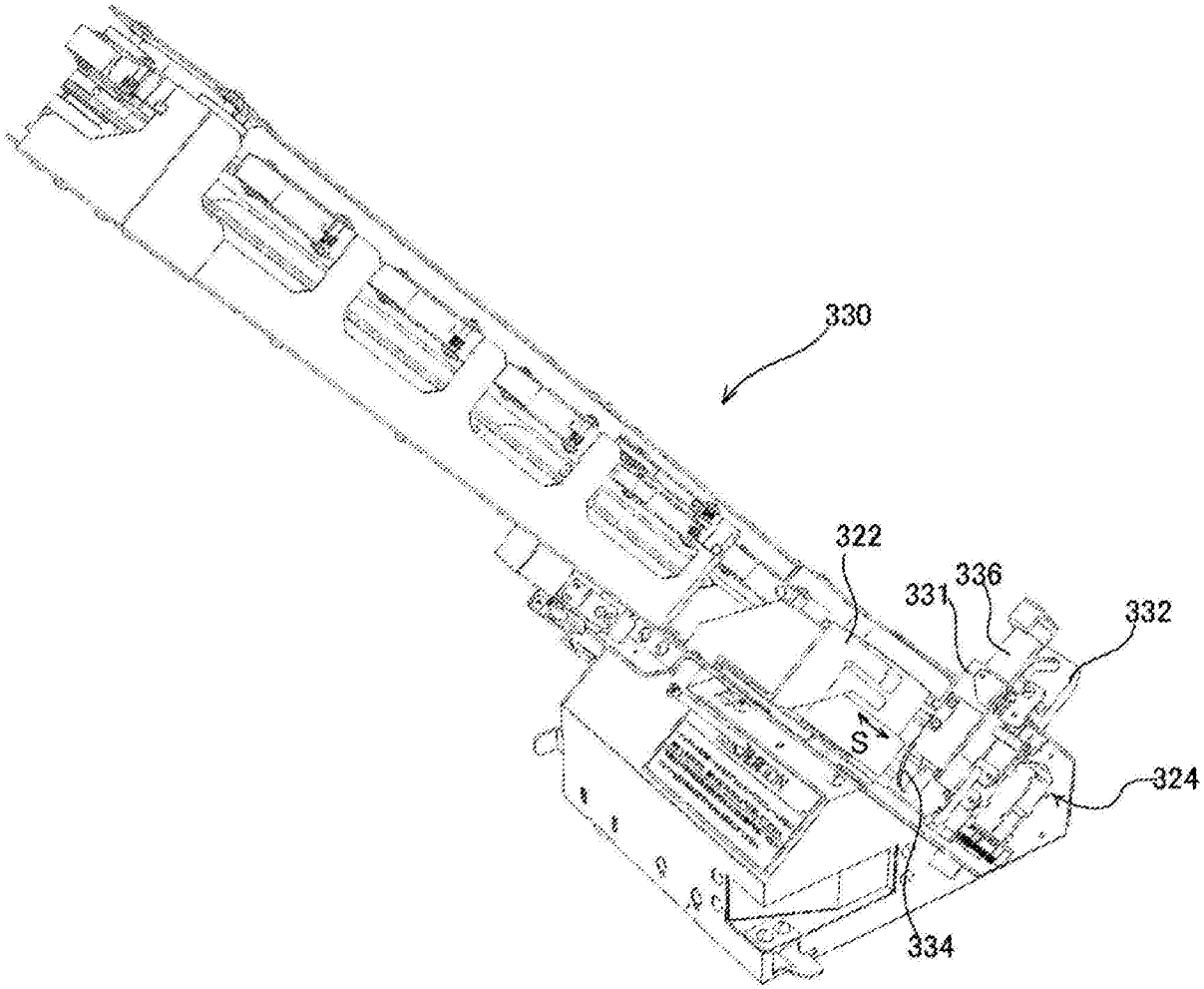
FIG. 29 is a perspective view showing a carrying portion used in the packaging portion shown in FIG. 26.
Figure 30:
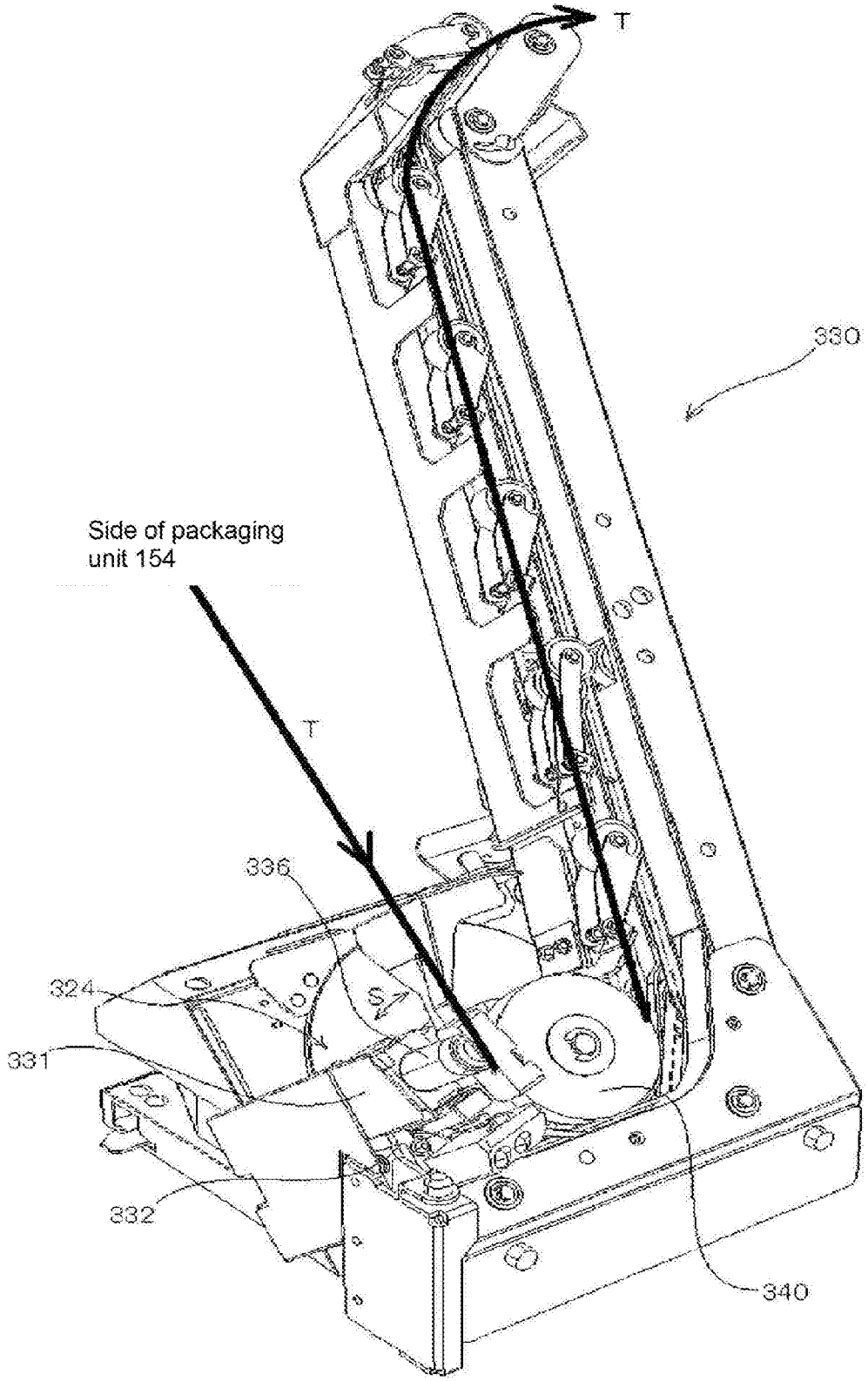
FIG. 30 is a perspective view showing a state that the carrying portion shown in FIG. 29 is seen from another angle.

As shown in FIG. 29 and FIG. 30, the post-packaging information writing portion 320 includes a rear side contacting portion 322 and a writing mechanism 324. The post-packaging information writing portion 320 is provided at a position adjacent to the downstream side of the carrying direction of the packaging paper than the packaging unit 154. For example, the post-packaging information writing portion 320 can be arranged in an area on the downstream side of the carrying direction of the packaging paper than the packaging unit 154 and down to a direction changing portion 340 (see FIG. 30) for changing the carrying direction of the packaging paper carried from the side of the packaging unit 154. In this embodiment, the post-packaging information writing portion 320 is arranged at a portion (a packaging paper carrying portion 330) at which the packaging paper is carried with a posture that the plane of the packaging paper stands in the substantially vertical direction on the downstream side of the carrying direction of the packaging paper than the packaging unit 154. The rear side contacting portion 322 is arranged on one side (in this embodiment, the rear side) of a carrying path T for the packaging paper carried with the posture that the plane of the packaging paper stands in the substantially vertical direction as a border in the packaging paper carrying portion 330. The rear side contacting portion 322 may be any portion such as a metallic plate-like body as long as it can contact with the packaging paper to serve as a base when the information is written onto the packaging paper by the writing mechanism 324.

The writing mechanism 324 is arranged on another side, which is opposite to the rear side contacting portion 322, of the carrying path T of the packaging paper carried with the posture that the plane stands as the boarder. The writing mechanism 324 has a holder 331, an oscillating portion 332 and a front side contacting portion 334. The holder 331 is used for holding a writing member 336 for writing the information onto the packaging paper. In this embodiment, a pen is used as the writing member 336. Thus, the holder 331 is configured to hold the pen by inserting the pen therein.

As indicated by an arrowed line S in FIG. 29 and FIG. 30, the oscillating portion 332 is configured to oscillate the holder 331 in a direction for approaching and separating the holder 331 to and away from the side of the carrying path T (the side of the rear side contacting portion 322). Although the oscillating portion 332 may be any portion as long as it can oscillate the holder 331, it is possible to use a portion including an actuator such as a motor and a cylinder as a driving source as the oscillating portion 332. By actuating the oscillating portion 332, it is possible to contact a pen tip of the pen held by the holder 331 with the packaging paper to write a mark such as a point-like or line-like mark as the information.

The front side contacting portion 334 is a member provided integrally with the holder 331. Thus, by actuating the oscillating portion 332, it is possible to oscillate the front side contacting portion 334 together with the holder 331. The front side contacting portion 334 is formed from an elastic material such as a metal and a resin having elasticity. The front side contacting portion 334 is provided so as to be in a state that the front side contacting portion 334 protrudes toward the side of the carrying path T (the side of the rear side contacting portion 322) more than the holder 331. The front side contacting portion 334 can be constituted of a leaf spring curved or bent into a J-like shape or a U-like shape, for example. Further, the front side contacting portion 334 is provided at a position facing the rear side contacting portion 332. Thus, when the holder 331 is oscillated toward the side of the carrying path T (the side of the rear side contacting portion 322), the front side contacting portion 334 contacts with the packaging paper prior to the pen arranged in the holder 331 and the packaging paper is put between the front side contacting portion 334 and the rear side contacting portion 322 and becomes in a fixed state. When the holder 331 in this state is further oscillated toward the side of the carrying path T, the front side contacting portion 334 is pressed and becomes in a deflected state and then the pen contacts with the packaging paper. This makes it possible to write the information constituted of the point-like or line-like marks onto the surface of the packaging paper.

The tip end of the writing member 336 (the pen) is held by the holder 331 in a state that a cap (not shown in the drawings) is attached to the tip end. When the holder 331 is oscillated in the direction for approaching to the rear side contacting portion 322, the tip end of the pen is removed from the cap and the tip end of the pen contacts with the packaging paper. On the other hand, when the holder 331 is oscillated in the direction for separating away from the side of the rear side contacting portion 322, the tip end of the pen held by the holder 331 is capped again.

Figure 33:
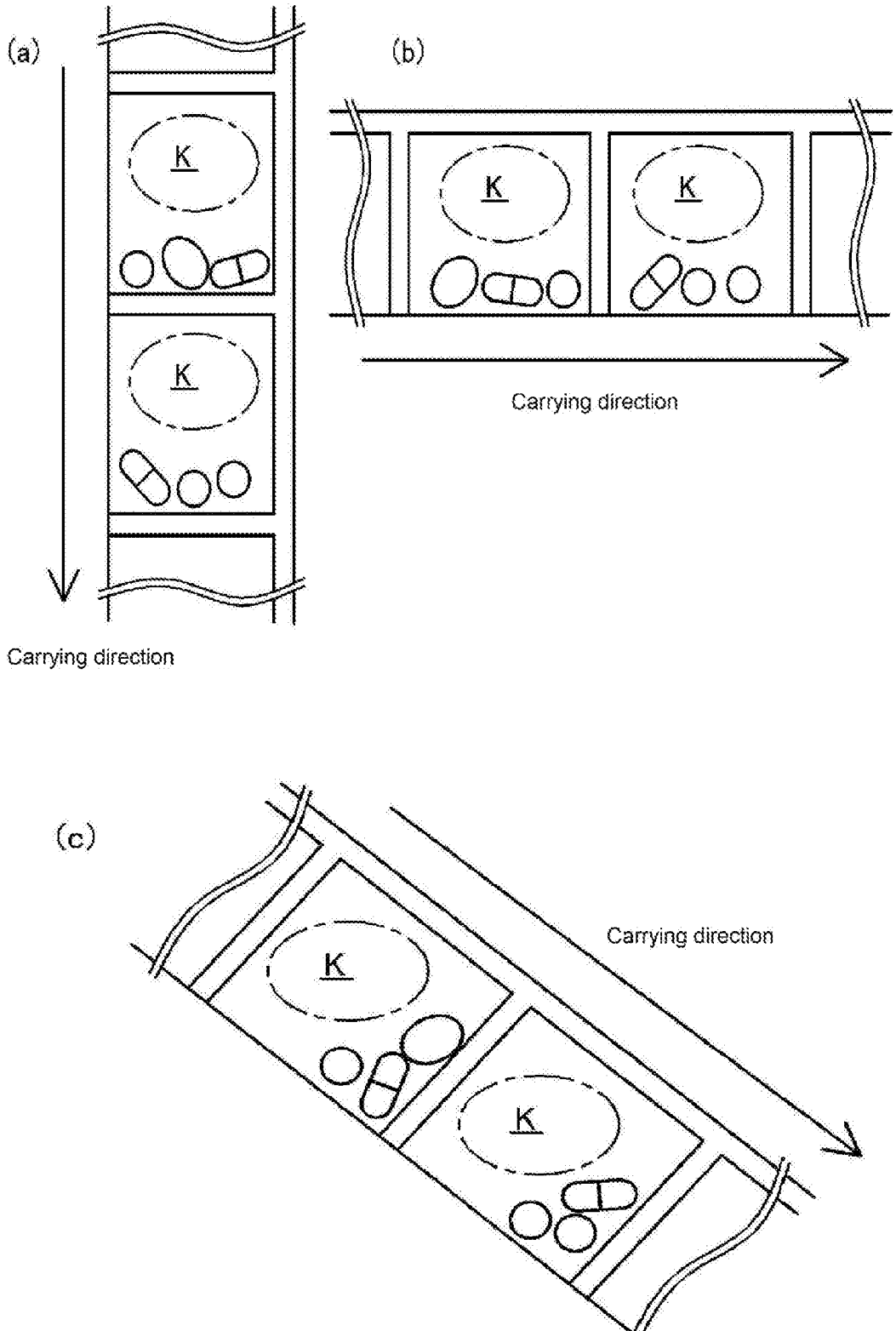
FIG. 33 is a front view showing a posture of the packaging paper in a packaging paper carrying portion.

As described above, the post-packaging information writing portion 320 is arranged in the packaging paper carrying portion 330 and the packaging paper is carried with the posture that the plane of the packaging paper stands in the packaging paper carrying portion 30. With this configuration, the medicines are positioned on the lower side in the packaging bag due to their own weights and an area K in which the medicines do not exist on the upper side in the packaging bag as shown in FIG. 33(*a*). The medicine packaging apparatus 10 is configured so that the front side contacting portion 334 and the writing member 336 contact toward the area K of the packaging paper.

Although the example in which the packaging paper carrying portion 330 allows the packaging paper to be carried with the posture that the plane of the packaging paper stands in the substantially vertical direction is described in this embodiment, the present invention is not limited thereto. Namely, the packaging paper carrying portion 330 may be configured to allow the packaging paper to be carried with a posture that the plane of the packaging paper stands with a certain level inclination.

The packaging paper carrying portion 330 is configured so that the packaging paper is carried in the substantially vertical direction as shown in FIG. 30 and FIG. 33(*a*) in this embodiment. In this regard, the packaging paper carrying portion 330 may be configured so that the packaging paper is carried in the horizontal direction with the posture that the plane of the packaging paper stands or may be configured so that the packaging paper is carried in the diagonal direction as shown in FIG. 33(*c*).

In a case of taking the above-described configuration of the packaging portion 150, it is possible to perform a temperature rising suppressing control and a post-packaging information writing control described later with the control part 200. Hereinafter, the temperature rising suppressing control and the post-packaging information writing control will be described in detail.

<<Regarding the Temperature Rising Suppressing Control>>

Figure 31:
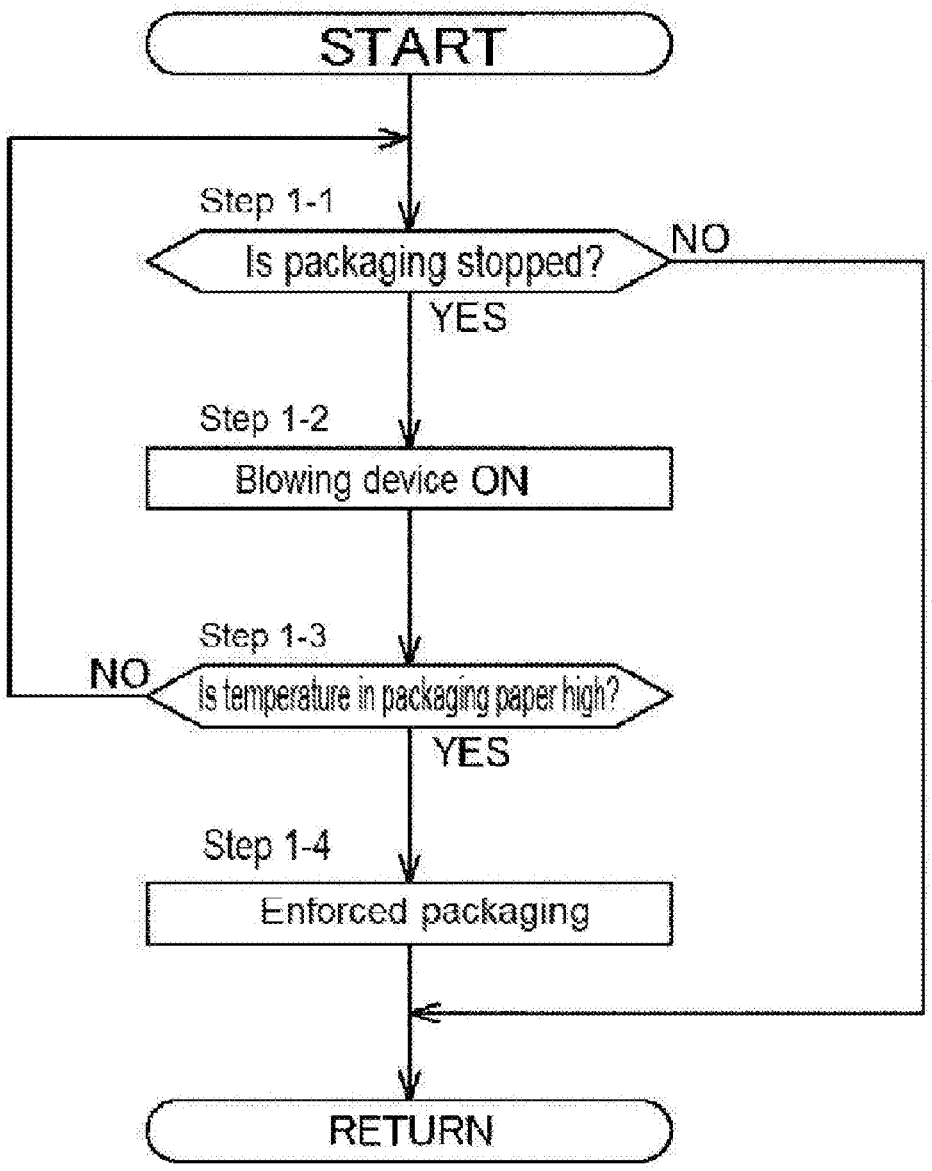
FIG. 31 is a flowchart showing a flow of a temperature rising suppressing control.

The above-described temperature rising suppressing control is a control performed for preventing a temperature in the packaging paper in a medicine introducing waiting state on the upper stream side of the carrying direction of the packaging paper than the sealing portion from being too high at the time of waiting the introduction of the medicines from the medicine introducing portion into the packaging paper. The temperature rising suppressing control actuates the blowing device 302 under a condition that the sealing action (the packaging action) for the packaging paper in the packaging unit 154 is stopped and performs an action control for feeding the packaging paper to the side of the packaging unit 154 by a predetermined amount under a condition that the temperature in the packaging paper exceeds a predetermined temperature condition. Hereinafter, the temperature rising suppressing control will be described in detail according to a flowchart shown in FIG. 31.

(Step 1-1)

In the temperature rising suppressing control, at first, at a step 1-1, it is confirmed by the control part 200 whether or not the packaging operation is stopped. In a case where the packaging action is stopped (step 1-1=YES), the control flow is shifted to a step 1-2. In a case where the packaging operation is continuing (step 1-1=NO), the sequential control flow finishes.

(Step 1-2)

At the step 1-2, the blowing device 302 is turned on by the control part 200. This makes it possible to introduce low-temperature air (in this embodiment, external air) into the packaging paper waiting for the sealing on the upper stream side of the packaging unit 154. After that, the control flow shifts to a step 1-3.

(Step 1-3)

At the step 1-3, it is confirmed whether or not the temperature in the packaging paper waiting for the sealing on the upper stream side of the packaging unit 154 is in a state that the temperature exceeds the predetermined temperature condition. The temperature in the packaging paper can be derived by an appropriate method such as a method of directly measuring the temperature with a temperature sensor not shown in the drawings and a method of indirectly deriving the temperature from a lapsed time until the packaging action is stopped, a temperature outside the packaging paper or an arrangement atmosphere temperature of the medicine packaging apparatus 10. In a case where it is confirmed that the temperature in the packaging paper is in the state that the temperature exceeds the predetermined temperature condition (step 1-3=YES), the control flow shifts to a step 1-4. In a case where the temperature in the packaging paper is in a state that the temperature is equal to or lower than the predetermined temperature condition (step 1-3=NO), the control flow returns to the step 1-1.

(Step 1-4)

At the step 1-4, the packaging paper is fed to the side of the packaging unit 154 by the predetermined amount to perform an action (an enforced sealing action) for sealing the packaging paper. With this action, coming and exiting of air (a gas stream) in the packaging paper occurs and thermal energy is consumed by heat quantity required for the sealing in the packaging unit 154, thereby suppressing the temperature in the packaging paper from being too high.

<<Regarding the Post-Packaging Information Writing Control>>

Figure 32:
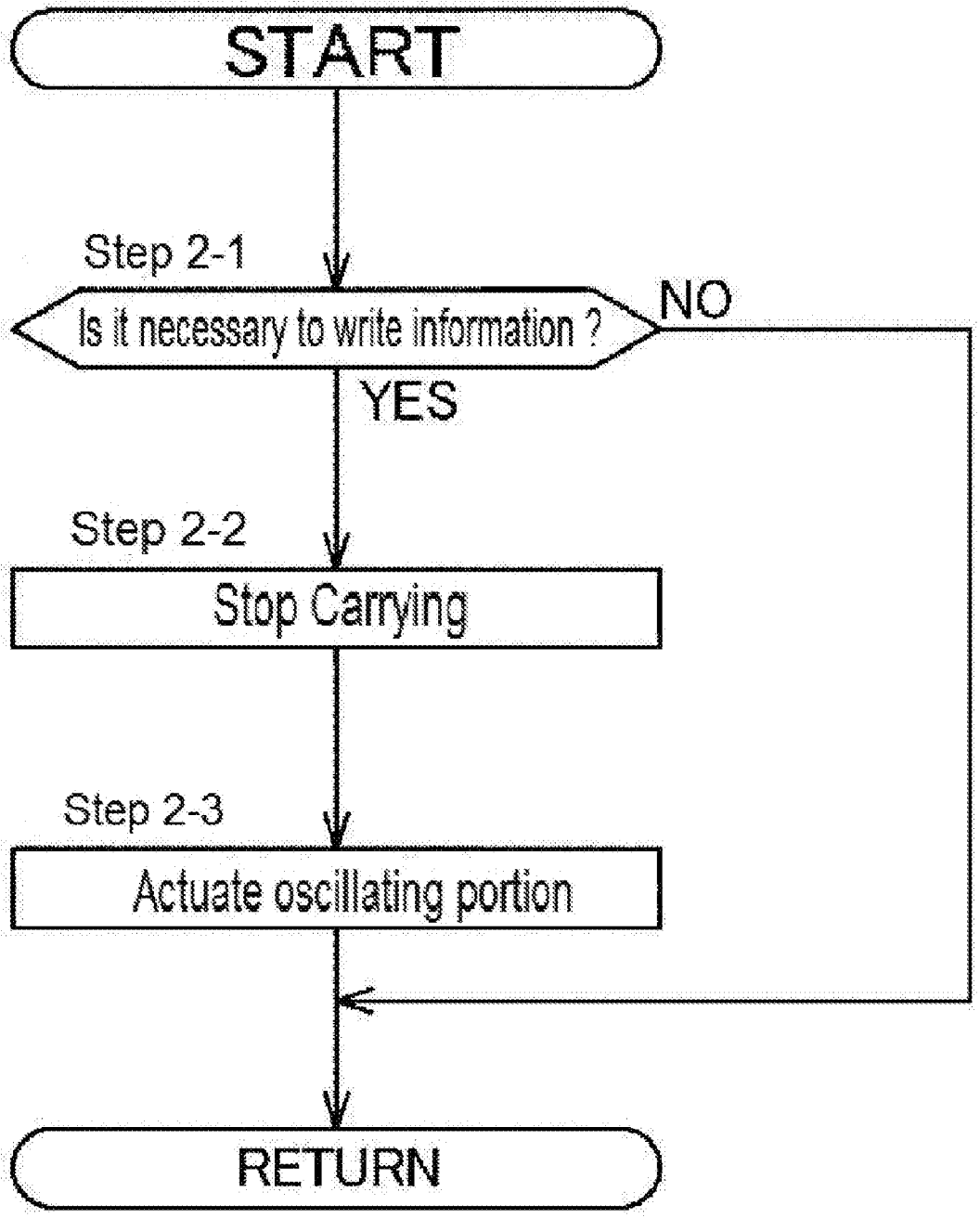
FIG. 32 is a flowchart showing a flow of a post-packaging information writing control.

The above-described post-packaging information writing control is a control for writing the information onto the packaging paper after the medicines have been packaged in the packaging paper with the post-packaging information writing portion 320. Hereinafter, the post-packaging writing control will be described in detail according to a flowchart shown in FIG. 32.

(Step 2-1)

At a step 2-1, it is confirmed whether or not the packaging for the medicines has been finished in the packaging unit 154 and the packaging bag reaching the post-packaging information writing portion 320 is one onto which any information should be written. For example, it is confirmed whether or not the packaging bag in which the medicines which are determined to have problems as a result of the above-described inspection are packaged is one onto which any information such as a mark for distinguishing one from others having no problems should be written. Here, in a case of determining that the packaging bag is the one onto which the information should be written (step 2-1=YES), the control flow shifts to a step 2-2. In a case of determining that the packaging bag is not the one onto which the information should be written (step 2-1=NO), the sequent control flow finishes.

(Step 2-2)

In the case of determining that the packaging bag is the one onto which the information should be written at the above-described step 2-1, the control part 200 performs a control for stopping the carrying of the packaging paper at the step 2-2. At this time, a carrying stop position of the packaging paper is set so that the packaging bag onto which the information should be written reaches between the rear side contacting portion 322 and the front side contacting portion 334 constituting the post-packaging information writing portion 320.

(Step 2-3)

At a step 2-3, the control part 200 actuates the oscillating portion 332. With this control, the front side contacting portion 334 first contacts with the packaging paper and the packaging paper becomes in a state that the packaging paper is put and fixed between the front side contacting portion 334 and the rear side contacting portion 322. After that, when the holder 331 is further oscillated toward the side of the carrying path T, the pen held by the holder 331 contacts with the packaging paper. This makes it possible to write the information constituted of the point-like mark or mark on the line onto the surface of the packaging paper. With this control, the sequent control flow finishes.

As described above, the packaging portion 150 includes the blowing portion 300 and is configured to blow the air into the packaging paper on the upper stream side than the packaging unit 154. Further, if the blowing of the air by the blowing portion 300 is performed under the condition that the introduction of the medicines into the packaging paper from the hopper 166 is waiting, it is possible to reliably prevent the temperature in the packaging paper form rising due to the effect of temperature rising in the packaging unit 154 or the like. Thus, by providing the blowing portion 300, it is possible to suppress the medicines supplied into the packaging paper in order to prepare for the packaging from being adversely affected by heat or the like. In this regard, the example in which the blowing portion 300 is provided is described in the above-described example, the present invention is not limited thereto and may be configured not to include the blowing portion 300.

Further, as described above, by feeding the packaging paper to the side of the packaging unit 154 by the predetermined amount under the condition that the temperature in the packaging paper becomes in the state that the temperature exceeds the predetermined temperature condition on the upper stream side of the carrying direction of the packaging paper than the packaging unit 154 to perform the enforced sealing action, it is possible to obtain the suppressing effect of the temperature rising and thus it is possible to suppress the medicines from being adversely affected by the heat. In this regard, the present invention is not necessarily configured to perform the enforced sealing action.

As described above, by providing the one whose detection range is set in the packaging paper as the introduction detecting portion 310 for detecting the introduction of the medicines into the packaging paper, it is possible to precisely detect whether or not the medicines supplied from the roll 156 are introduced into the packaging paper through the hopper 166. Further, by arranging the light receiving portion 314 of the introduction detecting portion 310 on the side of the width expanding portion 167 and arranging the light emitting portion 312 at the position facing the light receiving portion 314, it is possible to detect the introduction of the medicines into the packaging paper without missing the introduction. Further, since the light emitting portion 312 is provided at the blowing portion 300, it is possible to prevent the light emitting portion 312 from getting dirty by the powder caused from the medicine or the like, thereby preventing the detection accuracy from deteriorating. In this regard, the introduction detecting portion 310 is not an essential configuration in the present invention and it is possible to appropriately omit the introduction detecting portion 310. Further, the introduction detecting portion 310 is not necessarily configured to be the one as described above, it is possible to replace the introduction detecting portion 310 with other sensors or the like.

In a case of configuring the packaging portion 150 as described above, the packaging portion 150 takes a distinguishing configuration in which the information can be written onto the packaging paper on not only the upper stream side of the carrying direction of the packaging paper than the packaging unit 154 but also the downstream side than the packaging unit 154. Specifically, it is possible to not only write the information onto the packaging paper before the medicines are packaged with the printing unit 152 provided on the upper stream side than the packaging unit 154 but also write the information onto the packaging paper with the post-packaging information writing portion 320 provided on the downstream side than the packaging unit 154.

Further, as one operational example in a case of configuring the packaging paper 150 as described above, it is possible to take a configuration in which characters are mainly written onto the packaging paper before the packaging and symbols are mainly written onto the packaging paper after the packaging. Examples of the information written with the characters include contents of the prescription data, a medicine name, a dosage time and a patient name. Examples of the information written with the symbols include an inspection result of the medicine kind, a result of the detection in the introduction detecting portion 310 and the like.

Further, at the position where the packaging paper is carried in the vertical direction after the medicines have been packaged (in this embodiment, the position where the packaging bag is carried in the state that the packaging bag stands in the vertical direction), the medicines are eccentrically located on the lower side in the packaging bag. Since the post-packaging information writing portion 320 is arranged at such a position, it is possible to write the information with the post-packaging information writing portion 320 with targeting the position on the upper side of the packaging bag where the medicines do not exist and the number of undulations is small with the post-packaging information writing portion 320.

Further, the above-described post-packaging information writing portion 320 can allow the packaging paper to be in the packaging paper fixed state that the packaging paper is put between the front side contacting portion 334 and the rear side contacting portion 322 to write the information with the pen or the like in a state that the packaging paper is stabilized in the vicinity of the post-packaging information writing portion 320. Further, in the above-described packaging portion 150, the post-packaging information writing portion 320 is provided at the position adjacent to the downstream side of the carrying direction of the packaging paper than the packaging unit 154. Thus, even if the packaging bag formed by packaging the medicines with the packaging paper has any length, it is possible to appropriately write the information.

In this regard, although the configuration in which the post-packaging information writing portion 320 is provided is described in the above-described example of the packaging portion 150, the present invention is not limited thereto and may be configured not to include the post-packaging information writing portion 320. Further, the configuration of the post-packaging information writing portion 320 is not limited to the above-described configuration. Specifically, it may be possible to take a configuration in which one or both of the front side contacting portion 334 and the rear side contacting portion 322 are not provided or a configuration in which the member held by the holder 331 is replaced with other tools such as a stamp instead of the pen. Further, the arrangement of the post-packaging information writing portion 320 can be appropriately modified. Further, when a packaging error occurs, it is possible not to write a message indicating that the packaging error occurs onto the packaging bag which is cause of the error but writing the message with other methods. Specifically, when one or more of the packaging errors occur in the sequent packaging process, it may be possible to write the message onto any one of the subsequent packaging bags. In this case, although the packaging bag onto which the message indicating that the packaging error occurs should be written may be any one of the packaging bags, it is preferable to write the message onto one which can be easily recognized by a user such as the last one of the packaging bags, for example. With this configuration, the user can understand that the packaging bag at which the packaging error occurs exists in the subsequent packaging paper by seeing the last one of the packaging bags, for example.

Figure 34:
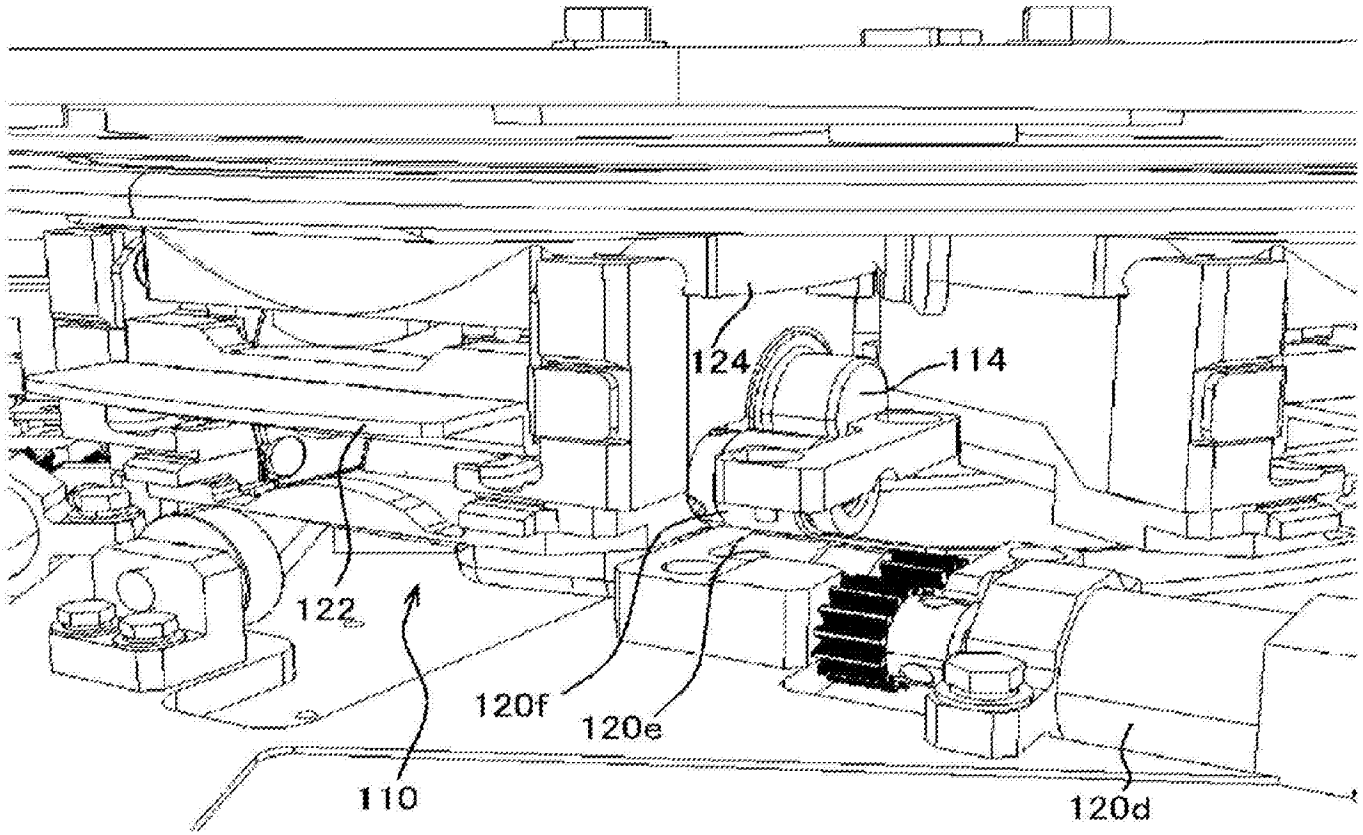
FIG. 34 is a perspective view showing a modified example of a driving mechanism for transmitting driving force to a rolling and moving unit.

Further, although the above-described rolling and moving unit 110 is configured to include the contact type driving mechanism constituted of the driving force applying portion 120*a* and the like, the present invention is not limited thereto and may be configured to include a non-contact type driving mechanism. Specifically, as shown in FIG. 34, a driving source 120*e* whose rotational axis is coupled with a magnet roller 120*d* is provided and a roller 120*f* which can rotate by receiving magnetic force of the magnet roller 120*d* is provided at a position corresponding to the above-described driving force applying portion 120*a*. By taking such a configuration, it is possible to perform driving force transmission to the rolling and moving unit 110 with the non-contact type driving mechanism. This makes it possible to solve problems such as abrasion of each member and occurrence of abrasion powder in a case of employing the contact type driving mechanism.

Although the representative embodiment of the present invention is described up to here, it is possible to perform various design changes within the technical sprit of the present invention described in the claims and these modifications are also contained in the present invention.

INDUSTRIAL APPLICABILITY

The present invention can be appropriately utilized in a general medicine packaging apparatus for packaging medicines.

DESCRIPTION OF REFERENCE SIGNS

10 Medicine packaging apparatus
20 Medicine preparing and dispensing portion
22 Cassette dispensing portion
24 Manually distributing portion
32 Medicine cassette
60 Individually supplying portion
64 Delivering device
68 Rotating body
72 Receiving portion
72*b* Receiving area
72*d* Inner circumferential surface
73 Collectively discharging mechanism
74 Discharging port
78 Frame body
78*e* Pre-absorbing position forming portion
88*b* Contacting portion
90 Suctioning device
92 Discharging device
94 Receiving photographing portion
96 Illuminating portion
100 Pre-packaging photographing portion
102 Medicine rolling and moving device
104 Medicine photographing device
114 First rotating roller
116 Second rotating roller
116*a* Second rotational axis
122 Movable portion
124 Introducing portion
124*e* Introduced area
142 Tray
150 Packaging portion
152 Printing unit (pre-packaging information writing portion)
154 Packaging unit (sealing portion)
156 Roll (packaging paper supplying portion)
164 Heater roller (heating portion)
166 Hopper (medicine introducing portion)
167 Width expanding portion
200 Control part
222 Rotating body control part
224 Arrangement deriving part
226 Delivery action control part
230 Reading control part
240 Inspection processing part
300 Blowing portion
310 Introduction detecting portion
312 Light emitting portion
314 Light receiving portion
320 Post-packaging information writing portion
322 Rear side contacting portion
324 Writing mechanism portion

331 Holder
332 Oscillating portion
334 Front side contacting portion

What is claimed is:

1. A medicine packaging apparatus, comprising:

a medicine preparing and dispensing portion for preparing medicines so that the medicines can be dispensed;

a packaging portion for packaging the medicines dispensed from the medicine preparing and dispensing portion; and a control part, wherein the control part includes:

a sealing portion for forming a packaging bag from a packaging paper supplied for packaging the medicines, a medicine introducing portion for introducing the medicines into the packaging paper on an upper stream side of a carrying direction of the packaging paper than the sealing portion, and an introduction detecting portion for detecting introduction of the medicines from the medicine introducing portion into the packaging paper on the upper stream side of the carrying direction of the packaging paper than the sealing portion, and wherein a detection range of the introduction detecting portion is set in the packaging paper.

2. The medicine packaging apparatus according to claim 1, wherein the pre-packaging photographing portion has a medicine rolling and moving device for rolling and moving the medicines.

3. The medicine packaging apparatus according to claim 2, wherein the medicine rolling and moving device includes a first rotating roller and a second rotating roller arranged side by side, and wherein the medicine rolling and moving device rotates the first rotating roller and the second rotating roller in the same direction at the time of reading the identification information.

4. The medicine packaging apparatus according to claim 2, wherein an introducing portion internally having an introduced area for introducing the medicines is provided at the medicine rolling and moving device, and wherein a cross-sectional shape of the introduced area is non-circular.

5. The medicine packaging apparatus according to claim 2, wherein an introducing portion internally having an introduced area for introducing the medicines is provided at the medicine rolling and moving device, wherein the introducing portion is constituted of a plurality of constitution bodies, wherein the plurality of constitution bodies are connected to each other in the vertical direction so that end surfaces of the plurality of constitution bodies are contacted with each other, and wherein the end surface of each constitution body has dark color.

6. The medicine packaging apparatus according to claim 2, wherein the medicine rolling and moving device includes a first rotating roller and a second rotating roller arranged side by side, wherein the medicine rolling and moving device is configured to rotate the medicines arranged on the first rotating roller and the second rotating roller, and wherein each of the first rotating roller and the second rotating roller has dark color.

7. The medicine packaging apparatus according to claim 2, wherein the medicine rolling and moving device includes a first rotating roller and a second rotating roller arranged side by side, wherein the medicine rolling and moving device is configured to rotate the medicines arranged on the first rotating roller and the second rotating roller, wherein the medicine packaging apparatus can perform an integrated process for photographing a plurality of medicines by using the medicine photographing portion with rotating the plurality of medicines by using the medicine rolling and moving device, and wherein when a length of a portion which is the longest in each medicine is defined as a medicine length x and a length of a border line between the first rotating roller and the second rotating roller is defined as a border length X, a condition that a sum of the medicine lengths x of the plurality of medicines which are targets of the integrated process is equal to or less than the border length X is set as an execution condition for the integrated process.

8. The medicine packaging apparatus according to claim 2, wherein some or all of members constituting the medicine rolling and moving device have a charging suppressing effect.

9. The medicine packaging apparatus according to claim 2, wherein the medicine rolling and moving device includes a first rotating roller and a second rotating roller arranged side by side, wherein the medicine rolling and moving device is configured to rotate the medicines arranged on the first rotating roller and the second rotating roller, wherein the medicine rolling and moving device is configured to dispense the medicines by expanding a clearance between the first rotating roller and the second rotating roller, wherein the medicine rolling and moving device has a movable portion for movably supporting a support axis of one of the first rotating roller and the second rotating roller, wherein the medicine rolling and moving device is configured to move the support axis in a direction for expanding the clearance between the first rotating roller and the second rotating roller by applying external force in a direction for lifting the movable portion and return to a state that the medicines can be arranged on the first rotating roller and the second rotating roller by releasing the external force to allow the movable portion to be lowered due to its own weight.

10. The medicine packaging apparatus according to claim 9, wherein the medicine packaging apparatus is configured to fix the movable portion with fixing force due to magnetic force in a state that the movable portion is lowered.

11. The medicine packaging apparatus according to claim 1, wherein a tray is provided on the lower side of the pre-packaging photographing portion.

12. The medicine packaging apparatus according to claim 1, wherein the reading control part performs one or both of a process for recognizing the identification information attached to the medicine as textual information and obtaining the identification information based on an identification information text master in which information on the medicine is defined by the textual information and a process for recognizing the identification information attached to the medicine as image information and obtaining the identification information based on an identification information image master in which information on the medicine is defined by the image information.

13. The medicine packaging apparatus according to claim 1, wherein the packaging portion includes:

a heating portion for heating a packaging paper supplied for packaging the medicines, a medicine introducing portion for introducing the medicines into the packaging paper on an upper stream side of a carrying direction of the packaging paper than the heating portion, and a blowing portion which can blow air into the packaging paper on the upper stream side of the carrying direction of the packaging paper than the heating portion.

14. The medicine packaging apparatus according to claim 13, wherein the blowing due to the blowing portion is performed under a condition that the medicine packaging apparatus is standing-by for supplying the medicines from the medicine introducing portion into the packaging paper.

15. The medicine packaging apparatus according to claim 13, wherein the medicine packaging apparatus feeds the packaging paper to the side of the heating portion by a predetermined amount under a condition that a temperature in the packaging paper exceeds a predetermined temperature condition on the upper stream side of the carrying direction of the packaging paper than the heating portion.

16. The medicine packaging apparatus according to claim 1, further comprising a width expanding portion for expanding a width of the packaging paper on the upper stream side of the carrying direction of the packaging paper than the sealing portion, wherein the introduction detecting portion has a light emitting portion which can emit detection light and a light receiving portion which can receive the detection light, wherein the introduction detecting portion is configured to detect passing of the medicines under a condition that light-receiving of the detection light at the light receiving portion is stopped or a received amount of the detection light at the light receiving portion decreases during emitting of the detection light by the light emitting portion, wherein the light receiving portion is arranged on the side of the width expanding portion, and wherein the light emitting portion is arranged at a position facing the light receiving portion.

17. The medicine packaging apparatus according to claim 16, wherein the light emitting portion is provided on a blowing portion which can blow air into the packaging paper on the upper stream side of the carrying direction of the packaging paper than the sealing portion.

* * * * *